US007029101B2

(12) United States Patent
Delametter et al.

(10) Patent No.: US 7,029,101 B2
(45) Date of Patent: Apr. 18, 2006

(54) TAPERED MULTI-LAYER THERMAL ACTUATOR AND METHOD OF OPERATING SAME

(75) Inventors: Christopher N. Delametter, Rochester, NY (US); Edward P. Furlani, Lancaster, NY (US); John A. Lebens, Rush, NY (US); David P. Trauernicht, Rochester, NY (US); Antonio Cabal, Webster, NY (US); David S. Ross, Fairport, NY (US); Stephen F. Pond, Oakton, VA (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/953,398

(22) Filed: Sep. 29, 2004

(65) Prior Publication Data

US 2005/0052498 A1 Mar. 10, 2005

Related U.S. Application Data

(62) Division of application No. 10/293,982, filed on Nov. 13, 2002, now Pat. No. 6,817,702.

(51) Int. Cl.
*B41J 2/05* (2006.01)
*B41J 2/04* (2006.01)

(52) U.S. Cl. ..... 347/56; 347/54; 347/65

(58) Field of Classification Search ..... 347/54, 347/56, 61, 65

See application file for complete search history.

(56) References Cited

U.S. PATENT DOCUMENTS

| | | | | |
|---|---|---|---|---|
| 3,747,120 | A | 7/1973 | Stemme | 346/75 |
| 3,946,398 | A | 3/1976 | Kyser et al. | 346/1 |
| 4,296,421 | A | 10/1981 | Hara et al. | 346/140 R |
| 5,599,695 | A | 2/1997 | Pease et al. | 435/91.1 |
| 5,771,882 | A | 6/1998 | Psaros et al. | 128/203.12 |
| 5,902,648 | A | 5/1999 | Naka et al. | 427/558 |
| 6,067,797 | A | 5/2000 | Silverbrook | 60/528 |
| 6,087,638 | A | 7/2000 | Silverbrook | 218/540 |
| 6,180,427 | B1 | 1/2001 | Silverbrook | 428/21 |
| 6,209,989 | B1 | 4/2001 | Silverbrook | 347/54 |
| 6,234,609 | B1 | 5/2001 | Silverbrook | 347/54 |
| 6,239,821 | B1 | 5/2001 | Silverbrook | 347/54 |
| 6,243,113 | B1 | 6/2001 | Silverbrook | 347/54 |
| 6,247,791 | B1 | 6/2001 | Silverbrook | 347/54 |
| 6,254,793 | B1 | 7/2001 | Silverbrook | 216/27 |
| 6,258,284 | B1 | 7/2001 | Silverbrook | 216/27 |

(Continued)

FOREIGN PATENT DOCUMENTS

JP 20330543 1/1990

*Primary Examiner*—Stephen Meier
*Assistant Examiner*—An H. Do
(74) *Attorney, Agent, or Firm*—William R. Zimmerli

(57) ABSTRACT

An apparatus for and method of operating a thermal actuator for a micromechanical device, especially a liquid drop emitter for use in an ink jet printhead, is disclosed. The disclosed thermal actuator includes a base element and a cantilevered element including a thermo-mechanical bender portion extending from the base element to a free end tip. The thermo-mechanical bender portion includes a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the baffler layer is bonded between the first and second deflector layers.

36 Claims, 40 Drawing Sheets

U.S. PATENT DOCUMENTS 6,274,056 B1 8/2001 Silverbrook ..... 216/27
6,364,453 B1 4/2002 Silverbrook ..... 347/44
6,561,627 B1 * 5/2003 Jarrold et al. ..... 347/54
6,631,979 B1 * 10/2003 Lebens et al. ..... 347/54
6,647,766 B1 * 11/2003 Despont et al. ..... 73/105
6,824,249 B1 * 11/2004 Delametter et al. ..... 347/54

* cited by examiner

TAPERED MULTI-LAYER THERMAL ACTUATOR AND METHOD OF OPERATING SAME

This application is a divisional of prior application Ser. No. 10/293,982, filed Nov. 13, 2002 now U.S. Pat. No. 6,817,702.

CROSS REFERENCE TO RELATED APPLICATION

Reference is made to commonly-assigned co-pending U.S. patent applications: U.S. Ser. No. 10/293,653 filed Nov. 13, 2002, now U.S. Pat. No. 6,721,020, entitled "Thermal Actuator With Spatial Thermal Pattern," of Delametter, et al.; U.S. Ser. No. 10/293,077 filed Nov. 13, 2002, now U.S. Pat. No. 6,820,964, entitled "Tapered Thermal Actuator," of Trauemicht, et al.; U.S. Ser. No. 10/227,079, filed Nov. 13, 2002, now U.S. Pat. No. 6,824,249 entitled "Tapered Thermal Actuator," of Delametter et al.; U.S. Ser. No. 10/154,634, filed May 23, 2002, now U.S. Pat. No. 6,598,960 entitled "Multi-layer Thermal Actuator with Optimized Heater Length and Method of Operating Same," of Cabal et al.; U.S. Ser. No. 10/071,120, filed Feb. 08, 2002, now U.S. Pat. No. 6,588,884 entitled "Tri-layer Thermal Actuator and Method of Operating," of Furlani, et al.; U.S. Ser. No. 10/050,993, filed Oct. 14, 2003, now U.S. Pat. No. 6,631,979 entitled "Thermal Actuator With Optimized Heater Length," of Cabal, et al.; and U.S. Pat. No. 6,464,341, entitled "Dual Actuation Thermal Actuator and Method of Operating Thereof," of Furlani, et al.

FIELD OF THE INVENTION

The present invention relates generally to micro-electro-mechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electrically resistive heaters to generate vapor bubbles which cause drop emission, as is discussed by Hara et al., in U.S. Pat. No. 4,296,421.

Electrically resistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combine the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,087,638; 6,209,989; 6,234,609; 6,239,821; and 6,247,791. Methods of manufacturing thermo-mechanical ink jet devices using microelectronic processes have been disclosed by K. Silverbrook in U.S. Pat. Nos. 6,180,427; 6,254,793; 6,258,284 and 6,274,056. The term "thermal actuator" and thermo-mechanical actuator will be used interchangeably herein.

Thermo-mechanically actuated drop emitters are promising as low cost devices which can be mass produced using microelectronic materials and equipment and which allow operation with liquids that would be unreliable in a thermal ink jet device. Thermal actuators and thermal actuator style liquid drop emitters are needed which allow the movement of the actuator to be controlled to produce a predetermined displacement as a function of time. Highest repetition rates of actuation, and drop emission consistency, may be realized if the thermal actuation can be electronically controlled in concert with stored mechanical energy effects. Further, designs which maximize actuator movement as a function of input electrical energy also contribute to increased actuation repetion rates.

For liquid drop emitters, the drop generation event relies on creating a pressure impulse in the liquid at the nozzle, but also on the state of the liquid meniscus at the time of the pressure impulse. The characteristics of drop generation, especially drop volume, velocity and satellite formation may be affected by the specific time variation of the displacement of the thermal actuator. Improved print quality may be achieved by varying the drop volume to produce varying print density levels, by more precisely controlling target drop volumes, and by suppressing satellite formation. Printing productivity may be increased by reducing the time required for the thermal actuator to return to a nominal starting displacement condition so that a next drop emission event may be initiated.

Apparatus and methods of operation for thermal actuators and DOD emitters are needed which minimize the energy utilized and which enable improved control of the time varying displacement of the thermal actuator so as to maximize the productivity of such devices and to create liquid pressure profiles for favorable liquid drop emission characteristics.

A useful design for thermo-mechanical actuators is a layered, or laminated, cantilevered beam anchored at one end to the device structure with a free end that deflects perpendicular to the beam. The deflection is caused by setting up thermal expansion gradients in the layered beam, perpendicular to the laminations. Such expansion gradients may be caused by temperature gradients among layers. It is advantageous for pulsed thermal actuators to be able to establish such temperature gradients quickly, and to dissipate them quickly as well, so that the actuator will rapidly restore to an initial position. An optimized cantilevered element may be constructed by using electroresistive materials which are partially patterned into heating resisters for some layers.

A dual actuation thermal actuator configured to generate opposing thermal expansion gradients, hence opposing beam deflections, is useful in a liquid drop emitter to generate pressure impulses at the nozzle which are both positive and negative. Control over the generation and timing of both positive and negative pressure impulses allows fluid and nozzle meniscus effects to be used to favorably alter drop emission characteristics.

Designs which produce a comparable amount of deflection and a deflection force while requiring less input energy than previous configurations are needed to enhance the commercial potential of various thermally actuated devices, especially ink jet printheads. The shape of the thermo-mechanical bender portion of the cantilevered element may be optimized to reduce the affect of loading or liquid backpressure, thereby reducing the needed input energy.

The spatial pattern of thermal heating may be altered to result in more deflection for less input of electrical energy. K. Silverbrook has disclosed thermal actuators which have spatially non-uniform thermal patterns in U.S. Pat. Nos. 6,243,113 and 6,364,453. However, the thermo-mechanical bending portions of the disclosed thermal actuators are not configured to be operated in contact with a liquid, rendering them unreliable for use in such devices as liquid drop emitters and microvalves. The disclosed designs are based on coupled arm structures which are inherently difficult to fabricate, may develop post-fabrication twisted shapes, and are subject to easy mechanical damage. The thermal actuator designs disclosed in Silverbrook '113 have structurally weak base ends which are subjected to peak temperatures, possibly causing early failure.

Further, the thermal actuator designs disclosed in Silverbrook '453 are directed at solving an anticipated problem of an excessive temperature increase in the center of the thermal actuator, and do not offer increased energy efficiency during actuation. The disclosed actuator designs have heat sink components which increase undesirable liquid backpressure effects when used immersed in a liquid, and, further, add isolated mass which may slow actuator cool down, limiting maximum reliable operating frequencies.

Cantilevered element thermal actuators, which can be operated with reduced energy and at acceptable peak temperatures, and which can be deflected in controlled displacement versus time profiles, are needed in order to build systems that can be fabricated using MEMS fabrication methods and also enable liquid drop emission at high repetition frequency with excellent drop formation characteristics.

SUMMARY OF THE INVENTION

It is therefore an object of the present invention to provide a thermo-mechanical actuator which uses reduced input energy and which does not require excessive peak temperatures.

It is also an object of the present invention to provide an energy efficient thermal actuator which comprises dual actuation means that move the thermal actuator in substantially opposite directions allowing rapid restoration of the actuator to a nominal position and more rapid repetitions.

It is also an object of the present invention to provide a liquid drop emitter which is actuated by an energy efficient thermal actuator configured using a cantilevered element designed to restore to an initial position when reaching a uniform internal temperature.

It is further an object of the present invention to provide a liquid drop emitter which is actuated using a thermo-mechanical bender portion which is shaped to reduce the affect of loading or back pressures and energized by a heater resistor having a spatial thermal pattern to improve energy efficiency.

It is further an object of the present invention to provide a method of operating an energy efficient thermal actuator utilizing dual actuations to achieve a predetermined resultant time varying displacement.

It is further an object of the present invention to provide a method of operating a liquid drop emitter having an energy efficient thermal actuator utilizing dual actuations to adjust a characteristic of the liquid drop emission.

The foregoing and numerous other features, objects and advantages of the present invention will become readily apparent upon a review of the detailed description, claims and drawings set forth herein. These features, objects and advantages are accomplished by constructing a thermal actuator for a micro-electromechanical device comprising a base element and a cantilevered element including a thermo-mechanical bender portion extending from the base element and a free end tip which resides in a first position. The thermo-mechanical bender portion having a base end and base end width, $w_b$, adjacent the base element, and a free end and free end width, $w_f$, adjacent the free end tip, wherein the base end width is substantially greater than the free end width. Apparatus adapted to apply a heat pulse directly to the thermo-mechanical bender portion is provided. The heat pulses have a spatial thermal pattern which results in a greater temperature increase of the base end than the free end of the thermo-mechanical bender portion. The rapid heating of the thermo-mechanical bender portion causes the deflection of the free end tip of the cantilevered element to a second position.

The features, objects and advantages are also accomplished by constructing a thermal actuator for a micro-electromechanical device comprising a base element and a cantilevered element including a thermo-mechanical bender portion extending from the base element to a free end tip residing at a first position. The thermo-mechanical bender portion includes a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers. The thermo-mechanical bender portion further has a base end and base end width, $w_b$, adjacent the base element, and a free end and free end width, $w_f$, adjacent the free end tip, wherein the base end width is substantially greater than the free end width. A first heater resistor is formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end. A second heater resistor is formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end. A first pair of electrodes is connected to the first heater resistor to apply an electrical pulse to cause resistive heating of the first deflector layer, resulting in a thermal expansion of the first deflector layer relative to the second deflector layer. A second pair of electrodes is connected to the second heater resistor portion to apply an electrical pulse to cause resistive heating of the second deflector layer, resulting in a thermal expansion of the second deflector layer relative to the first deflector layer. Application of an electrical pulse to either the first pair or the second pair of electrodes causes deflection of the cantilevered element away from the first position to a second position, followed by restoration of the cantilevered element to the first position as heat diffuses through the barrier layer and the cantilevered element reaches a uniform temperature.

The present inventions are particularly useful as thermal actuators for liquid drop emitters used as printheads for DOD ink jet printing. In these preferred embodiments the thermal actuator resides in a liquid-filled chamber that includes a nozzle for ejecting liquid. The thermal actuator includes a cantilevered element extending from a wall of the chamber and a free end residing in a first position proximate to the nozzle. Application of an electrical pulse to either the first pair or the second pair of electrodes causes deflection of the cantilevered element away from its first position and, alternately, causes a positive or negative pressure in the liquid at the nozzle. Application of electrical pulses to the first and second pairs of electrodes, and the timing thereof, are used to adjust the characteristics of liquid drop emission.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a thermo-mechanical actuator and a drop-on-demand liquid emission device and methods of operating same. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermal actuators so as to improve overall drop emission productivity.

Figure 1:
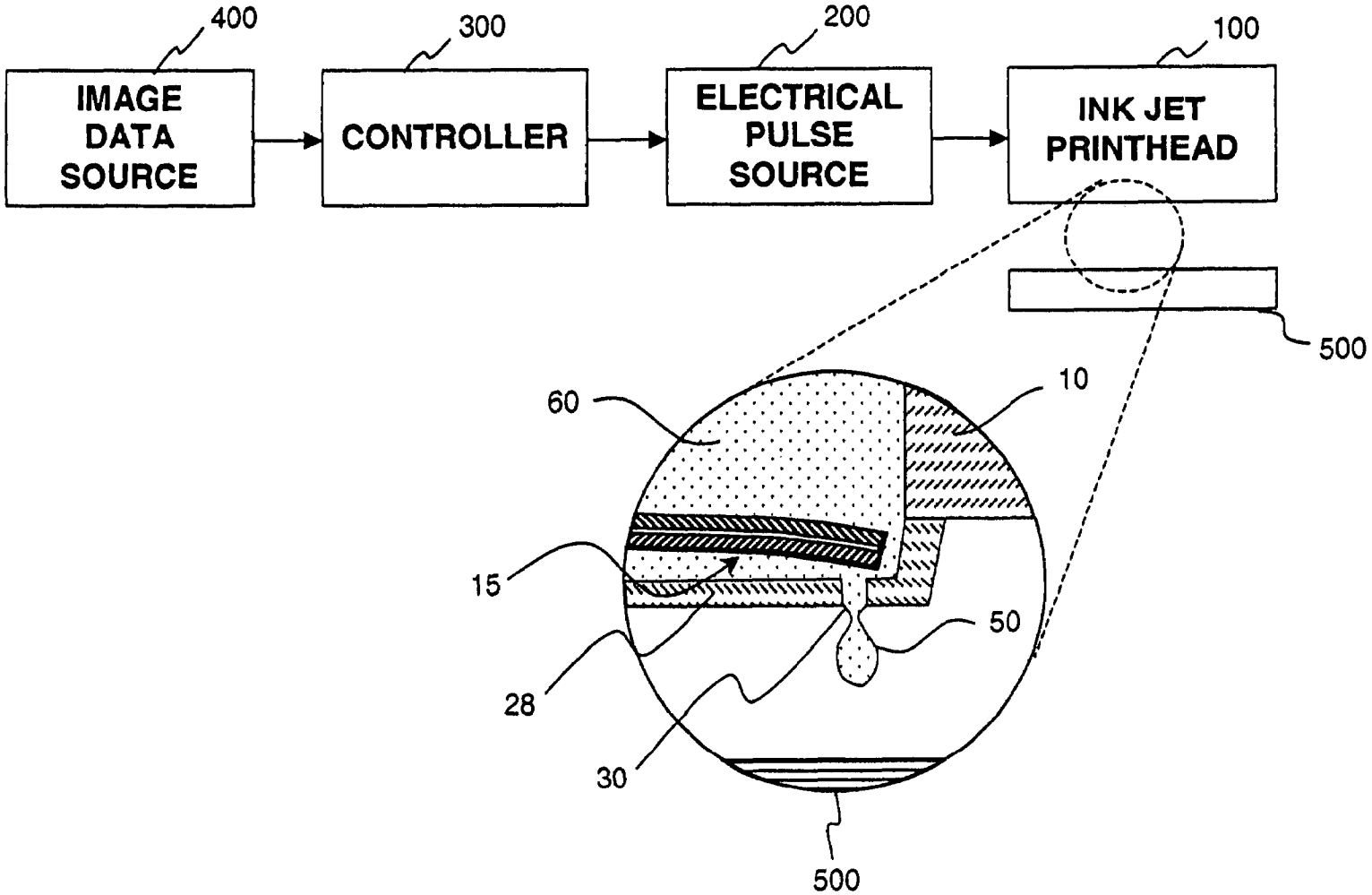
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermal actuator 15 within ink jet printhead 100. The electrical energy pulses cause a thermal actuator 15 to rapidly bend, pressurizing ink 60 located at nozzle 30, and emitting an ink drop 50 which lands on receiver 500. The present invention causes the emission of drops having substantially the same volume and velocity, that is, having volume and velocity within +/−20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
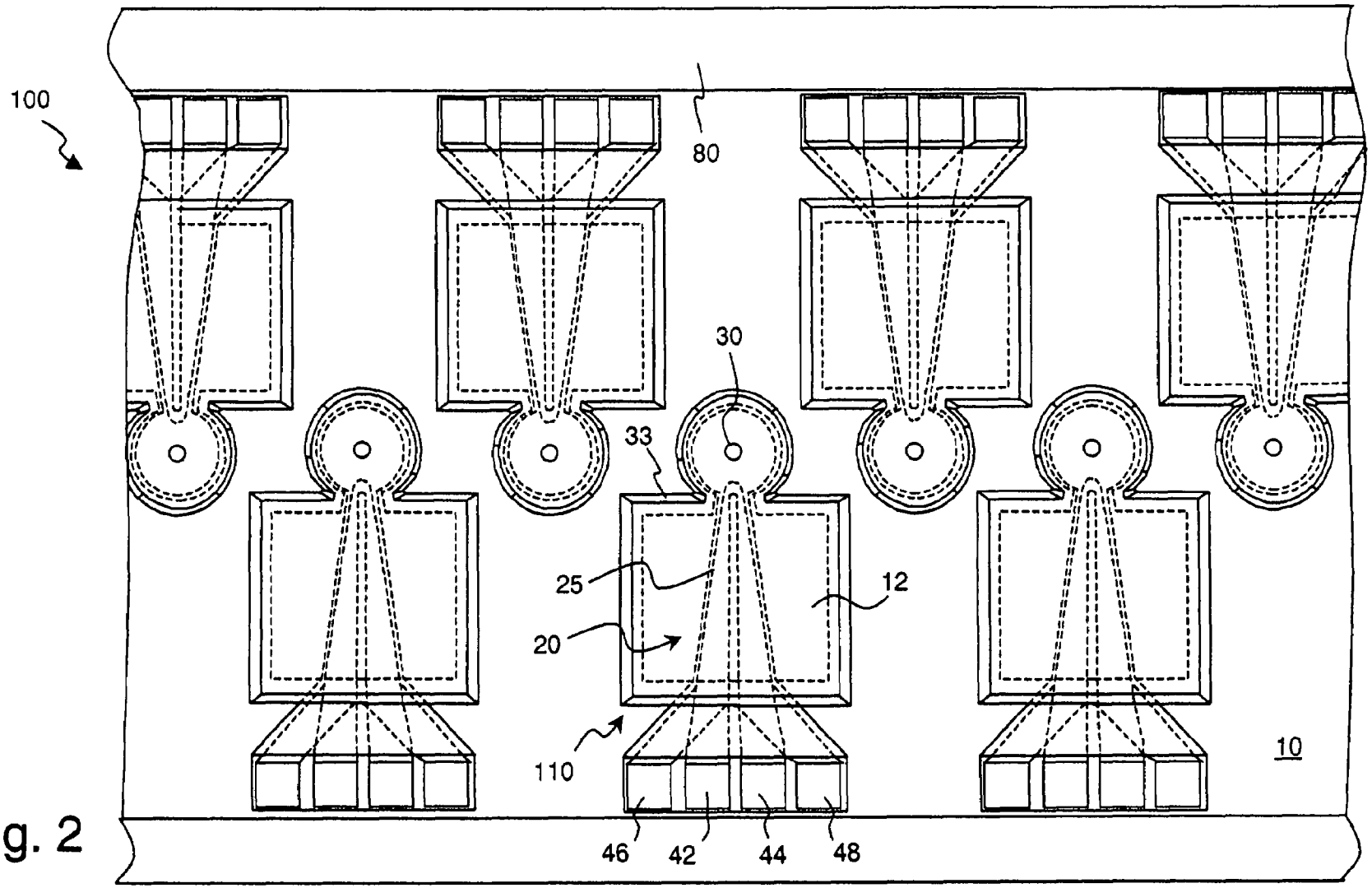
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Each drop emitter unit 110 has an associated first pair of electrodes 42, 44 which are formed with, or are electrically connected to, an electrically resistive heater portion in a first deflector layer of a thermo-mechanical bender portion 25 of the thermal actuator and which participates in the thermo-mechanical effects as will be described hereinbelow. Each drop emitter unit 110 also has an associated second pair of electrodes 46, 48 which are formed with, or are electrically connected to, an electrically resistive heater portion in a second deflector layer of the thermo-mechanical bender portion 25 and which also participates in the thermo-mechanical effects as will be described hereinbelow. The heater resistor portions formed in the first and second deflector layers are above one another and are indicated by phantom lines in FIG. 2. Element 80 of the printhead 100 is a mounting structure which provides a mounting surface for microelectronic substrate 10 and other means for interconnecting the liquid supply, electrical signals, and mechanical interface features.

Figure 3A:
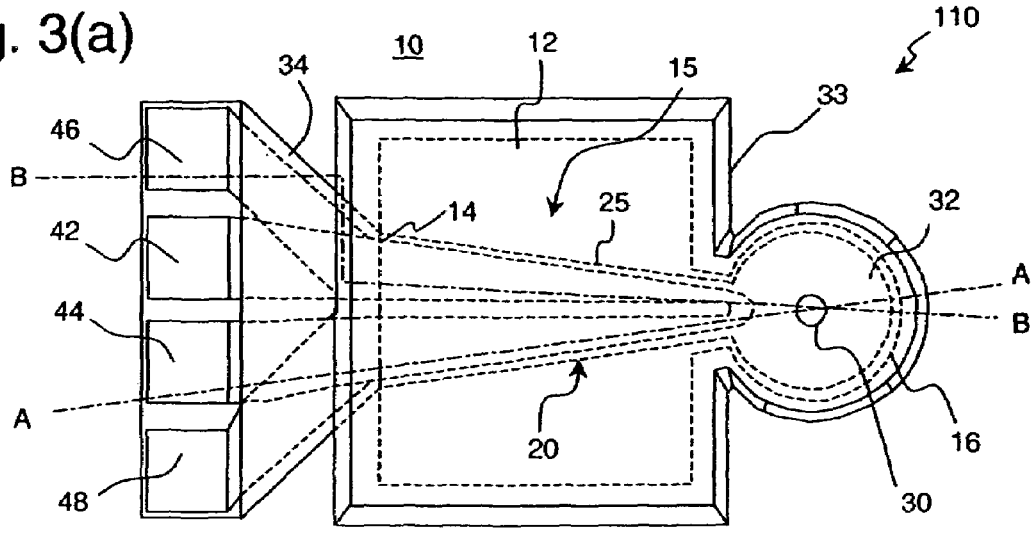
FIGS. 3(*a*) and 3(*b*) are enlarged plan views of an individual ink jet unit shown in FIG. 2.
Figure 3B:
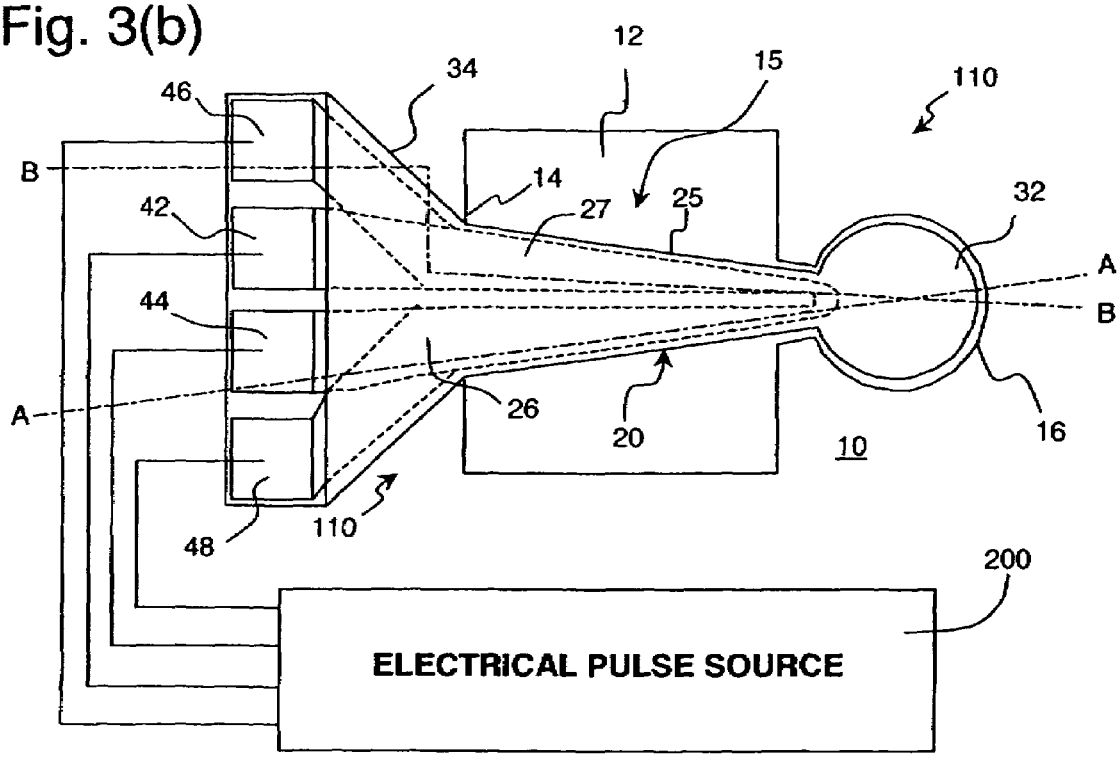

FIG. 3*a* illustrates a plan view of a single drop emitter unit 110 and, a second plan view, FIG. 3*b*, with the liquid chamber cover 33, including nozzle 30, removed. The thermal actuator 15, shown in phantom in FIG. 3*a* can be seen with solid lines in FIG. 3*b*. The cantilevered element 20 of thermal actuator 15 extends from edge 14 of liquid chamber 12 which is formed in substrate 10. Cantilevered element portion 34 is bonded to substrate 10 which serves as a base element anchoring the cantilever.

The cantilevered element 20 of the actuator has the shape of a paddle, an extended, tapered flat shaft ending with a disc of larger diameter than the final shaft width. This shape is merely illustrative of cantilever actuators which can be used, many other shapes are applicable as will be described hereinbelow. The disc-shape aligns the nozzle 30 with the center of the cantilevered element free end tip 32. The fluid chamber 12 has a curved wall portion at 16 which conforms to the curvature of the free end tip 32, spaced away to provide clearance for the actuator movement.

FIG. 3*b* illustrates schematically the attachment of electrical pulse source 200 to a second heater resistor 27 (shown in phantom) formed in the second deflector layer of the thermo-mechanical bender portion 25 at a second pair of electrodes 46 and 48. Voltage differences are applied to electrodes 46 and 48 to cause resistance heating of the second deflector layer. A first heater resistor 26 formed in the first deflector layer is hidden below second heater resistor 27 (and a barrier layer) but may be seen indicated by phantom lines emerging to make contact to a first pair of electrodes 42 and 44. Voltage differences are applied to electrodes 42 and 44 to cause resistance heating of the first deflector layer. Heater resistors 26 and 27 are designed to provide a spatial thermal pattern to the layer in which they are patterned. While illustrated as four separate electrodes 42, 44, 46, and 48, having connections to electrical pulse source 200, one member of each pair of electrodes could be brought into electrical contact at a common point so that heater resistors 26 and 27 could be addressed using three inputs from electrical pulse source 200.

In the plan views of FIGS. 3*a*–3*b*, the actuator free end 32 moves toward the viewer when the first deflector layer is heated appropriately by first heater resistor 26 and drops are emitted toward the viewer from the nozzle 30 in liquid chamber cover 33. This geometry of actuation and drop emission is called a "roof shooter" in many ink jet disclosures. The actuator free end 32 moves away from the viewer of FIGS. 3*a*–3*b*, and nozzle 30, when the second deflector layer is heated by second heater resistor 27. This actuation of free end 32 away from nozzle 30 may be used to restore the cantilevered element 20 to a nominal position, to alter the state of the liquid meniscus at nozzle 30, to change the liquid pressure in the fluid chamber 12 or some combination of these and other effects.

Figure 4A:
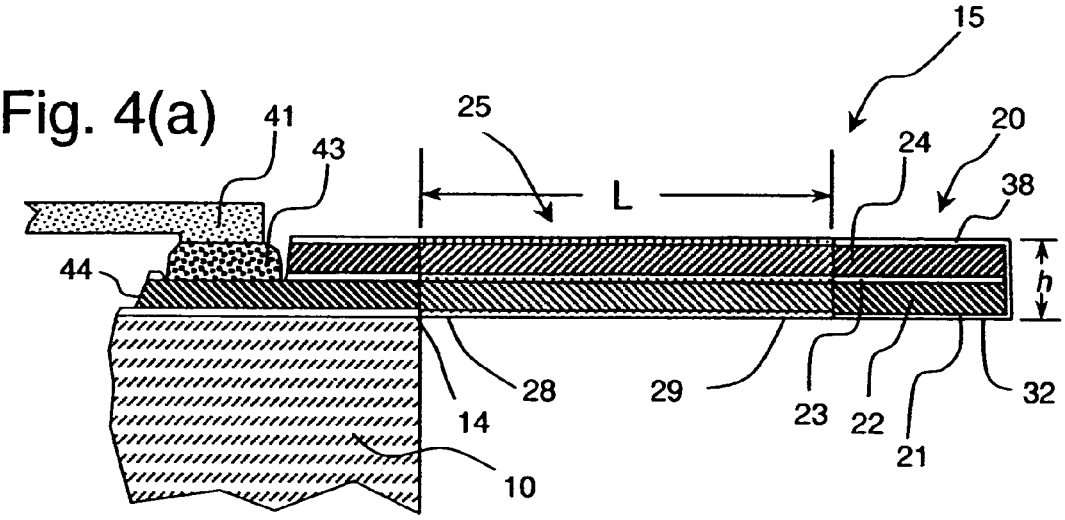
FIGS. 4(*a*)–4(*c*) are side views illustrating the movement of a thermal actuator according to the present invention.
Figure 4B:
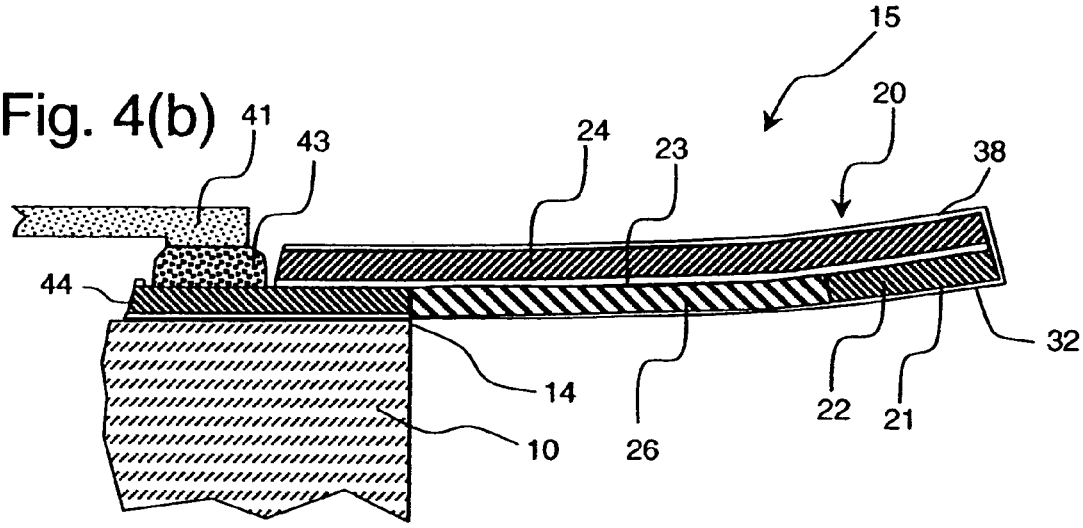
Figure 4C:
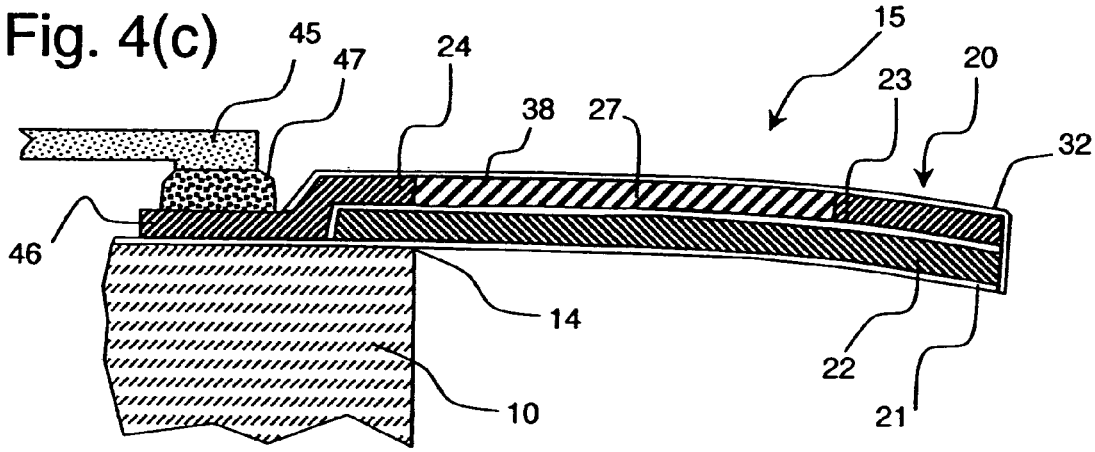

FIGS. 4*a*–4*c* illustrate in side view cantilevered thermal actuators 15 according to a preferred embodiment of the present invention. In FIG. 4*a* thermal actuator 15 is in a first position and in FIG. 4*b* it is shown deflected upward to a second position. The side views of FIGS. 4*a* and 4*b* are formed along line A—A in plan view FIG. 3*b*. In side view FIG. 4*c*, formed along line B—B of plan view FIG. 3*b*, thermal actuator 15 is illustrated as deflected downward to a third position. Cantilevered element 20 is anchored to substrate 10 which serves as a base element for the thermal actuator. Cantilevered element 20 includes a thermo-mechanical bender portion 25 extending a length L from wall edge 14 of substrate base element 10. Thermo-mechanical bender portion 25 has a base end 28 adjacent base element 10 and a free end 29 adjacent free end tip 32. The overall thickness, h, of cantilevered element 20 and thermo-mechanical bender portion 25 is indicated in FIG. 4.

Cantilevered element 20, including thermo-mechanical bender portion 25, is constructed of several layers or laminations. Layer 22 is the first deflector layer which causes the upward deflection when it is thermally elongated with respect to other layers in cantilevered element 20. Layer 24 is the second deflector layer which causes the downward deflection of thermal actuator 15 when it is thermally elongated with respect of the other layers in cantilevered element 20. First and second deflector layers are preferably constructed of materials that respond to temperature with substantially the same thermo-mechanical effects.

The second deflector layer mechanically balances the first deflector layer, and vice versa, when both are in thermal equilibrium. This balance many be readily achieved by using the same material for both the first deflector layer 22 and the second deflector layer 24. The balance may also be achieved by selecting materials having substantially equal coefficients of thermal expansion and other properties to be discussed hereinbelow.

For some of the embodiments of the present invention the second deflector layer 24 is not patterned with a second uniform resister portion 27. For these embodiments, second deflector layer 24 acts as a passive restorer layer which mechanically balances the first deflector layer when the cantilevered element 20 reaches a uniform internal temperature.

The cantilevered element 20 also includes a barrier layer 23, interposed between the first deflector layer 22 and second deflector layer 24. The barrier layer 23 is constructed of a material having a low thermal conductivity with respect to the thermal conductivity of the material used to construct the first deflector layer 22. The thickness and thermal conductivity of barrier layer 23 is chosen to provide a desired time constant $\tau_B$ for heat transfer from first deflector layer 22 to second deflector layer 24. Barrier layer 23 may also be a dielectric insulator to provide electrical insulation, and partial physical definition, for the electrically resistive heater portions of the first and second deflector layers.

Barrier layer 23 may be composed of sub-layers, laminations of more than one material, so as to allow optimization of functions of heat flow management, electrical isolation, and strong bonding of the layers of the cantilevered element 20. Multiple sub-layer construction of barrier layer 23 may also assist the discrimination of patterning fabrication processes utilized to form the heater resistors of the first and second deflector layers.

First and second deflector layers 22 and 24 likewise may be composed of sub-layers, laminations of more than one material, so as to allow optimization of functions of electrical parameters, thickness, balance of thermal expansion effects, electrical isolation, strong bonding of the layers of the cantilevered element 20, and the like. Multiple sub-layer construction of first and second deflector layers 22 and 24 may also assist the discrimination of patterning fabrication processes utilized to form the heater resistors of the first and second deflector layers.

In some alternate embodiments of the present inventions, the barrier layer 23 is provided as a thick layer constructed of a dielectric material having a low coefficient of thermal expansion and the second deflector layer 24 is deleted. For these embodiments the dielectric material barrier layer 23 performs the role of a second layer in a bi-layer thermo-mechanical bender. The first deflector layer 22, having a large coefficient of thermal expansion provides the deflection force by expanding relative to a second layer, in this case barrier layer 23.

Passivation layer 21 and overlayer 38 shown in FIGS. 4*a*–4*c* are provided to protect the cantilevered element 20 chemically and electrically. Such protective layers may not be needed for some applications of thermal actuators according to the present invention, in which case they may be deleted. Liquid drop emitters utilizing thermal actuators which are touched on one or more surfaces by the working liquid may require passivation layer 21 and overlayer 38 which are made chemically and electrically inert to the working liquid.

In FIG. 4*b*, a heat pulse has been applied to first deflector layer 22, causing it to rise in temperature and elongate. Second deflector layer 24 does not elongate initially because barrier layer 23 prevents immediate heat transfer to it. The difference in temperature, hence, elongation, between first deflector layer 22 and the second deflector layer 24 causes the cantilevered element 20 to bend upward. When used as actuators in drop emitters the bending response of the cantilevered element 20 must be rapid enough to sufficiently pressurize the liquid at the nozzle. Typically, first heater resistor 26 of the first deflector layer is adapted to apply appropriate heat pulses when an electrical pulse duration of less than 10 μsecs., and, preferably, a duration less than 4 μsecs., is used.

In FIG. 4*c*, a heat pulse has been applied to second deflector layer 24, causing it to rise in temperature and elongate. First deflector layer 22 does not elongate initially because barrier layer 23 prevents immediate heat transfer to it. The difference in temperature, hence, elongation, between second deflector layer 24 and the first deflector layer 22 causes the cantilevered element 20 to bend downward. Typically, second heater resistor 27 of the second deflector layer is adapted to apply appropriate heat pulses when an electrical pulse duration of less than 10 μsecs., and, preferably, a duration less than 4 μsecs., is used.

Depending on the application of the thermal actuator, the energy of the electrical pulses, and the corresponding amount of cantilever bending that results, may be chosen to be greater for one direction of deflection relative to the other. In many applications, deflection in one direction will be the primary physical actuation event. Deflections in the opposite direction will then be used to make smaller adjustments to the cantilever displacement for pre-setting a condition or for restoring the cantilevered element to its quiescent first position.

FIGS. 5 through 13*c* illustrate fabrication processing steps for constructing a single liquid drop emitter according to some of the preferred embodiments of the present invention. For these embodiments the first deflector layer 22 is constructed using an electrically resistive material, such as titanium aluminide, and a portion is patterned into a resistor for carrying electrical current. A second deflector layer 24 is constructed also using an electrically resistive material, such as titanium aluminide, and a portion is patterned into a resistor for carrying electrical current. A dielectric barrier layer 23 is formed in between first and second deflector layers to control heat transfer timing between deflector layers.

For other embodiments of the present inventions, the second deflector layer 24 is omitted and a thick barrier layer 23 serves as a low thermal expansion second layer, together with high expansion first deflector layer 22, in forming a bi-layer thermo-mechanical bender portion of a cantilevered element thermal actuator.

Figure 5:
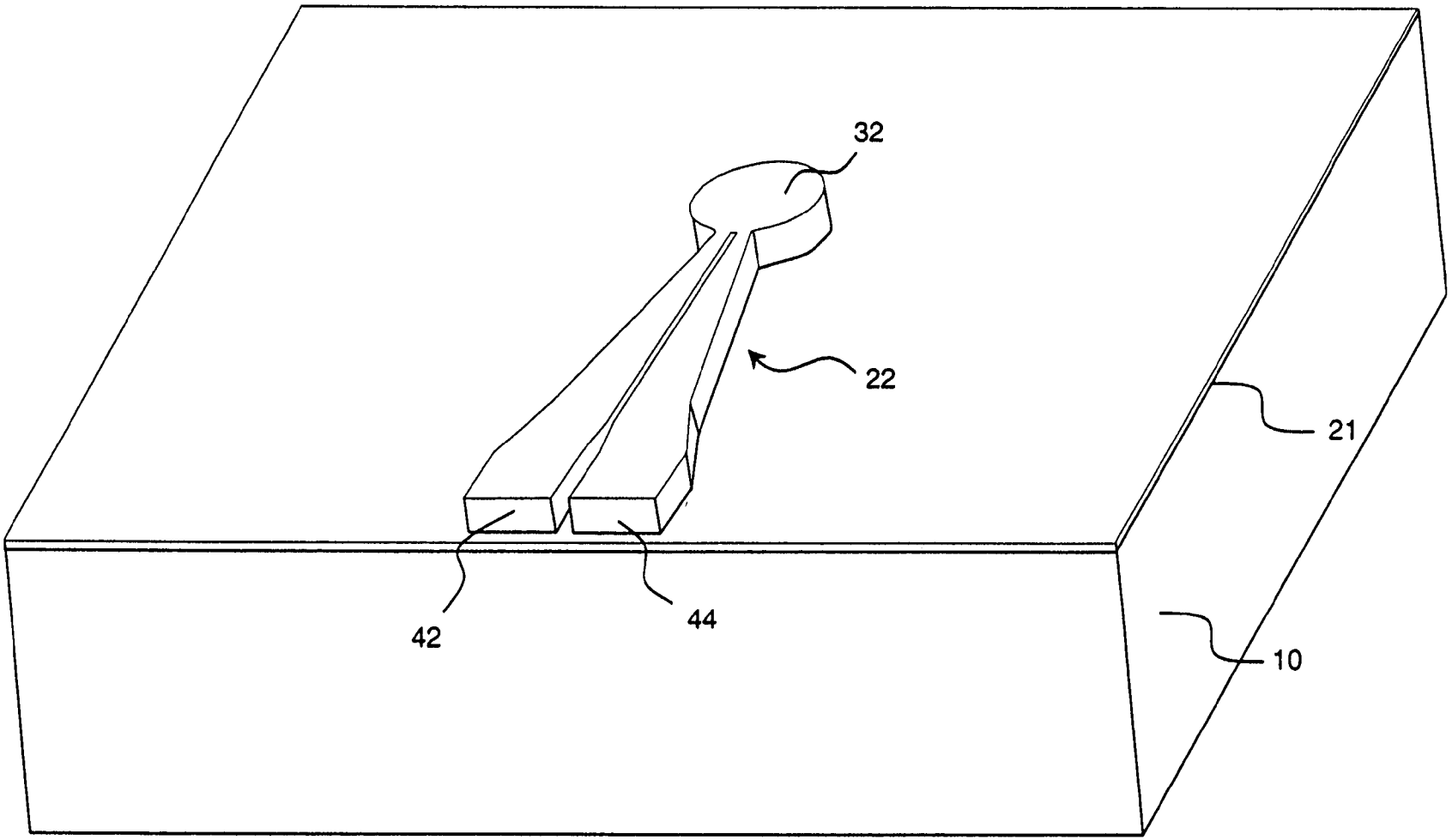
FIG. 5 is a perspective view of the early stages of a process suitable for constructing a thermal actuator according to the present invention wherein a first deflector layer of the cantilevered element is formed.

FIG. 5 illustrates in perspective view a first deflector layer 22 portion of a cantilever, as shown in FIG. 3*b*, in a first stage of fabrication. A first material having a high coefficient of thermal expansion, for example titanium aluminide, is deposited and patterned to form the first deflector layer structure. The illustrated structure is formed on a substrate 10, for example, single crystal silicon, by standard microelectronic deposition and patterning methods. Deposition of intermetallic titanium aluminide may be carried out, for example, by RF or pulsed DC magnetron sputtering. First deflector layer 22 is patterned to partially form a first heater resistor. The free end tip 32 portion of the first deflector layer is labeled for reference. First electrode pair 42 and 44 will eventually be attached to a source of electrical pulses 200.

Figure 6:
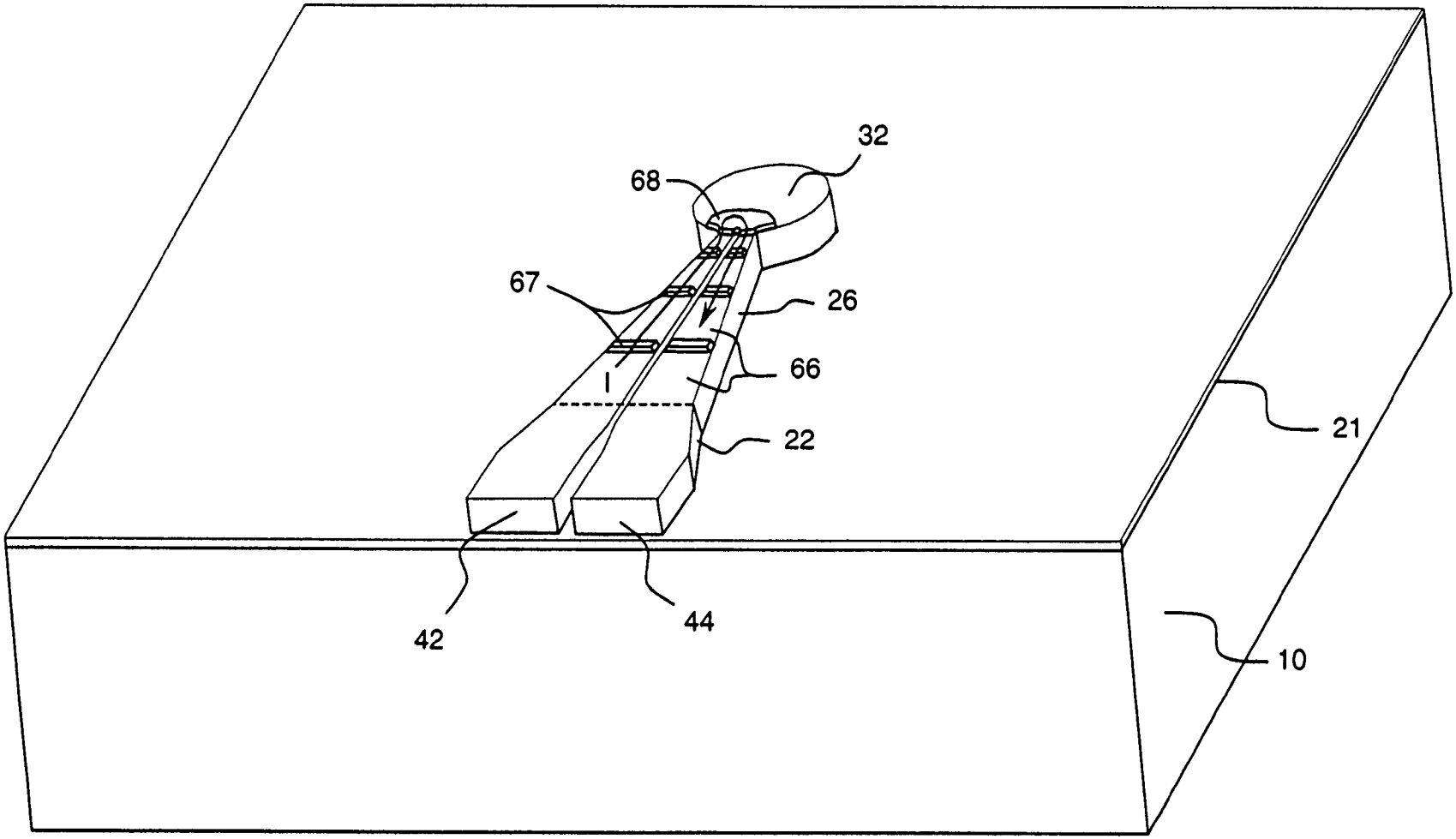
FIG. 6 is a perspective view of a next stage of a process suitable for construction a thermal actuator according to the present inventions wherein a first heater resistor is formed in the first deflector layer by addition of conductive material and patterning.

FIG. 6 illustrates in perspective view a next step in the fabrication wherein a conductive material is deposited and patterned to complete the formation of first heater resistor 26 in first deflector layer 22. Typically the conductive layer will be formed of a metal conductor such as aluminum. However, overall fabrication process design considerations may be better served by other higher temperature materials, such as silicides, which have less conductivity than a metal but substantially higher conductivity than the conductivity of the electrically resistive material.

First heater resister 26 is comprised of heater resistor segments 66 formed in the first material of the first deflector layer 22, a current coupling device 68 which conducts current serially from input electrode 42 to input electrode 44, and current shunts 67 which modify the power density of electrical energy input to the first resistor. Heater resistor segments 66 and current shunts 67 are designed to establish a spatial thermal pattern in the first deflector layer. The current path is indicated by an arrow and letter "I".

Electrodes 42, 44 may make contact with circuitry previously formed in substrate 10 or may be contacted externally by other standard electrical interconnection methods, such as tape automated bonding (TAB) or wire bonding. A passivation layer 21 is formed on substrate 10 before the deposition and patterning of the first material. This passivation layer may be left under deflector layer 22 and other subsequent structures or patterned away in a subsequent patterning process.

An alternative approach to that illustrated in FIG. 6 would be to modify the resistivity of the first deflector layer material to make it significantly more conductive in a spatial pattern similar to the illustrated current shunt pattern. Increased conductivity may be achieved by in situ processing of the electrically resistive material forming first layer 22. Examples of in situ processing to increase conductivity include laser annealing, ion implantation through a mask, or thermal diffusion doping.

Figure 7:
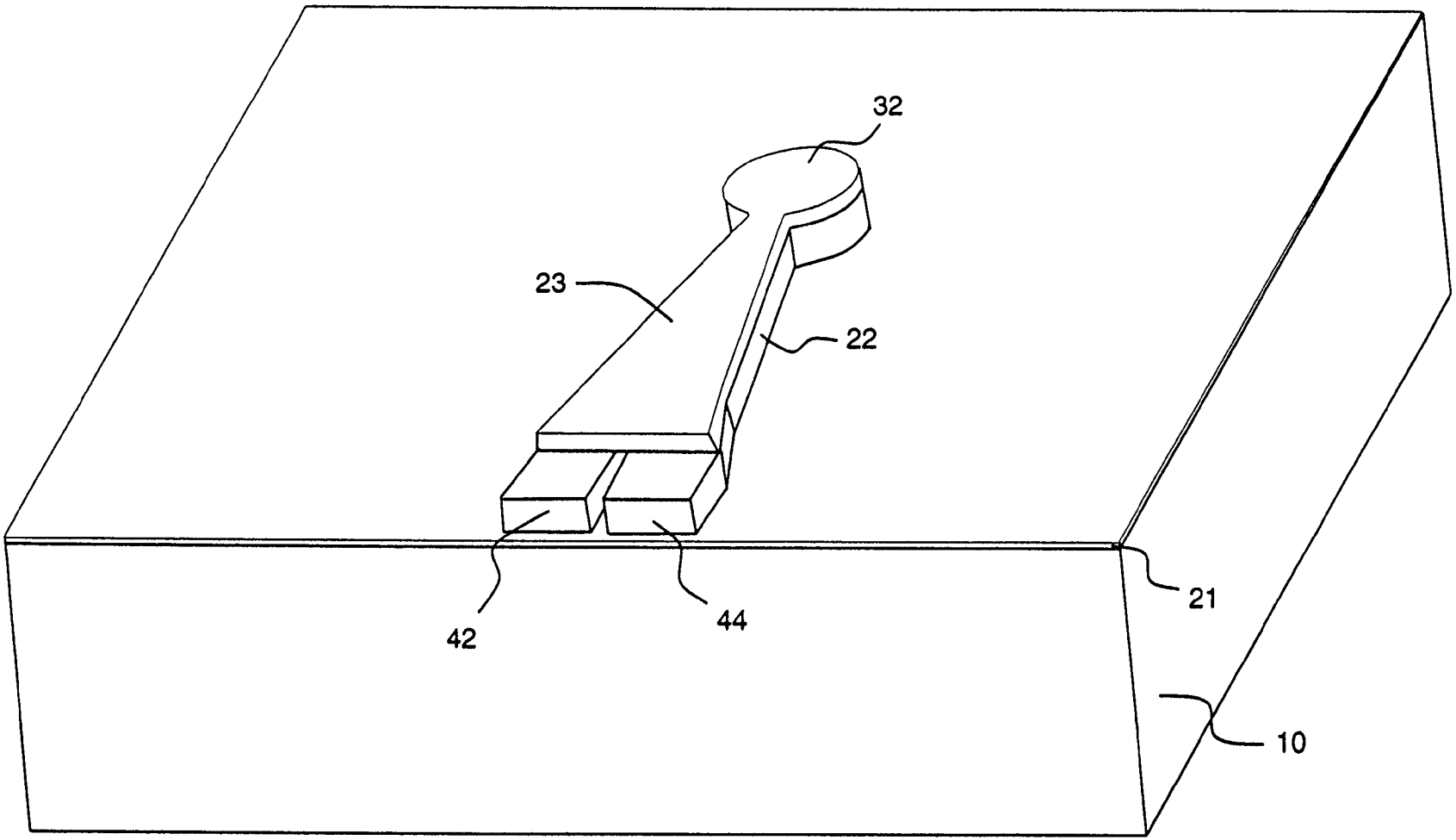
FIG. 7 is a perspective view of the next stages of the process illustrated in FIGS. 5–6 wherein a second layer or a barrier layer of the cantilevered element is formed.

FIG. 7 illustrates in perspective view a barrier layer 23 having been deposited and patterned over the previously formed first deflector layer 22 and the first heater resistor 26. The barrier layer 23 material has low thermal conductivity compared to the first deflector layer 22. For example, barrier layer 23 may be silicon dioxide, silicon nitride, aluminum oxide or some multi-layered lamination of these materials or the like. The barrier layer 23 material is also a good electrical insulator, a dielectric, providing electrical passivation for the first heater resistor components previously discussed.

Favorable efficiency of the thermal actuator is realized if the barrier layer 23 material has thermal conductivity substantially below that of both the first deflector layer 22 material and the second deflector layer 24 material. For example, dielectric oxides, such as silicon oxide, will have thermal conductivity several orders of magnitude smaller than intermetallic materials such as titanium aluminide. Low thermal conductivity allows the barrier layer 23 to be made thin relative to the first deflector layer 22 and second deflector layer 24. Heat stored by barrier layer 23 is not useful for the thermo-mechanical actuation process. Minimizing the volume of the barrier layer improves the energy efficiency of the thermal actuator and assists in achieving rapid restoration from a deflected position to a starting first position. The thermal conductivity of the barrier layer 23 material is preferably less than one-half the thermal conductivity of the first deflector layer or second deflector layer materials, and more preferably, less than one-tenth.

In some embodiments of the present invention, barrier layer 23 is formed as a thick layer having a thickness comparable to or greater than the thickness of the first deflector layer. In these embodiments barrier layer 23 serves as a low thermal expansion second layer, together with high expansion first deflection layer 22, in forming a bi-layer thermo-mechanical bender portion of a cantilevered element thermal actuator. For these embodiments the next two or three fabrication steps, illustrated in FIGS. 8–10, may be omitted.

Figure 8:
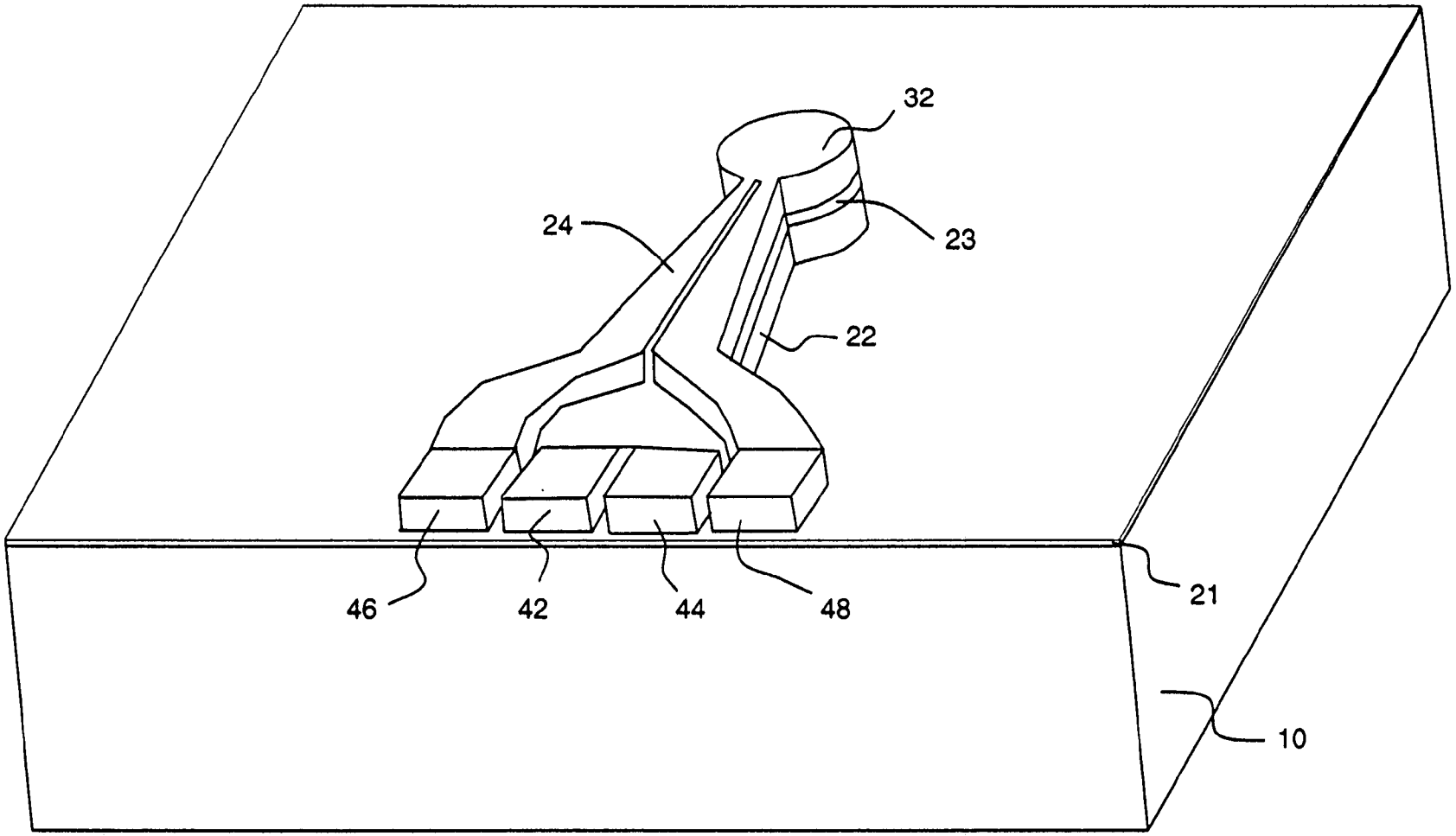
FIG. 8 is a perspective view of the next stages of the process illustrated in FIGS. 5–7 wherein a second deflector layer of the cantilevered element is formed.

FIG. 8 illustrates in perspective view a second deflector layer 24 of a cantilevered element thermal actuator. A second material having a high coefficient of thermal expansion, for example titanium aluminide, is deposited and patterned to form the second deflector layer structure. Second deflector layer 24 is patterned to partially form a second heater resistor. The free end tip 32 portion of the second deflector layer is labeled for reference.

In the illustrated embodiment, a second pair of electrodes 46 and 48, for addressing a second heater resistor are formed in the second deflector layer 24 material brought over the barrier layer 23 to contact positions on either side of the first pair of electrodes 42 and 44. Electrodes 46 and 48 may make contact with circuitry previously formed in substrate 10 or may be contacted externally by other standard electrical interconnection methods, such as tape automated bonding (TAB) or wire bonding.

Figure 9:
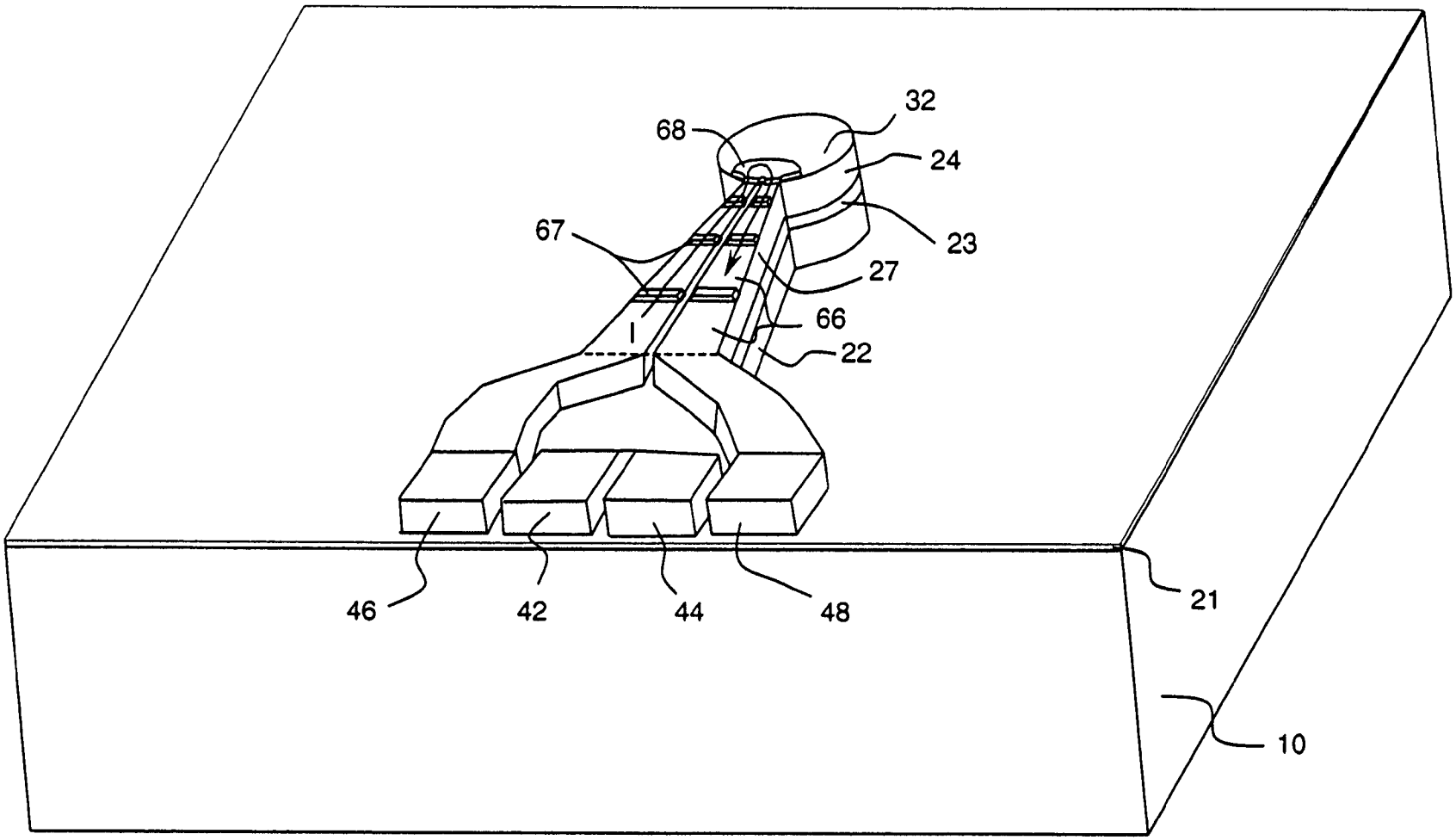
FIG. 9 is a perspective view of the next stages of the process illustrated in FIGS. 5–8 wherein a second heater resistor is formed in the second deflector layer by addition of conductive material and patterning.

FIG. 9 illustrates in perspective view a next step in the fabrication wherein a conductive material is deposited and patterned to complete the formation of second heater resistor 27 in second deflector layer 24. Typically the conductive layer will be formed of a metal conductor such as aluminum. However, overall fabrication process design considerations may be better served by other higher temperature materials, such as silicides, which have less conductivity than a metal but substantially higher conductivity than the conductivity of the electrically resistive material.

Second heater resister 27 is comprised of heater resistor segments 66 formed in the second material of the second deflector layer 24, a current coupling device 68 which conducts current serially from input electrode 46 to input electrode 48, and current shunts 67 which modify the power density of electrical energy input to the second heater resistor. Heater resistor segments 66 and current shunts 67 are designed to establish a spatial thermal pattern in the second deflector layer. The current path is indicated by an arrow and letter "I".

An alternative approach to that illustrated in FIG. 9 would be to modify the resistivity of the second deflector layer material to make it significantly more conductive in a spatial pattern similar to the illustrated current shunt pattern. Increased conductivity may be achieved by in situ processing of the electrically resistive material forming second layer 24. Examples of in situ processing to increase conductivity include laser annealing, ion implantation through a mask, or thermal diffusion doping In some preferred embodiments of the present inventions, the second deflector layer 24 is not patterned to form a heater resistor portion. For these embodiments, second deflector layer 24 acts as a passive restorer layer which mechanically balances the first deflector layer when the cantilevered element 20 reaches a uniform internal temperature. Instead of electrical input pads, thermal pathway leads may be formed into second deflector layer 24 to make contact with a heat sink portion of substrate 10. Thermal pathway leads help to remove heat from the cantilevered element 20 after an actuation. Thermal pathway effects will be discussed hereinbelow in association with FIG. 40.

In some preferred embodiments of the present invention, the same material, for example, intermetallic titanium aluminide, is used for both second deflector layer 24 and first deflector layer 22. In this case an intermediate masking step may be needed to allow patterning of the second deflector layer 24 shape without disturbing the previously delineated first deflector layer 22 shape. Alternately, barrier layer 23 may be fabricated using a lamination of two different materials, one of which is left in place protecting electrodes 42, 44, current shunts 67 and current coupling device 68 while patterning second deflector layer 24, and then removed to result in the cantilever element intermediate structure illustrated in FIGS. 8 and 9.

Figure 10:
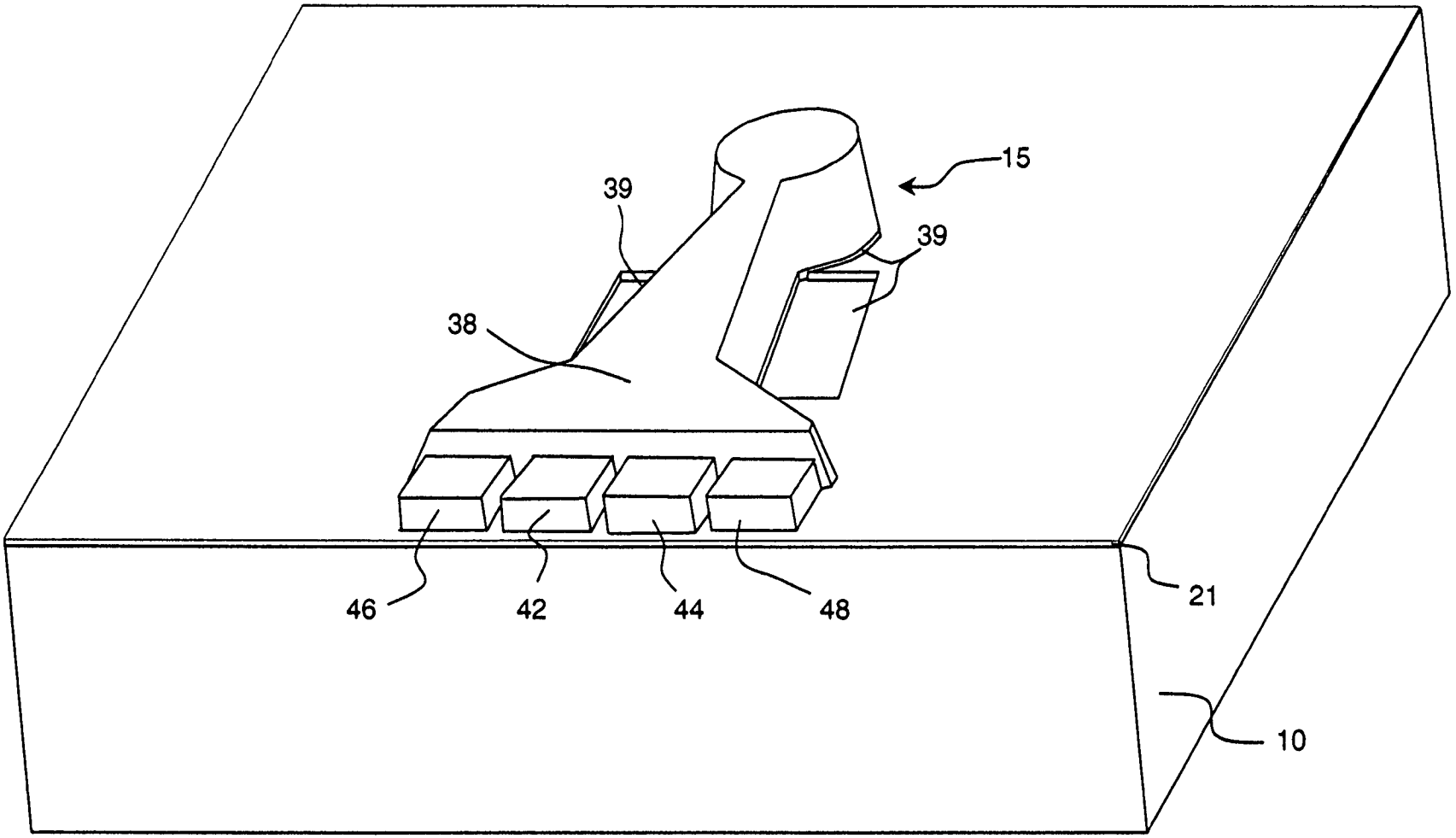
FIG. 10 is a perspective view of the next stages of the process illustrated in FIGS. 5–9 wherein a dielectric and chemical passivation layer is formed over the thermal actuator if needed for the device application, such as for a liquid drop emitter.

FIG. 10 illustrates in perspective view the addition of a passivation material overlayer 38 applied over the second deflector layer and second heater resistor for chemical and electrical protection. For applications in which the thermal actuator will not contact chemically or electrically active materials, passivation overlayer 38 may be omitted. Also, at this stage, the initial passivation layer 21 may be patterned away from clearance areas 39. Clearance areas 39 are locations where working fluid will pass from openings to be etched later in substrate 10, or are clearances needed to allow free movement of the cantilevered element of thermal actuator 15.

Figure 11:
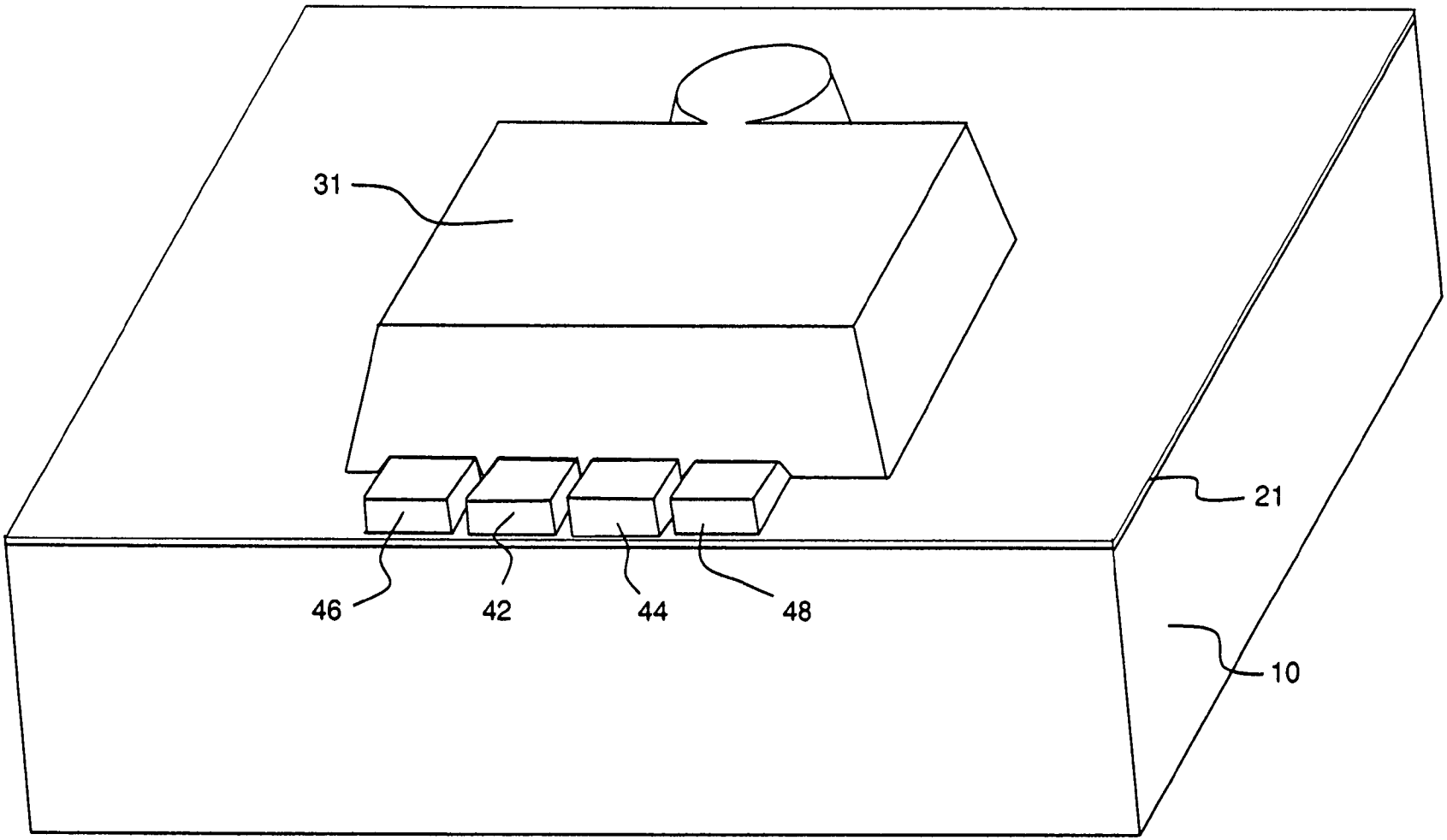
FIG. 11 is a perspective view of the next stages of the process illustrated in FIGS. 5–10 wherein a sacrificial layer in the shape of the liquid filling a chamber of a drop emitter according to the present invention is formed.

FIG. 11 shows in perspective view the addition of a sacrificial layer 31 which is formed into the shape of the interior of a chamber of a liquid drop emitter. A suitable material for this purpose is polyimide. Polyimide is applied to the device substrate in sufficient depth to also planarize the surface which has the topography of all of the layers and materials used to form the cantilevered element heretofore. Any material which can be selectively removed with respect to the adjacent materials may be used to construct sacrificial structure 31.

Figure 12:
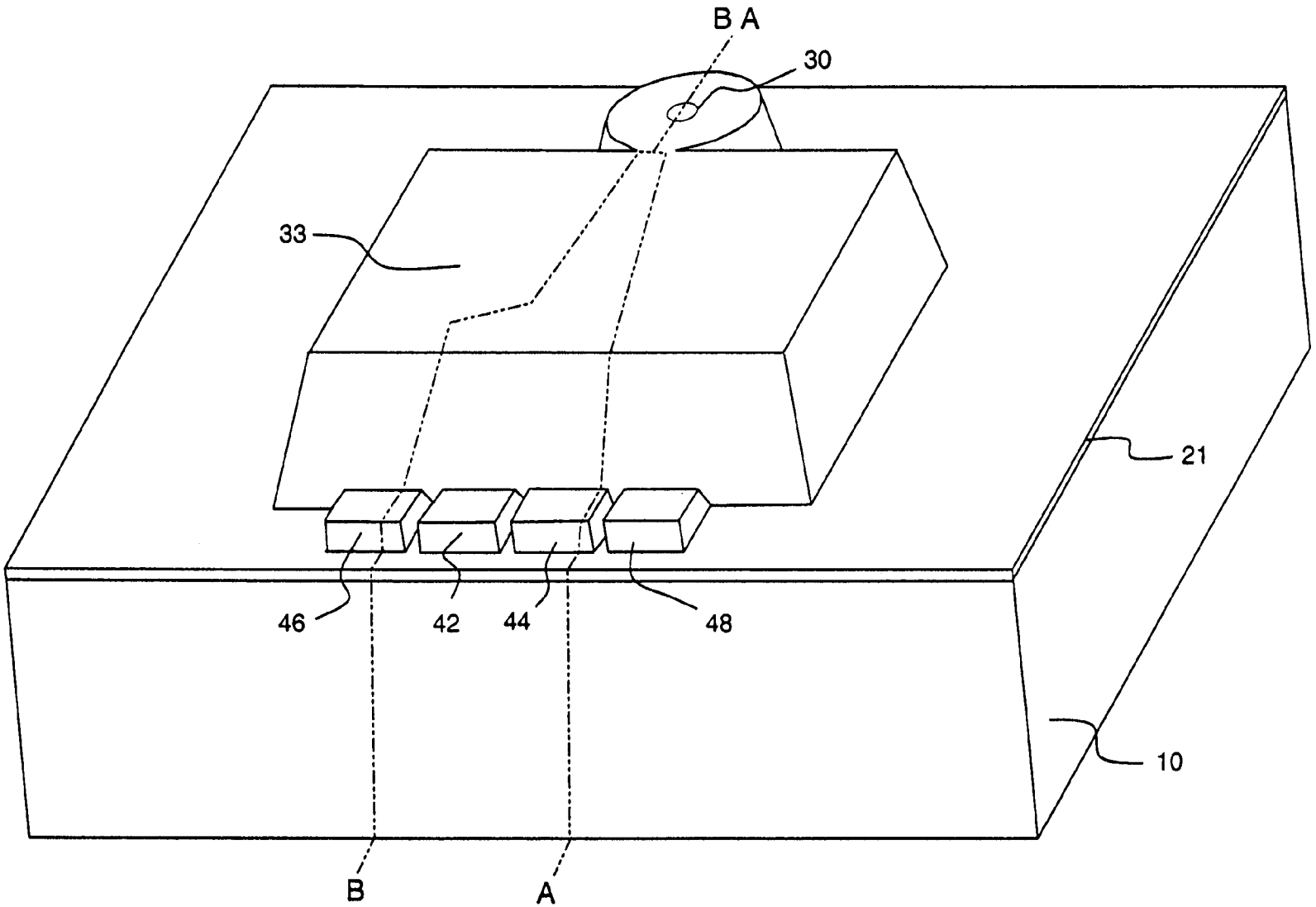
FIG. 12 is a perspective view of the next stages of the process illustrated in FIGS. 5–11 wherein a liquid chamber and nozzle of a drop emitter according to the present invention are formed.

FIG. 12 illustrates in perspective view a drop emitter liquid chamber walls and cover formed by depositing a conformal material, such as plasma deposited silicon oxide, nitride, or the like, over the sacrificial layer structure 31. This layer is patterned to form drop emitter chamber cover 33. Nozzle 30 is formed in the drop emitter chamber, communicating to the sacrificial material layer 31, which remains within the drop emitter chamber cover 33 at this stage of the fabrication sequence.

Figure 13A:
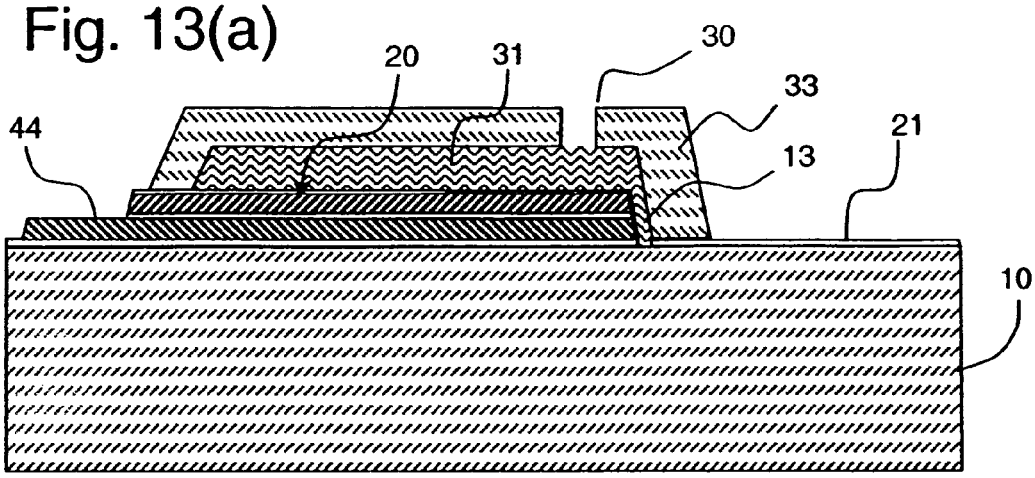
FIGS. 13(*a*)–13(*c*) are side views of the final stages of the process illustrated in FIGS. 5–12 wherein a liquid supply pathway is formed and the sacrificial layer is removed to complete a liquid drop emitter according to the present invention.
Figure 13B:
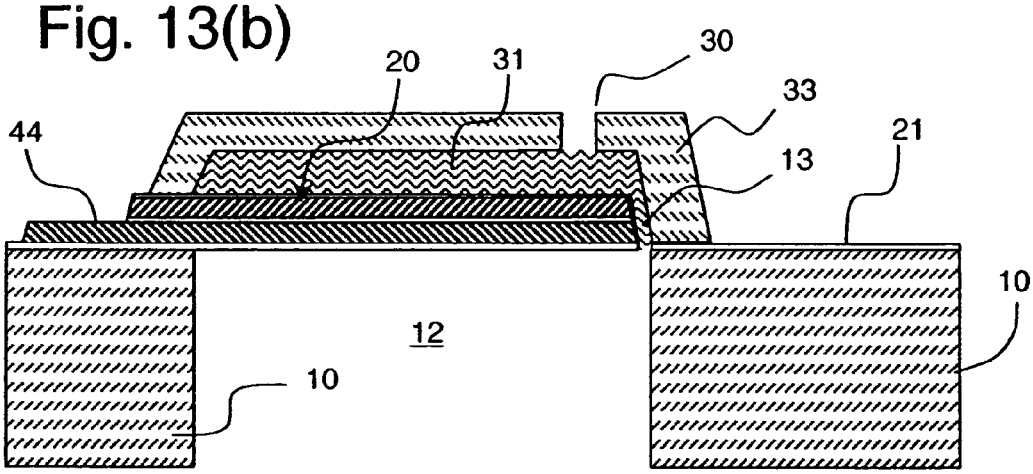
Figure 13C:
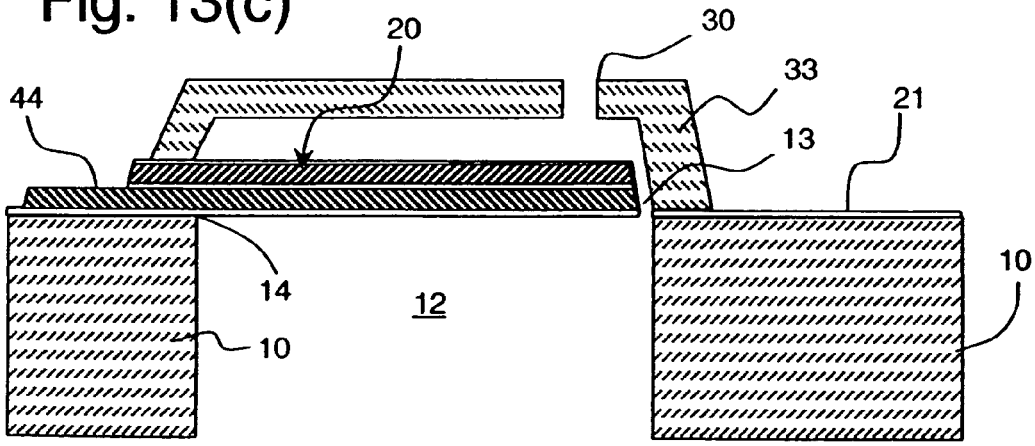

FIGS. 13*a*–13*c* show side views of the device through a section indicated as A—A in FIG. 12. In FIG. 13*a* sacrificial layer 31 is enclosed within the drop emitter chamber cover 33 except for nozzle opening 30. Also illustrated in FIG. 13*a*, substrate 10 is intact. Passivation layer 21 has been removed from the surface of substrate 10 in gap area 13 and around the periphery of the cantilevered element 20, illustrated as clearance areas 39 in FIG. 10. The removal of layer 21 in these clearance areas 39 was done at a fabrication stage before the forming of sacrificial structure 31.

In FIG. 13*b*, substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element.

In FIG. 13*c* the sacrificial material layer 31 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure.

Figure 14:
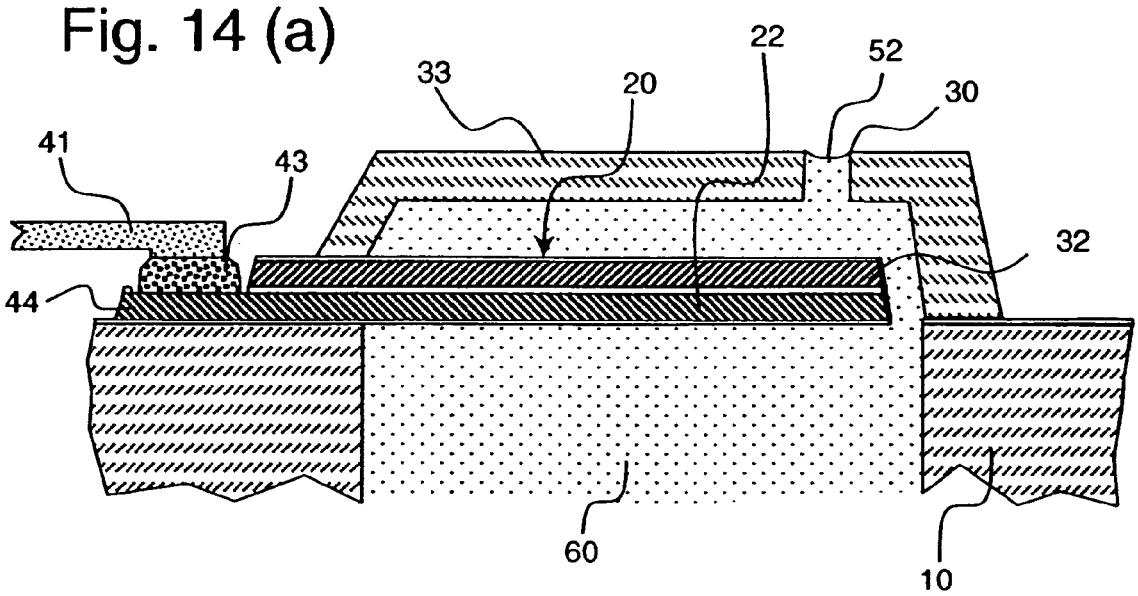
FIGS. 14(*a*) and 14(*b*) are side views illustrating the application of an electrical pulse to the first pair of electrodes of a drop emitter according the present invention.
Figure 14B:
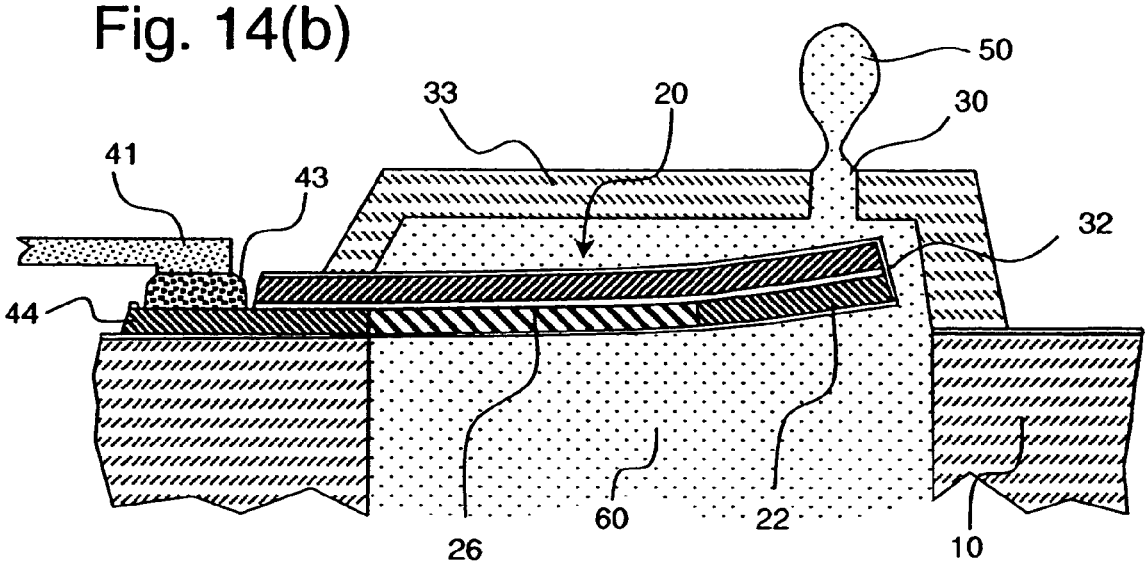

FIGS. 14*a* and 14*b* illustrate side views of a liquid drop emitter structure according to some preferred embodiments of the present invention. The side views of FIGS. 14*a* and 14*b* are formed along a line indicated as A—A in FIG. 12. FIG. 14*a* shows the cantilevered element 20 in a first position proximate to nozzle 30. Liquid meniscus 52 rests at the outer rim of nozzle 30. FIG. 14*b* illustrates the deflection of the free end 32 of the cantilevered element 20 towards nozzle 30. The upward deflection of the cantilevered element is caused by applying an electrical pulse to the first pair of electrodes 42, 44 attached to first heater resistor 26 formed in first deflector layer 22 (see also FIG. 4*b*). Rapid deflection of the cantilevered element to this second position pressurizes liquid 60, overcoming the meniscus pressure at the nozzle 30 and causing a drop 50 to be emitted.

Figure 15:
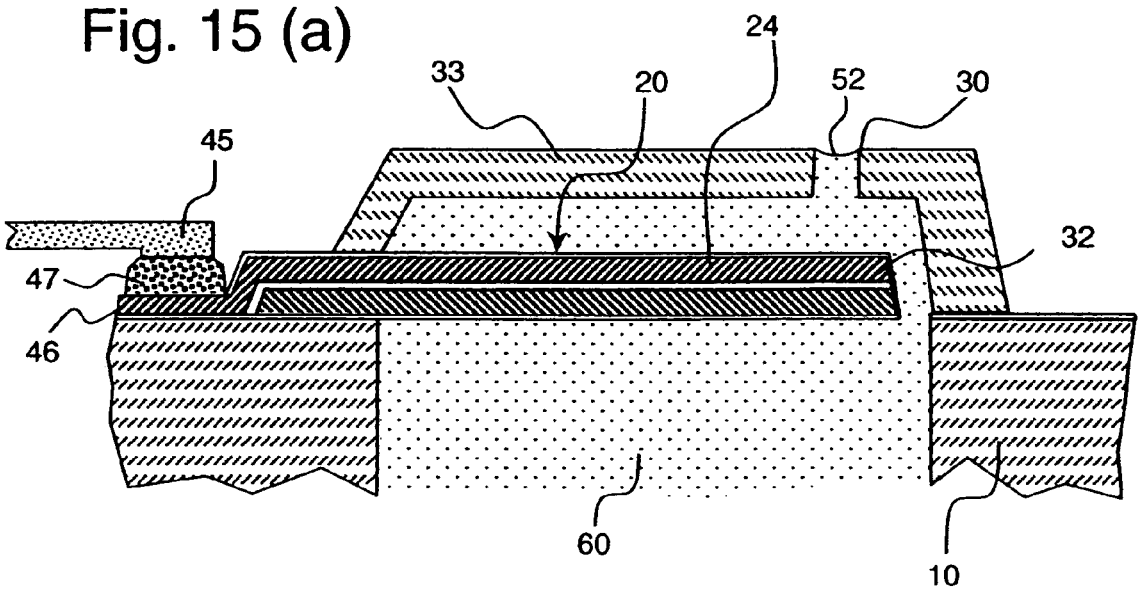
FIGS. 15(*a*) and 15(*b*) are side views illustrating the application of an electrical pulse to the second pair of electrodes of a drop emitter according the present invention.
Figure 15B:
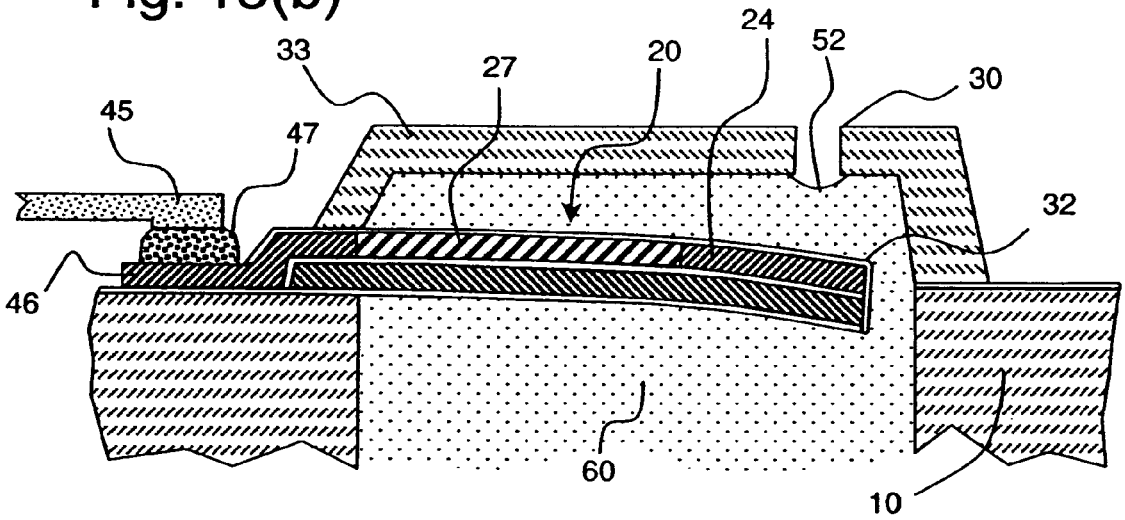

FIGS. 15*a* and 15*b* illustrate side views of a liquid drop emitter structure according to some preferred embodiments of the present invention. The side views of FIGS. 15*a* and 15*b* are formed along a line indicated as B—B in FIG. 12. FIG. 15*a* shows the cantilevered element 20 in a first position proximate to nozzle 30. Liquid meniscus 52 rests at the outer rim of nozzle 30. FIG. 15*b* illustrates the deflection of the free end tip 32 of the cantilevered element 20 away from nozzle 30. The downward deflection of the cantilevered element is caused by applying an electrical pulse to the second pair of electrodes 46,48 attached to second heater resistor 27 formed in second deflector layer 24 (see also FIG. 4*c*). Deflection of the cantilevered element to this downward position negatively pressurizes liquid 60 in the vicinity of nozzle 30, causing meniscus 52 to be retracted to a lower, inner rim area of nozzle 30.

In an operating emitter of the cantilevered element type illustrated, the quiescent first position may be a partially bent condition of the cantilevered element 20 rather than the horizontal condition illustrated FIGS. 4*a*, 14*a*, 15*a* and 39*a*. The actuator may be bent upward or downward at room temperature because of internal stresses that remain after one or more microelectronic deposition or curing processes. The device may be operated at an elevated temperature for various purposes, including thermal management design and ink property control. If so, the first position may be substantially bent.

For the purposes of the description of the present invention herein, the cantilevered element will be said to be quiescent or in its first position when the free end is not significantly changing in deflected position. For ease of understanding, the first position is depicted as horizontal in FIGS. 4*a*, 14*a*, 15*a* and 39*a*. However, operation of thermal actuators about a bent first position are known and anticipated by the inventors of the present invention and are fully within the scope of the present inventions.

FIGS. 5 through 13*c* illustrate a preferred fabrication sequence. However, many other construction approaches may be followed using well known microelectronic fabrication processes and materials. For the purposes of the present invention, any fabrication approach which results in a cantilevered element including a first deflection layer 22, a barrier layer 23, and, optionally, a second deflector layer 24 may be followed. These layers may also be composed of sub-layers or laminations in which case the thermo-mechanical behavior results from a summation of the properties of individual laminations. Further, in the illustrated fabrication sequence of FIGS. 5 through 13*c*, the liquid chamber cover 33 and nozzle 30 of a liquid drop emitter were formed in situ on substrate 10. Alternatively a thermal actuator could be constructed separately and bonded to a liquid chamber component to form a liquid drop emitter.

The inventors of the present inventions have discovered that the efficiency of a cantilevered element thermal actuator is importantly influenced by the shape of the thermo-mechanical bender portion. The cantilevered element is designed to have a length sufficient to result in an amount of deflection sufficient to meet the requirements of the microelectronic device application, be it a drop emitter, a switch, a valve, light deflector, or the like. The details of thermal expansion differences, stiffness, thickness and other factors associated with the layers of the thermo-mechanical bender portion are considered in determining an appropriate length for the cantilevered element.

The width of the cantilevered element is important in determining the force which is achievable during actuation. For most applications of thermal actuators, the actuation must move a mass and overcome counter forces. For example, when used in a liquid drop emitter, the thermal actuator must accelerate a mass of liquid and overcome backpressure forces in order to generate a pressure pulse sufficient to emit a drop. When used in switches and valves the actuator must compress materials to achieve good contact or sealing.

In general, for a given length and material layer construction, the force that may be generated is proportional to the width of the thermo-mechanical bender portion of the cantilevered element. A straightforward design for a thermo-mechanical bender is therefore a rectangular beam of width $w_0$ and length L, wherein L is selected to produce adequate actuator deflection and $w_0$ is selected to produce adequate force of actuation, for a given set of thermo-mechanical materials and layer constructions.

It has been found by the inventors of the present inventions that the straightforward rectangular shape mentioned above is not the most energy efficient shape for the thermo-mechanical bender. Rather, it has been discovered that a thermo-mechanical bender portion that reduces in width from the anchored end of the cantilevered element to a narrower width at the free end, produces more force for a given area of the bender.

Figure 16A:
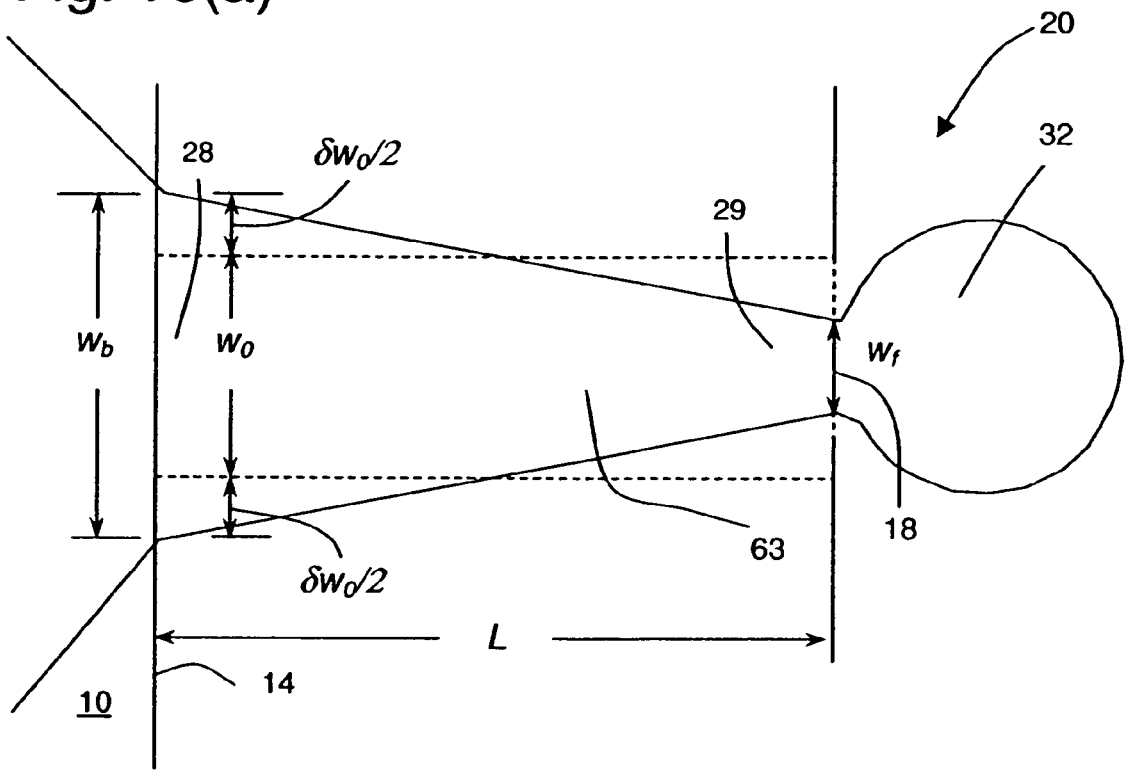
FIGS. 16(*a*) and 16(*b*) are plan views of alternative designs for a thermo-mechanical bender portion according to the present inventions.
Figure 16B:
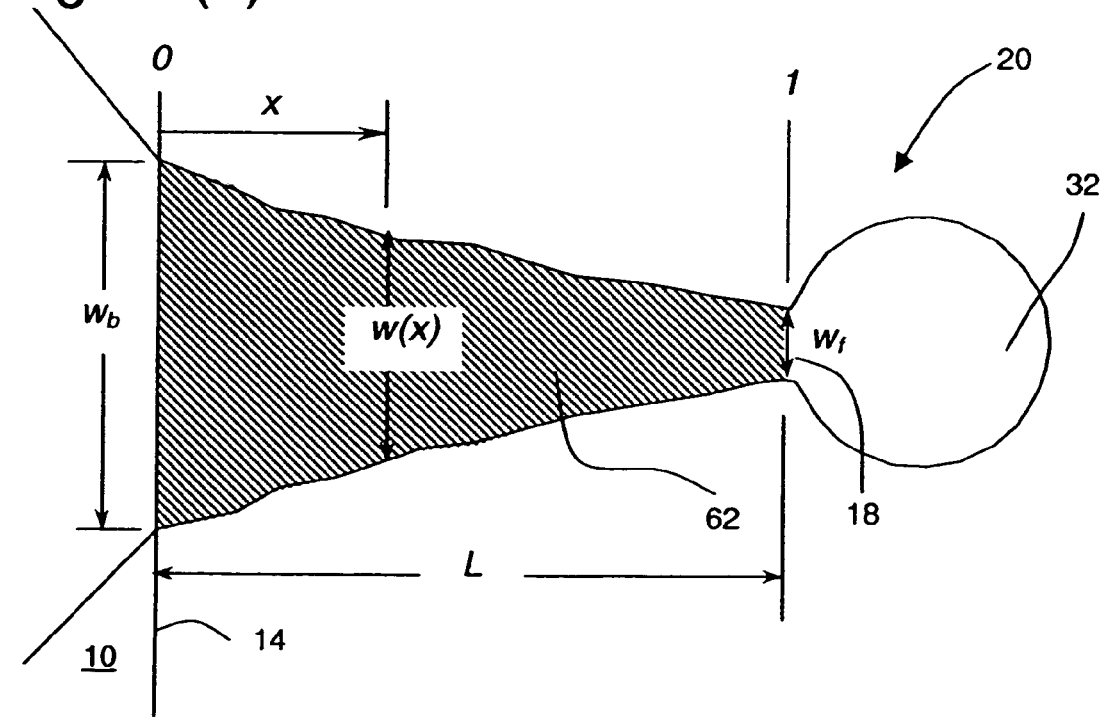

FIGS. 16*a* and 16*b* illustrate in plan views cantilevered elements 20 and thermo-mechanical bender portions 62 and 63 according to the present invention. Thermo-mechanical bender portions 62 and 63 extend from base element anchor locations 14 to locations of connection 18 to free end tips 32. The width of the thermo-mechanical bender portion is substantially greater at the base end, $w_b$, than at the free end, $w_f$. In FIG. 16*a*, the width of the thermo-mechanical bender decreases linearly from $w_b$ to $w_f$ producing a trapezoidal shaped thermo-mechanical bender portion. Also illustrated in FIG. 16*a*, $w_b$ and $w_f$ are chosen so that the area of the trapezoidal thermo-mechanical bender portion 63, is equal to the area of a rectangular thermo-mechanical bender portion 90, shown in phantom in FIG. 16*a*, having the same length L and a width $w_0=\frac{1}{2}(w_b+w_f)$.

The linear tapering shape illustrated in FIG. 16*a* is a special case of a generally tapering shape according to the present inventions and illustrated in FIG. 16*b*. Generally tapering thermo-mechanical bender portion 62, illustrated in FIG. 16*b*, has a width, w(x), which decreases monotonically as a function of the distance, x, from $w_b$ at anchor location 14 at base element 10, to $w_f$ at the location of connection 18 to free end tip 32 at distance L. In FIG. 16*b*, the distance variable x, over which the thermo-mechanical bender portion 62 monotonically reduces in width, is expressed as covering a range x=0→1, i.e. in units normalized by length L.

Figure 17A:
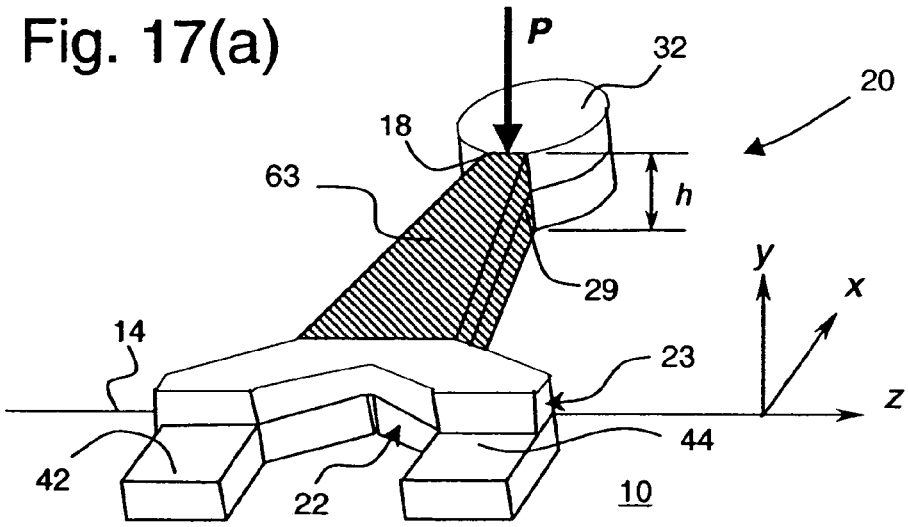
FIGS. 17(*a*) and 17(*b*) are a perspective and a plan view, respectively, of a design for a thermo-mechanical bender portion according to the present inventions.
Figure 17B:
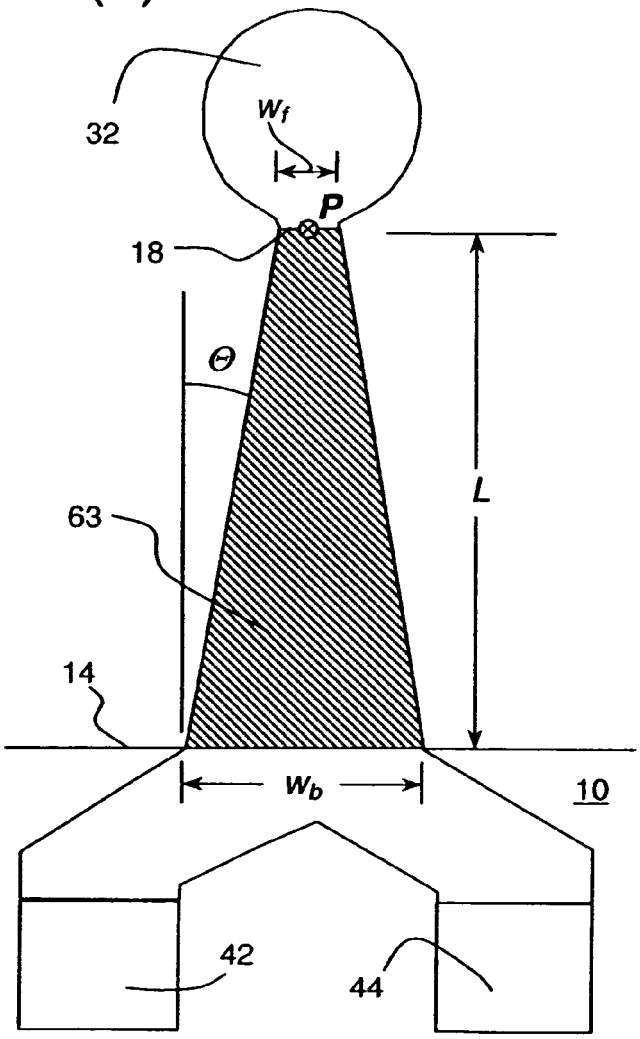

The beneficial effect of a taper-shaped thermo-mechanical bender portion 62 or 63 may be understood by analyzing the resistance to bending of a beam having such a shape. FIGS. 17*a* and 17*b* illustrate a first shape that can be explored analytically in closed form. FIG. 17*a* shows in perspective view a cantilevered element 20 comprised of first deflector layer 22 and second layer 23. A linearly-tapered (trapezoidal) thermo-mechanical bender portion 63 extends from anchor location 14 of base element 10 to a free end tip 32. A force, P, representing a load or backpressure, is applied perpendicularly, in the negative y-direction in FIG. 17*a*, to the free end 29 of thermo-mechanical bender portion 63 where it joins to free end tip 32 of the cantilevered element.

FIG. 17*b* illustrates in plan view the geometrical features of a trapezoidal thermo-mechanical bender portion 63 that are used in the analysis hereinbelow. Note that the amount of linear taper is expressed as an angle Θ in FIG. 17*b* and as a difference width, $\delta w_0/2$, in FIG. 16*b*. These two descriptions of the taper are related as follows: $\tan\Theta=\delta w_0/L$.

Thermo-mechanical bender portion 63, fixed at anchor location 14 (x=0) and impinged by force P at free end 29 location 18 (x=L) assumes an equilibrium shape based on geometrical parameters, including the overall thickness h, and the effective Young's modulus, E, of the multi-layer structure. The anchor connection exerts a force, oppositely directed to the force P, on the cantilevered element that prevents it from translating. Therefore the net moment, M(x), acting on the thermo-mechanical bender portion at a distance, x from the fixed base end is:

$$M(x)=Px-PL. \tag{1}$$

The thermo-mechanical bender portion 63 resists bending in response to the applied moment, M(x), according to geometrical shape factors expressed as the beam stiffness I(x) and Young's modulus, E. Therefore:

$$EI(x)\frac{d^2y}{dx^2}=M(x), \tag{2}$$

where, $$I(x)=\frac{1}{12}w(x)h^3. \tag{3}$$

Combining with Eq. 1: $$\frac{d^2y}{dx^2}=\frac{12PL^3}{Eh^3}\frac{(x-1)}{w(x)}. \tag{4}$$

Equation 4 above is a differential equation in y(x), the deflection of the thermo-mechanical bender member as a function of the geometrical parameters, materials parameters and distance out from the fixed anchor location, x, expressed in units of L. Equation 4 may be solved for y(x) using the boundary conditions y(0)=dy(0)/dx=0.

It is useful to solve Equation 4 initially for a rectangular thermo-mechanical bender portion to establish a base or nominal case for comparison to the reducing width shapes of the present inventions. Thus, for the rectangular shape illustrated in phantom lines in FIG. 16*a*, $$w(x)=w_0,\ 0\le x\le 1.0, \tag{5}$$

$$\frac{d^2y}{dx^2}=\frac{12PL^3}{Eh^3}\frac{(x-1)}{w_0}, \tag{6}$$

$$y(x)=C_0\left(\frac{x^3}{6}-\frac{x^2}{2}\right), \tag{7}$$

where, $$C_0=\frac{12PL^3}{Eh^3w_0}. \tag{8}$$

At the free end of the rectangular thermo-mechanical bender portion 63, x=1.0, the deflection of the beam, y(1), in response to a load P is therefore:

$$y(1)=-\frac{1}{3}C_0. \tag{9}$$

The deflection of the free end 29 of a rectangular thermo-mechanical bender portion, y(1), expressed in above Equation 9, will be used in the analysis hereinbelow as a normalization factor. That is, the amount of deflection under a load P of thermo-mechanical bender portions having reducing widths according to the present inventions, will be analyzed and compared to the rectangular case. It will be shown that the thermo-mechanical bender portions of the present inventions are deflected less by an equal load or backpressure than a rectangular thermo-mechanical bender portion having the same length, L, and average width, $w_0$. Because the shapes of the thermo-mechanical bender portions according to the present inventions are more resistant to load forces and backpressure forces, more deflection and more forceful deflection can be achieved by the input of the same heat energy as compared to a rectangular thermo-mechanical bender.

Trapezoidal-shaped thermo-mechanical bender portions, as illustrated in FIGS. 2, 3, 16, and 17 are preferred embodiments of the present inventions. The thermo-mechanical bender portion 63 is designed to narrow from a base end width, $w_b$, to a free end width, $w_f$, in a linear function of x, the distance out from the anchor location 14 of base element 10. Further, to clarify the improved efficiencies that are obtained, the trapezoidal-shaped thermo-mechanical bender portion is designed to have the same length, L, and area, $w_0L$, as the rectangular-shaped thermo-mechanical bender portion described by above Equation 5. The trapezoidal-shape width function, w(x), may be expressed as:

$$w(x)=w_0(ax+b),\ 0\leqq x\leqq 1.0, \tag{10}$$

where $(w_f+w_b)/2=w_0$, $\delta=(w_b-w_f)/2w_0$, $a=-2\delta$, and $b=(1+\delta)$.

Inserting the linear width function, Equation 10, into differential Equation 4 allows the calculation of the deflection of trapezoidal-shaped thermo-mechanical bender portion 63, y(x), in response to a load P at the free end 29:

$$\frac{d^2y}{dx^2}=\frac{12PL^3}{Eh^3w_0}\frac{(x-1)}{(ax+b)}, \tag{11}$$

$$y(x)=C_0\left\{-\frac{x^2}{4\delta}+\frac{(1-\delta)(1-(2x-1)\delta)}{8\delta^3}\left[-1-\ln\frac{(1+\delta)}{(1-(2x-1)\delta)}+\frac{(1+\delta)}{(1-(2x-1)\delta)}\right]\right\} \tag{12}$$

where $C_0$ in Equation 12 above is the same constant $C_0$ found in Equations 7–9 for the rectangular thermo-mechanical bender portion case. The quantity δ expresses the amount of taper in units of $w_0$. Further, Equation 12 above reduces to Equation 7 for the rectangular case as $\delta\rightarrow 0$.

The beneficial effects of a taper-shaped thermo-mechanical bender portion may be further understood by examining the amount of load P induced deflection at the free end 29 and normalizing by the amount of deflection, $-C_0/3$, that was found for the rectangular shape case (see Equation 9). The normalized deflection at the free end is designated $\bar{y}(\mathbf{1})$:

$$\bar{y}(1)=\frac{3}{4}\left[\frac{2\delta-1}{\delta^2}+\frac{(1-\delta)^2}{2\delta^3}\ln\frac{(1+\delta)}{(1-\delta)}\right]. \tag{13}$$

Figure 18:
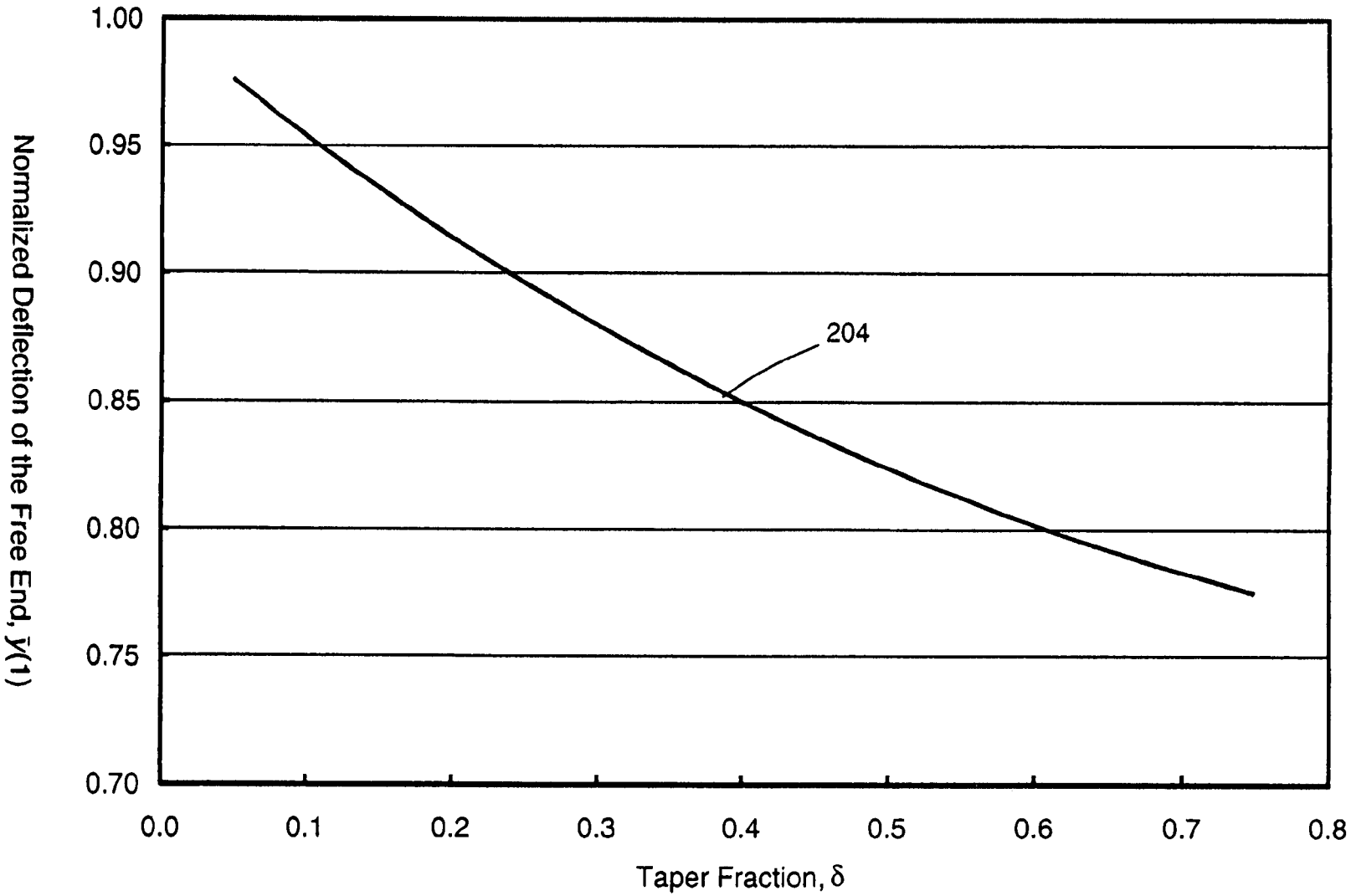
FIG. 18 is a plot of thermo-mechanical bender portion free end deflection under an imposed load for tapered thermo-mechanical actuators as a function of taper fraction.

The normalized free end deflection, $\bar{y}(\mathbf{1})$, is plotted as a function of δ in FIG. 18, curve 204. Curve 204 in FIG. 18 shows that as δ increases the thermo-mechanical bender portion deflects less under the applied load P. For practical implementations, δ cannot be increased much beyond δ=0.75 because the implied narrowing of the free end also leads to a weak free end location 18 in the cantilevered element 20 where the thermo-mechanical bender portion 63 joins to the free end tip 32.

The normalized free end deflection plot 204 in FIG. 18 shows that a tapered or trapezoidal shaped thermo-mechanical bender portion will resist more efficiently an actuator load, or backpressure in the case of a fluid-moving device. For example, if a typical rectangular thermal actuator of width $w_0$=20 μm and length L=100 μm is narrowed at the free end to $w_f$=10 μm, and broadened at the base end to $w_b$=30 μm, then δ=0.5. Such a tapered thermo-mechanical bender portion will be deflected ~18% less than the 20 μm wide rectangular thermal actuator which has the same area. This improved load resistance of the tapered thermo-mechanical bender portion is translated into an increase in actuation force and net free end deflection when pulsed with the same heat energy. Alternatively, the improved force efficiency of the tapered shape may be used to provide the same amount of force while using a lower energy heat pulse.

As illustrated in FIG. 16*b*, many shapes for the thermo-mechanical bending portion which monotonically reduce in width from base end to free end will show improved resistance to an actuation load or backpressure as compared to a rectangular bender of comparable area and length. This can be seen from Equation 4 by recognizing that the rate of change in the bending of the beam, $d^2y/dx^2$ is caused to decrease as the width is increased at the base end.

That is, from Equation 4:

$$\frac{d^2y}{dx^2}\propto-\frac{(1-x)}{w(x)}. \tag{14}$$

As compared to the rectangular case wherein $w(x)=w_0$, a constant, a normalized, monotonically decreasing w(x) will result in a smaller negative value for the rate of change in the slope of the beam at the base end, which is being deflected downward under the applied load P. Therefore, the accumulated amount of beam deflection at the free end, x=1, may be less. A beneficial improvement in the thermo-mechanical bending portion resistance to a load will be present if the base end width is substantially greater than the free end width, provided the free end has not been narrowed to the point of creating a mechanically weak elongated structure. The term substantially greater is used herein to mean at least 20% greater.

It is useful to the understanding of the present inventions to characterize thermo-mechanical bender portions that have a monotonically reducing width by calculating the normalized deflection at the free end, $\bar{y}(\mathbf{1})$ subject to an applied load P, as was done above for the linear taper shape. The normalized deflection at the free end, $\bar{y}(\mathbf{1})$, is calculated for an arbitrary shape 62, such as that illustrated in FIG. 16*b*, by first normalizing the shape parameters so that the deflection may be compared in consistent fashion to a similiarly constructed rectangular thermo-mechanical bending portion of length L and constant width $w_0$. The length of and the distance along the arbitrary shaped thermo-mechanical bender portion 62, x, are normalized to L so that x ranges from x=0 at the anchor location 14 to x=1 at the free end location 18.

The width reduction function, w(x), is normalized by requiring that the average width of the arbitrary shaped thermo-mechanical bender portion 62 is $w_0$. That is, the normalized width reduction function, $\bar{w}(x)$, is formed by adjusting the shape parameters so that $$\int_0^1\frac{\bar{w}(x)}{w_0}dx=1. \tag{15}$$

The normalized deflection at the free end, $\bar{y}(\mathbf{1})$, is then calculated by first inserting the normalized width reduction function, $\bar{w}(x)$, into differential Equation 4:

$$\frac{d^2y}{dx^2}=\frac{12PL^3}{Eh^3w_0}\frac{(x-1)}{\bar{w}(x)}=C_0\frac{(x-1)}{\bar{w}(x)}, \tag{16}$$

where $C_0$ is the same coefficient as given in above Equation 8.

Equation 16 is integrated twice to determine the deflection, y(x), along the thermo-mechanical bender portion 62. The integration solutions are subjected to the boundary conditions noted above, y(0)=dy(0)/dx=0. In addition, if the normalized width reduction function $\bar{w}(x)$ has steps, i.e. discontinuities, y and dy/dx are required to be continuous at the discontinuities. y(x) is evaluated at free end location 18, x=1, and normalized by the quantity ($-C_0/3$), the free end deflection of a rectangular thermo-mechanical bender of length L and width $w_0$. The resulting quantity is the normalized deflection at the free end, $\bar{y}(1)$:

$$\bar{y}(1) = -3\int_0^1\left[\int_0^{x_2}\frac{(x_1-1)}{\bar{w}(x_1)}dx_1\right]dx_2. \tag{17}$$

If the normalized deflection at the free end, $\bar{y}(1)<1$, then that thermo-mechanical bender portion shape will be more resistant to deflection under load than a rectangular shape having the same area. Such a shape may be used to create a thermal actuator having more deflection for the same input of thermal energy or the same deflection with the input of less thermal energy than the comparable rectangular thermal actuator. If, however, $\bar{y}(1)>1$, then the shape is less resistant to an applied load or backpressure effects and is disadvantaged relative to a rectangular shape.

The normalized deflection at the free end, $\bar{y}(1)$, is used herein to characterize and evaluate the contribution of the shape of the thermo-mechanical bender portion to the performance of a cantilevered thermal actuator. $\bar{y}(1)$ may be determined for an arbitary width reduction shape, w(x), by using well known numerical integration methods to calculate $\bar{w}(x)$ and evaluate Equation 17. All shapes which have $\bar{y}(1)<1$ are preferred embodiments of the present inventions.

Figure 19A:
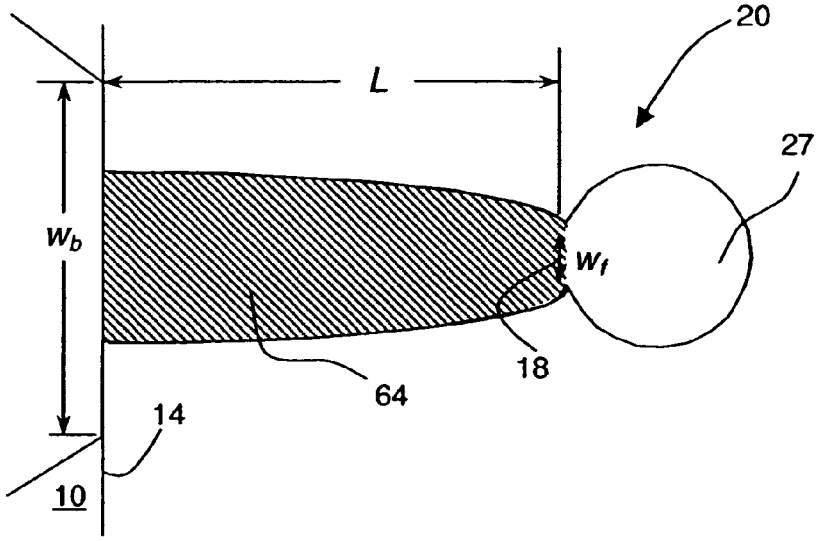
FIGS. 19(*a*)–19(*c*) are plan views of alternative designs for a thermo-mechanical bender portion according to the present inventions.
Figure 19B:
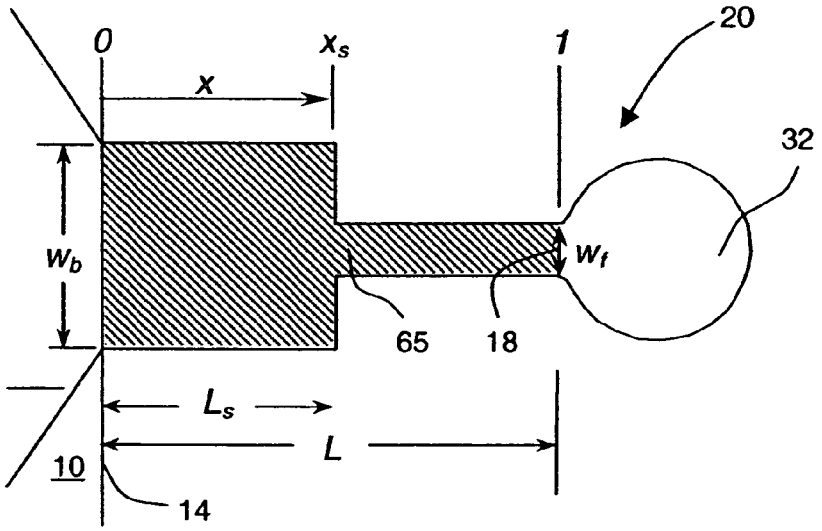

Two alternative shapes which embody the present inventions are illustrated in FIGS. 19*a* and 19*b*. FIG. 19*a* illustrates a thermo-mechanical bender portion 64 having a supralinear width reduction, in this case a quadratic change in the width from $w_b$ to $w_f$:

$$w(x) = \left(\frac{w_f - w_b}{L^2}\right)x^2 + w_b,\ 0 \le x \le L. \tag{18}$$

FIG. 19*b* illustrates a stepwise reducing thermo-mechanical bender portion 65 which has a single step reduction at $x=x_s$:

$$\begin{aligned} w(x) &= w_b, \quad 0 \le x \le x_s \\ &= w_f, \quad x_s \le x \le 1.0. \end{aligned} \tag{19}$$

An alternate form of a supralinear width function and the stepwise shape, Equation 19, are amenable to a closed form solution which further aids in understanding the present inventions.

Figure 19C:
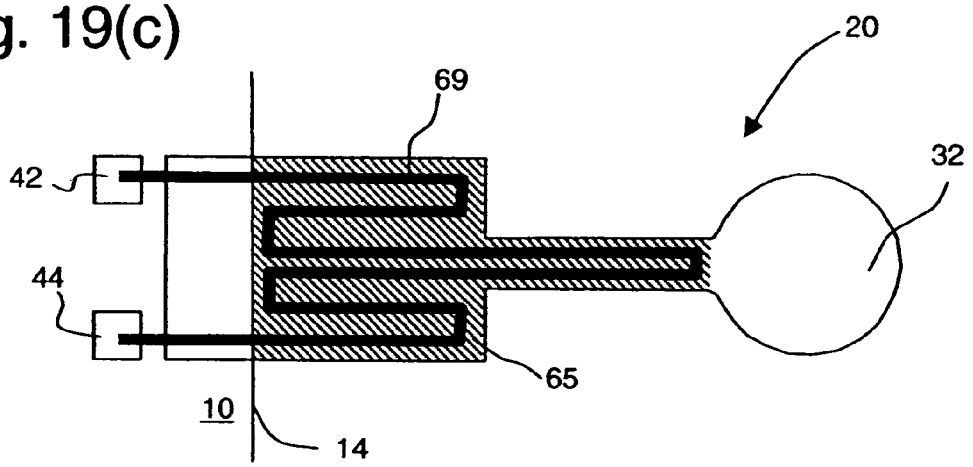

FIG. 19*c* illustrates an alternate apparatus adapted to apply a heat pulse directly to the thermo-mechanical bender portion 65, thin film resistor 69. A thin film resistor may be formed on substrate 10 before construction of the cantilevered element 20 and thermo-mechanical bender portion 65, applied after completion, or at an intermediate stage. Such heat pulse application apparatus may be used with any of the thermo-mechanical bender portion designs of the present inventions.

A first stepwise reducing thermo-mechanical bender portion 65 that may be examined is one that reduces at the midway point, $x_s=0.5$ in units of L. That is, $$\begin{aligned} w(x) &= w_0(1+\delta), \quad 0 \le x \le 0.5 \\ &= w_0(1-\delta), \quad 0.5 \le x \le 1.0. \end{aligned} \tag{20}$$

where $\delta=(w_b-w_f)/2$ and the area of the thermo-mechanical bender portion 65 is equal to a rectangular bender of width $w_0$ and length L. Equation 4 may be solved for the deflection y(x) experienced under a load P applied at the free end location 18 of stepped thermo-mechanical bender portion 65. The boundary conditions y(0)=dy(0)/dx=0 are supplemented by requiring continuity in y and dy/dx at the step $x_s=0.5$. The deflection, y(x), under load P, is found to be:

$$\begin{aligned} y_1(x) &= \frac{C_0}{(1+\delta)}\left[\frac{x^3}{6}-\frac{x^2}{2}\right],\ 0 \le x \le \frac{1}{2} \\ y_2(x) &= \frac{C_0}{(1-\delta)}\left[\frac{x^3}{6}-\frac{x^2}{2}+\frac{3}{4}\frac{\delta}{(1+\delta)}x-\frac{1}{6}\frac{\delta}{(1+\delta)}\right],\ \frac{1}{2} \le x \le 1 \end{aligned} \tag{21}$$

The deflection of the stepped thermo-mechanical bender portion at the free end location 18, normalized by the free end deflection of the rectangular bender of equal area and length is:

$$\bar{y}_2(1) = \frac{1}{(1-\delta)}\left[1-\frac{7}{4}\frac{\delta}{(1+\delta)}\right]. \tag{22}$$

Figure 20:
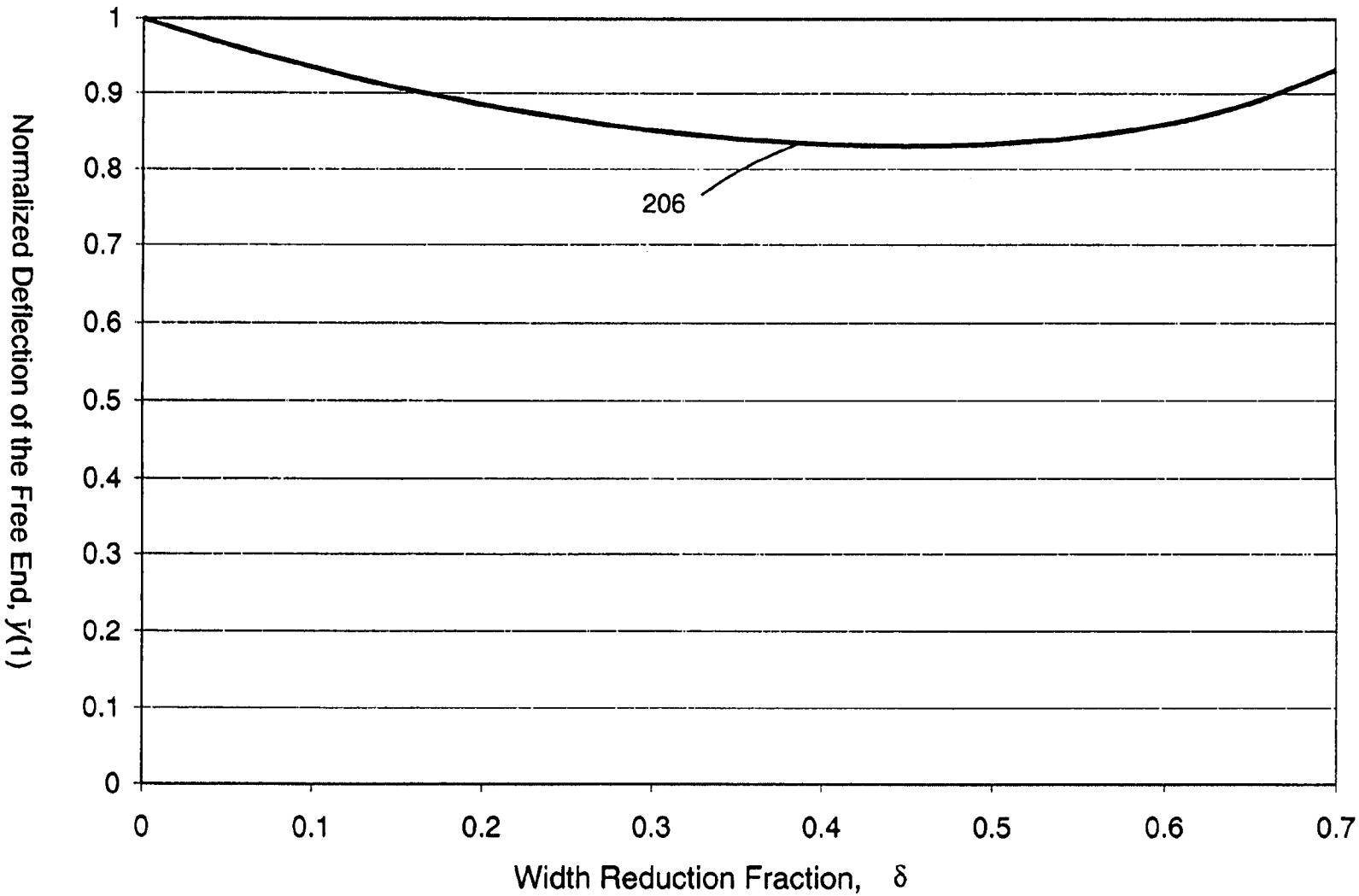
FIG. 20 is a plot of thermo-mechanical bender portion free end deflection under an imposed load for stepped reduction thermo-mechanical actuators as a function of width reduction fraction.

Equation 22 is plotted as plot 206 in FIG. 20 as a function of δ. It can be seen that the stepped thermo-mechanical bender portion 65 shows an improved resistance to the load P for fractions up to about δ~0.5 at which point the beam becomes weak and the resistance declines. By choosing a step reduction of ~0.5 $w_0$, the stepped beam will deflect ~16% less than a rectangular thermo-mechanical bender portion of equal area and length. This increased load resistance is comparable to that found for a trapezoidal shaped thermo-mechanical bender portion having a taper fraction of δ=0.5 (see plot 204, FIG. 18).

FIG. 20 indicates that there is an optimum width reduction for a given step position for stepped thermo-mechanical bender portions. It is also the case that there may be an optimum step position, $x_s$, for a given fractional width reduction of the stepped thermo-mechanical bender portion. The following general, one-step width reduction case is analyzed:

$$\begin{aligned} w(x) &= w_b = w_0(1-f+fx_s)/x_s, \quad 0 \le x \le x_s \\ &= w_f = w_0 f,\ x_s \le x \le 1.0. \end{aligned} \tag{23}$$

where f is the fraction of the free end width compared to the nominal width $w_0$ for a rectangular thermo-mechanical bender portion, $f=w_f/w_0$. Equation 23 is substituted into differential Equation 4 using the boundary conditions as before, y(0)=dy(0)/dx=0 and continuity in y and dy/dx at step $x_s$. The normalized deflection at the free end location 18 is found to be:

$$\bar{y}(1) = \frac{1}{f}\left[1 + \frac{(f-1)(x_s^3 - 3x_s^2 + 3x_s)}{(1 - f + fx_s)}\right] \tag{24}$$

The slope of Equation 24 as a function of $x_s$ is examined to determine the optimum values of $x_s$ for a choice of f:

$$\frac{d\bar{y}(1)}{dx_s} = \frac{(f-1)}{f}\left\{\frac{(1 - f + fx_s)(3x_s^2 - 6x_s + 3) - f(x_s^3 - 3x_s^2 + 3x_s)}{(1 - f + fx_s)^2}\right\}. \tag{25}$$

The slope function in Equation 25 will be zero when the numerator in the curly brackets is zero. The values of f and $x_s$ which result in the minimum value of the normalized deflection of the free end, $$f^{opt} \text{ and } x_s^{opt},$$

are found from Equation 25 to obey the following relationship:

$$f^{opt} = \frac{-3(x_s^{opt} - 1)^2}{2(x_s^{opt} - 1)^3 - 1}. \tag{26}$$

Figure 21:
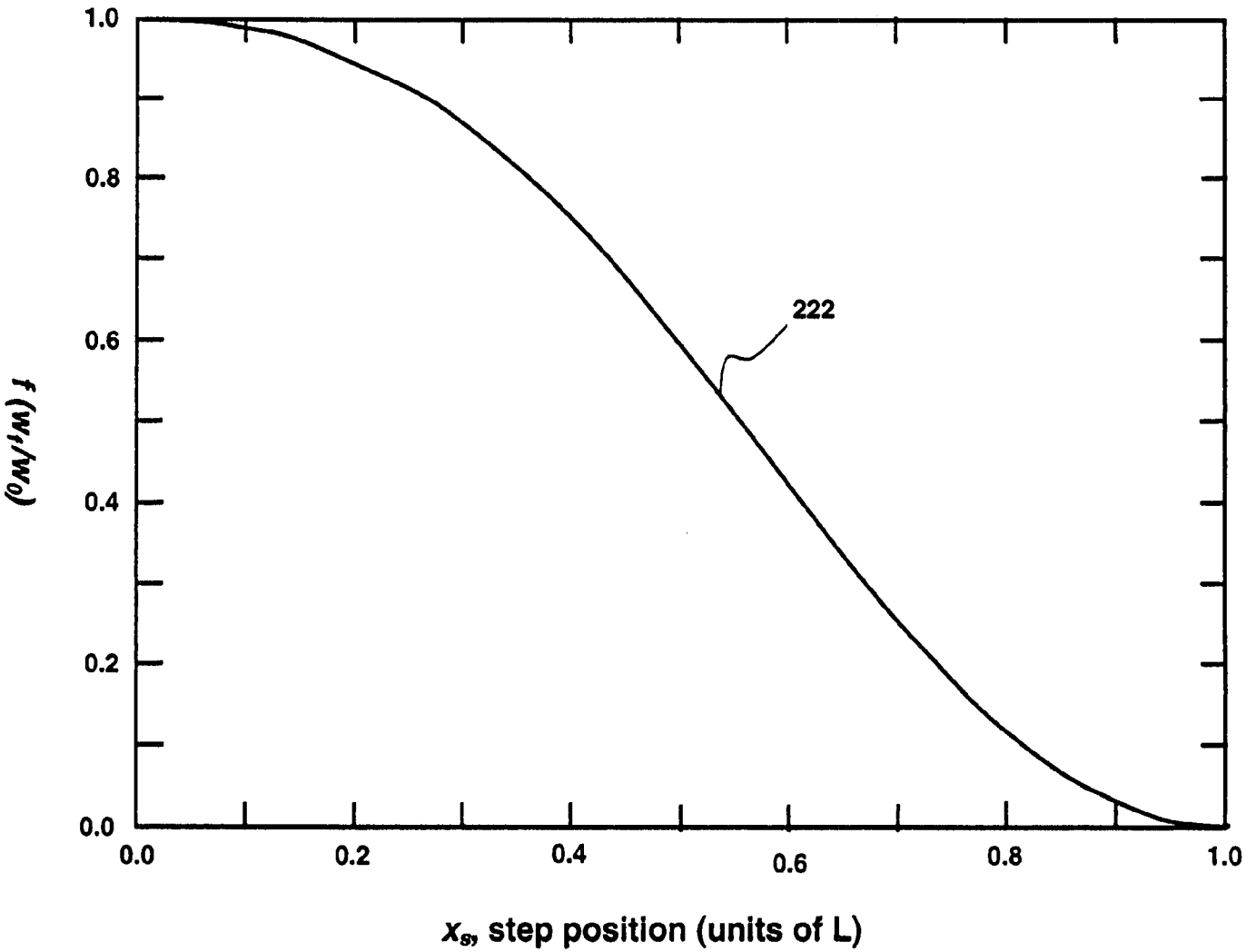
FIG. 21 is a plot of the parameters of a single step reduction shaped thermo-mechanical bender portion that yield the minimum normalized deflection of the free end.

The relationship between $f^{opt}$ and $x_s^{opt}$ given in Equation 26 is plotted as curve 222 in FIG. 21.

The minimum value for the normalized deflection of the free end, $\bar{y}_{min}(\mathbf{1})$, that can be realized for a given choice of the location of the step position, may be calculated by inserting the value of $f^{opt}$ into Equation 24 above. This yields an expression for the minimum value of the normalized deflection of the free end of a single step reduction thermo-mechanical bender portion that may be achieved:

$$\bar{y}_{\min}(1) = \frac{4(x_s^{opt} - 1)^7 + 6(x_s^{opt} - 1)^6 + 2(x_s^{opt} - 1)^4 + 3(x_s^{opt} - 1)^3 - 2x - 1}{-3\left((x_s^{opt} - 1)^3 + 1\right)}. \tag{27}$$

Figure 22:
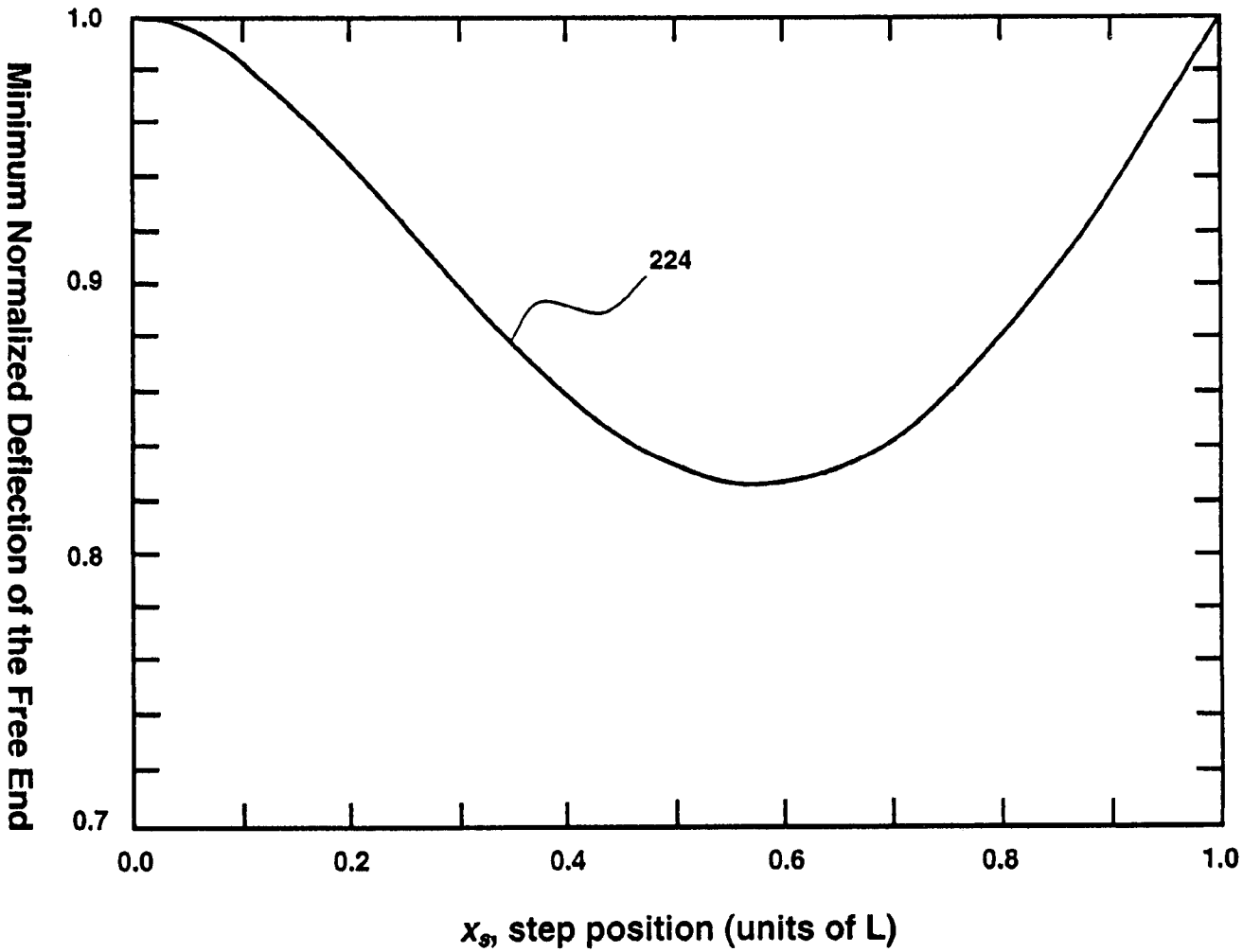
FIG. 22 is a plot of the minimum normalized deflection of the free end of a single step reduction thermo-mechanical bender portion resulting from the optimum parameters plotted in FIG. 21, as a function of the step position.

The minimum value for the normalized deflection of the free end, $\bar{y}_{min}(\mathbf{1})$, is plotted as curve 224 in FIG. 22, as a function of the location of the step position, $x_s$. It may be seen from FIG. 22 that to gain at least a 10% improvement in load resistance, over a standard rectangular shape for the thermo-mechanical bender portion, the step position may be selected in the range of $x_s$~0.3 to 0.84. Selection of $x_s$ in this range, coupled with selecting $f^{opt}$ according to Equation 26, allows reduction of the normalized deflection of the free end to be below 0.9, i.e., $\bar{y}(\mathbf{1})<0.9$.

Figure 23:
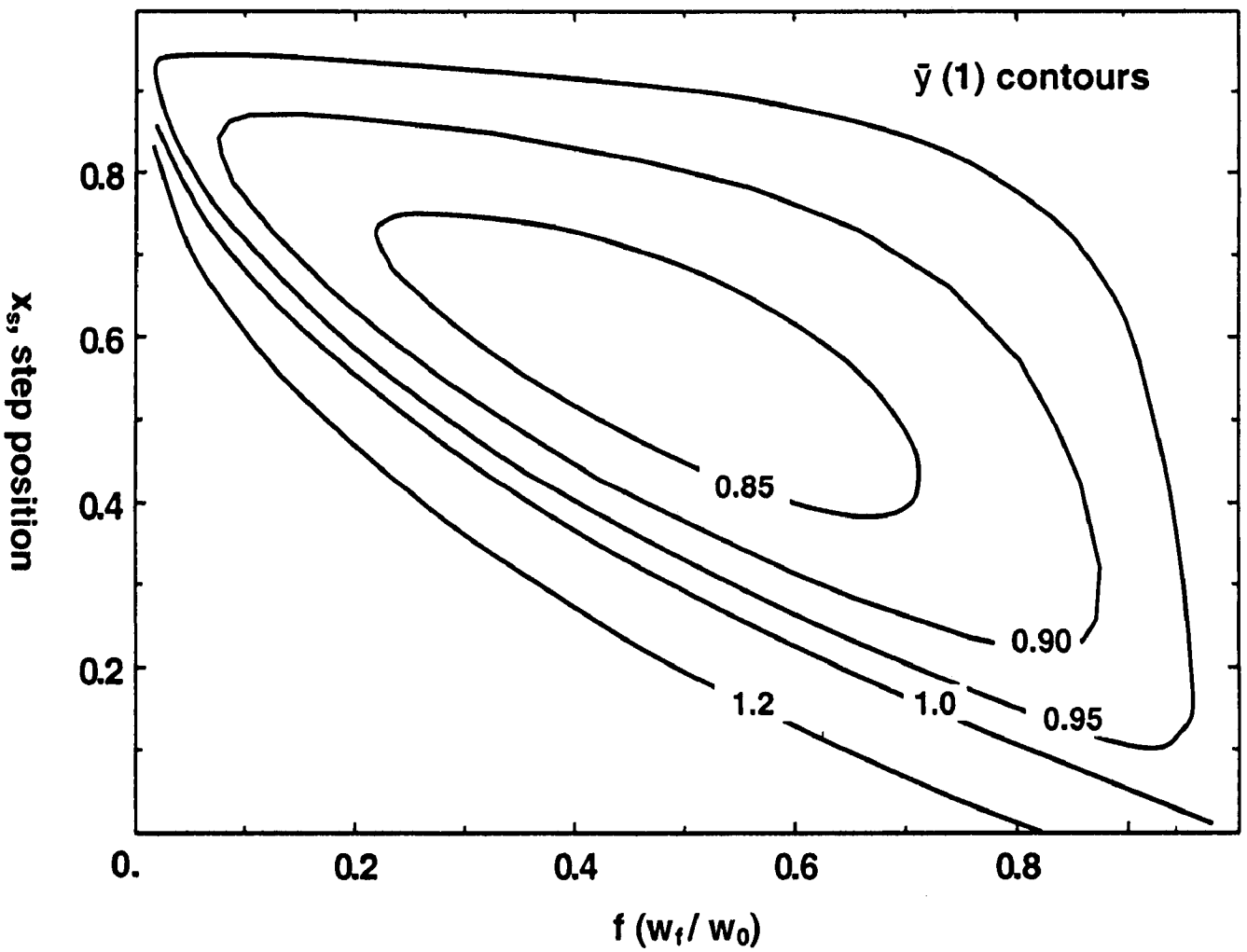
FIG. 23 shows contour plots of the thermo-mechanical bending portion free end deflection under an imposed load for single step reduction thermo-mechanical actuators as a function of step position and free end width reduction.

The normalized deflection, $\bar{y}(\mathbf{1})$, at the free end location 18 expressed in Equation 24 is contour-plotted in FIG. 23 as a function of the free end width fraction, f, and the step position $x_s$. The contours in FIG. 23 are lines of constant $\bar{y}(\mathbf{1})$, ranging from $\bar{y}(\mathbf{1})=1.2$ to $\bar{y}(\mathbf{1})=0.85$, as labeled. Benefici single step width reduction shapes are those that have $\bar{y}(\mathbf{1})<1.0$. There are not choices for the parameters f and $x_s$ that result in values of $\bar{y}(\mathbf{1})$ much less than the $\bar{y}(\mathbf{1})=0.85$ contour in FIG. 23, as may also be understood from FIG. 22. Those stepped width reduction shapes wherein $\bar{y}(\mathbf{1}) \geqq 1.0$ are not preferred embodiments of the present inventions. These shapes are conveyed by parameter choices in the lower left corner of the plot in FIG. 23.

It may be understood from the contour plots of FIG. 23 that there are multiple combinations of the two variables, f and $x_s$, which produce some beneficial reduction in the deflection of the free end under load. For example, the $\bar{y}(\mathbf{1})=0.85$ contour in FIG. 23 illustrates that a mechanical bending portion could be constructed having a free end width fraction of f=0.5 with a step position of either $x_s$, =0.45 or $x_s$=0.68.

Figure 24A:
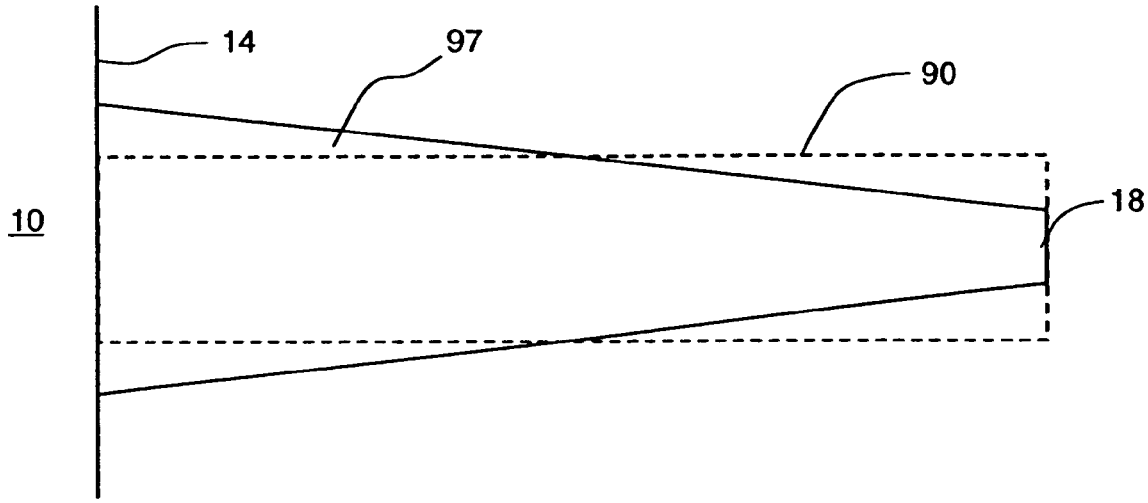
FIGS. 24(*a*) and 24(*b*) are plan views of alternative designs for a thermo-mechanical bending portion according to the present inventions.
Figure 24B:
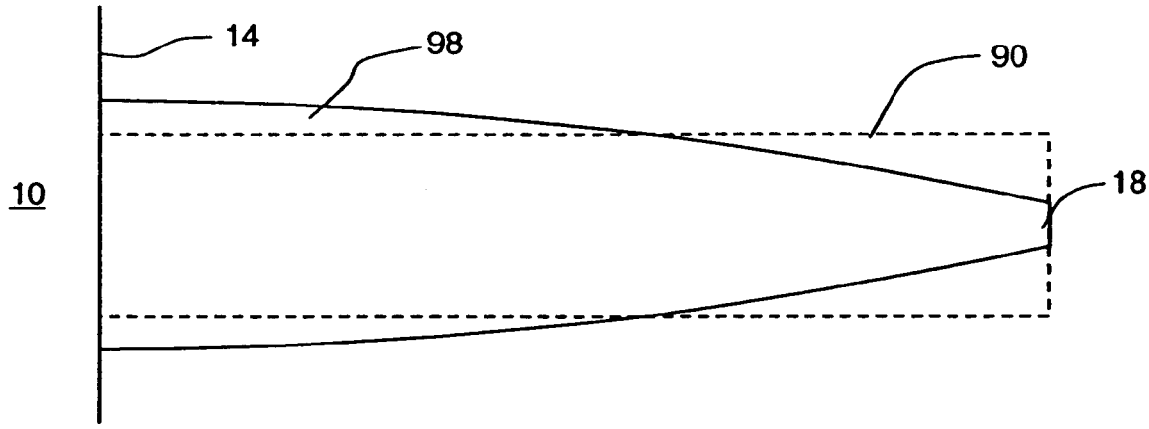

A supralinear width reduction functional form which is amenable to closed form solution is illustrated in FIGS. 24*a* and 24*b*. Thermo-mechanical bending portion 97 in FIG. 24*a* and thermo-mechanical bending portion 98 in FIG. 24*b* have width reduction functions that have the following quadratic form:

$$w(x)=2w_0[a-b(x+c)^2]=w_0\bar{w}(x), \tag{28}$$

where imposing the shape normalization requirement of Equation 15 above results in the relation for the parameter "a" as a function of b and c:

$$a = \frac{1}{2}\left[1 + \frac{2b}{3}(1 + 3c + 3c^2)\right]. \tag{29}$$

Further, in order that the free end of the thermo-mechanical bending portion is greater than zero, c must satisfy:

$$c < \frac{1}{2}\left[\frac{1}{b} - \frac{4}{3}\right]. \tag{30}$$

Phantom rectangular shape 90 in FIGS. 24*a* and 24*b* illustrates a rectangular thermo-mechanical bender portion having the same lenght L and average width $w_0$ as the quadratic shapes 97 and 98.

The potentially beneficial effects of quadratic shaped thermo-mechanical bender portions 97 and 98, illustrated in FIGS. 24*a* and 24*b*, may be understood by calculating the normalized deflection of the free end, $\bar{y}(\mathbf{1})$, using Equation 17 and the boundary conditions above noted. Inserting the expression for $\bar{w}(x)$ given in Equation 28 into Equation 17 yields:

$$\bar{y}(1) = \frac{3}{4b}\left\{\sqrt{\frac{b}{a}}\left(\frac{a}{b} + (1+c)^2\right)\ln\left[\frac{\left(\sqrt{\frac{a}{b}} + 1 + c\right)\left(\sqrt{\frac{a}{b}} - c\right)}{\left(\sqrt{\frac{a}{b}} - 1 - c\right)\left(\sqrt{\frac{a}{b}} + c\right)}\right]\right\} + \frac{3}{4b}\left\{2(1+c)\ln\left[\frac{\frac{a}{b} + (1+c)^2}{\frac{a}{b} - c^2}\right] - 2\right\}, \tag{31}$$

where a is related to b and c as specified by Equation 29 and c is limited as specified by Equation 30.

Figure 25:
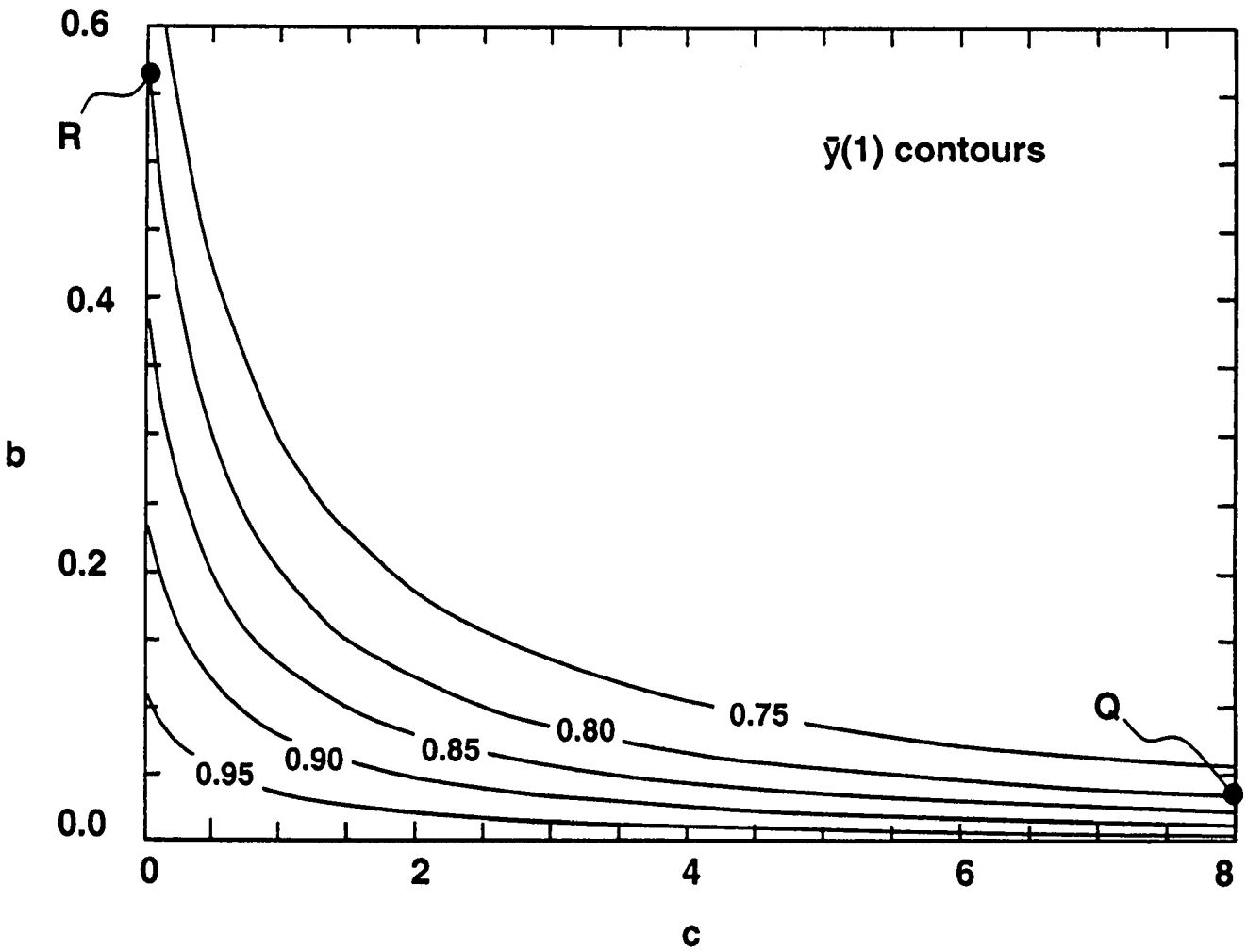
FIG. 25 shows contour plots of the thermo-mechanical bending portion free end deflection under an imposed load for width reduction shapes of the form illustrated in FIG. 24.

The normalized deflection, $\bar{y}(\mathbf{1})$, at the free end location 18 expressed in Equation 31 is contour-plotted in FIG. 25 as a function of the parameters b and c. The contours in FIG. 25 are lines of constant $\bar{y}(1)$, ranging from $\bar{y}(1)=0.95$ to $\bar{y}(1)=0.75$, as labeled. Beneficial quadratic width reduction shapes are those that have $\bar{y}(1)<1.0$. There are not choices for the parameters b and c that result in values of $\bar{y}(1)$ much less than the $\bar{y}(1)=0.75$ contour in FIG. 25. The large area of parameter space in the upper right hand corner of FIG. 25 is not allowed due to the requirement that the free end width be grater than zero, Equation 30.

It may be understood from the contour plots of FIG. 25, or from Equation 31 directly, that the quadratic width reduction functional form Equation 28 does not yield shapes having $\bar{y}(1)>1.0$. The parameter space bounded by Equation 30 does not result in some shapes having long, narrow weak free end regions as may be the case for the single step width reduction shapes discused above or the inverse-power shapes to be discussed hereinbelow.

It may be understood from the contour plots of FIG. 25 that there are many combinations of the two parameters, b and c, which produce some beneficial reduction in the deflection of the free end under load. For example, the $\bar{y}(1)=0.80$ contour in FIG. 25 illustrates that a beneficial thermo-mechanical bending portion could be constructed having a shape defined by Equation 28 wherein b=0.035 and c=8.0, point Q, or wherein b=0.57 and c=0.0, point R. These two shapes are those illustrated in FIGS. 24*a* and 24*b*. That is, thermo-mechanical bender portion 97 illustrated in FIG. 24*a* was formed according to Equation 28 wherein a=3.032, b=0.035, and c=8.0, i.e. point Q in FIG. 25. Thermo-mechanical bender portion 98 illustrated in FIG. 24*b* was formed according to Equation 28 wherein a=0.69, b=0.57 and c=0.0, i.e. point R in FIG. 25.

Figure 26A:
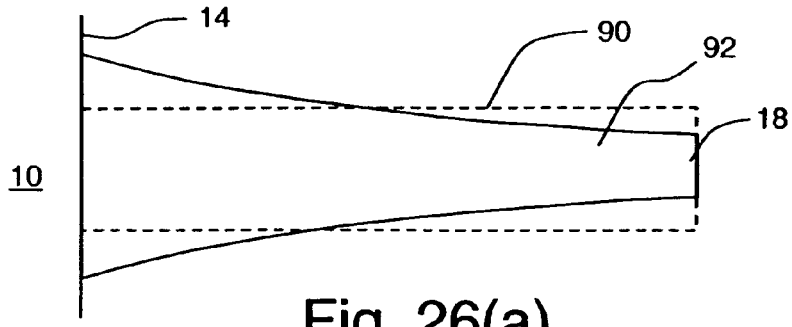
FIGS. 26(*a*)–26(*c*) are plan views of alternative designs for a thermo-mechanical bending portion.
Figure 26B:
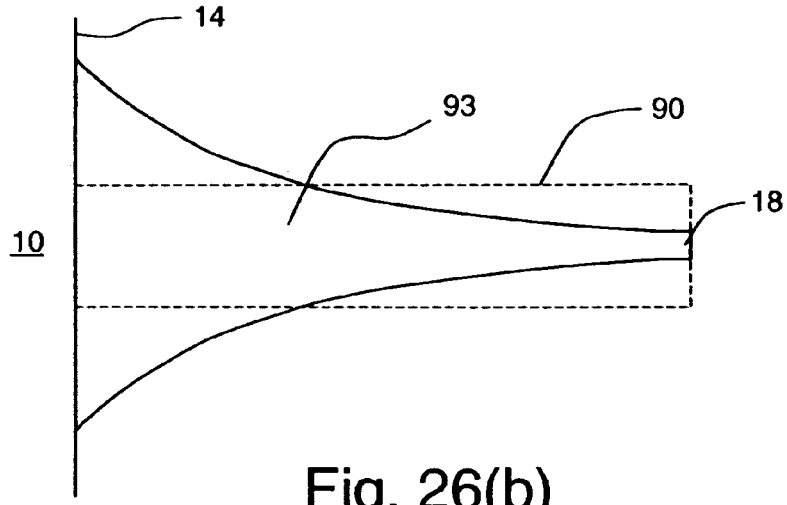
Figure 26C:
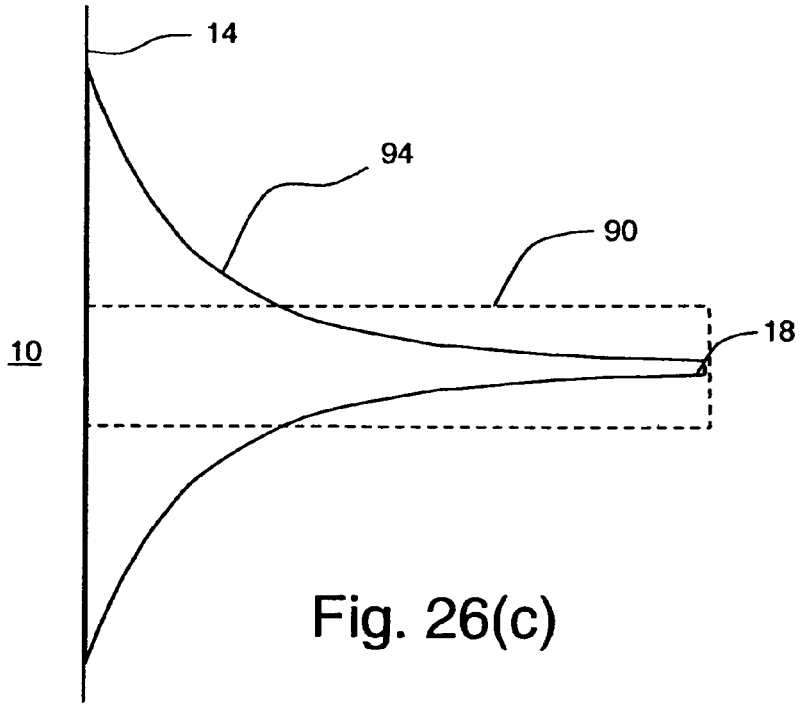

Another width reduction functional form, an inverse-power function, which is amenable to closed form solution is illustrated in FIGS. 26*a*–26*c*. Thermo-mechanical bending portions 92, 93, and 94 in FIGS. 26*a*–26*c*, respectively, have width reduction functions that have the following inverse-power form:

$$w(x) = 2w_0\left[\frac{a}{(x+b)^n}\right] = w_0\bar{w}(x), \tag{32}$$

where $n \geqq 0$, $b>0$. Imposing the shape normalization requirement of Equation 15 above results in the relation for the parameter "a" as a function of b and n:

$$2a = \frac{n-1}{b^{1-n}-(1+b)^{1-n}},\ n \neq 1, \qquad 2a = \frac{1}{\ln\left(\frac{1+b}{b}\right)},\ n = 1. \tag{33}$$

Phantom rectangular shape 90 in FIGS. 26*a*–26*c* illustrates a rectangular thermo-mechanical bender portion having the same length L and average width $w_0$ as the inverse-power shapes 92, 93 and 94.

The potentially beneficial effects of inverse-power shaped thermo-mechanical bender portions, illustrated in FIGS. 26*a*–26*c*, may be understood by calculating the normalized deflection of the free end, $\bar{y}(1)$, using Equation 17 and the boundary conditions above noted. Inserting the expression for $\bar{w}(x)$ given in Equation 32 into Equation 17 yields:

$$\bar{y}(1) = 3\left[\frac{b^{1-n}-(1+b)^{1-n}}{n-1}\right]\times \left\{\left(\frac{(1+b)^{n+3}-2b^{n+2}-(n+2)b^{n+1}-b^{n+3}}{(n+1)(n+2)}\right)-\left(\frac{(1+b)^{n+3}-b^{n+3}}{(n+2)(n+3)}\right)\right\}, \tag{34}$$

where a is related to b and n as specified by Equation 33.

Figure 27:
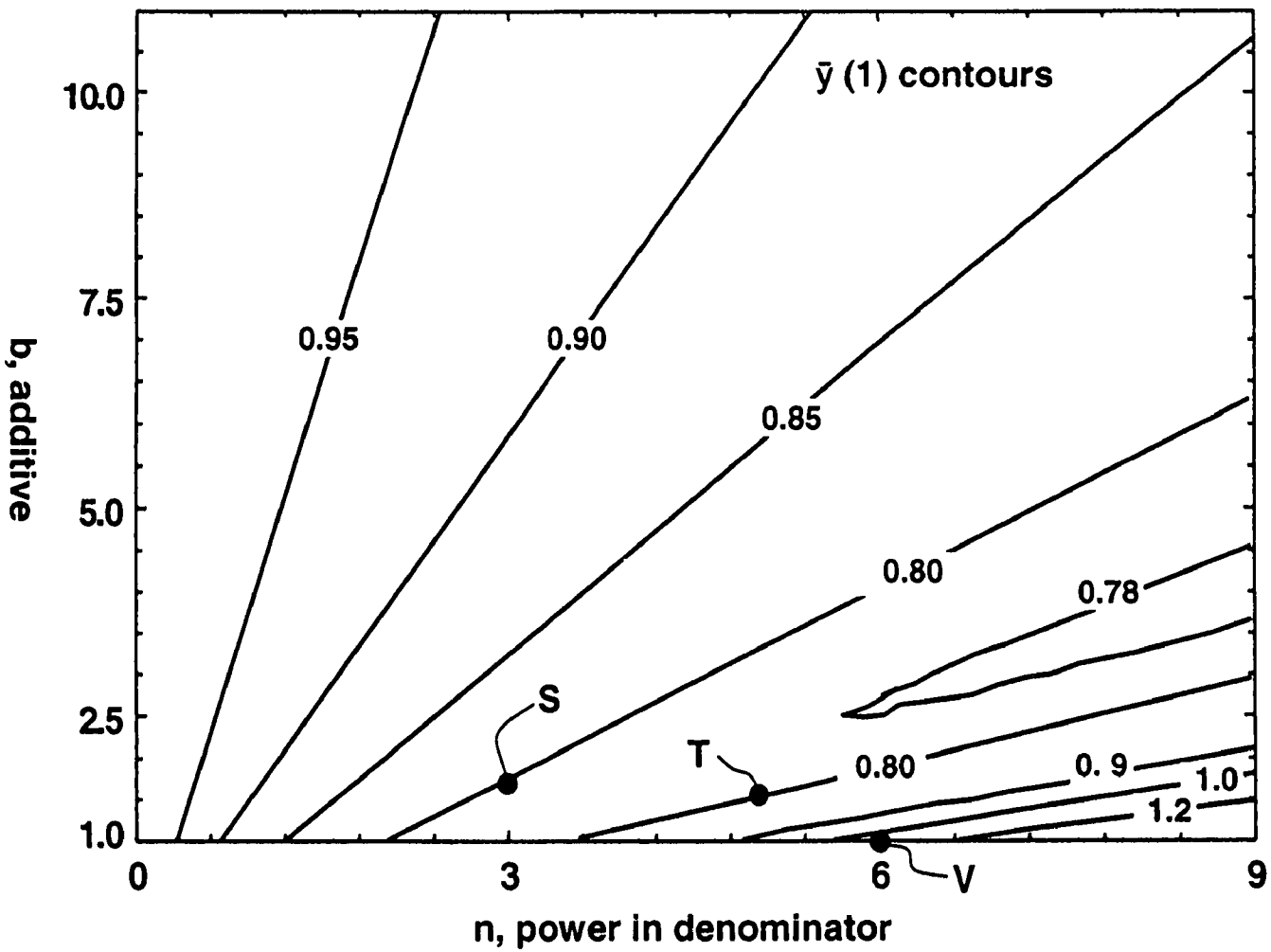
FIG. 27 shows contour plots of the thermo-mechanical bending portion free end deflection under an imposed load for width reduction shapes of the form illustrated in FIG. 26.

The normalized deflection at the free end location 18, $\bar{y}(1)$ expressed in Equation 34, is contour-plotted in FIG. 27 as a function of the parameters b and n. The contours in FIG. 27 are lines of constant $\bar{y}(1)$, ranging from $\bar{y}(1)=0.78$ to $\bar{y}(1)=1.2$, as labeled. There are not choices for the parameters b and n that result in values of $\bar{y}(1)$ much less than the $\bar{y}(1)=0.78$ contour in FIG. 27. Beneficial inverse-power width reduction shapes are those that have $\bar{y}(1)<1.0$.

It may be understood from the contour plots of FIG. 27 that there are many combinations of the two parameters, b and n which produce some beneficial reduction in the deflection of the free end under load. For example, the $\bar{y}(1)=0.80$ contour in FIG. 27 illustrates that a beneficial thermo-mechanical bending portion could be constructed having a shape defined by Equation 32 wherein b=1.75 and n=3, point S, or wherein b=1.5 and n=5, point T. These two shapes are those illustrated in FIGS. 26*a* and 26*b*. That is, thermo-mechanical bender portion 92 illustrated in FIG. 26*a* was formed according to Equation 32 wherein 2a=10.03, b=1.75, and n=3, i.e. point S in FIG. 27. Thermo-mechanical bender portion 93 illustrated in FIG. 26*b* was formed according to Equation 32 wherein 2a=23.25, b=1.5 and n=5 i.e. point T in FIG. 27.

The inverse-power shaped thermo-mechanical bender portion 94 illustrated in FIG. 26*c* does not provide a beneficial resistance to an applied load or backpressure as compared to a rectangular shape having the same area. Thermo-mechanical bender portion 94 is constructed according to Equation 32 wherein 2a=5.16, b=1, n=6, point V in FIG. 27. This shape has a normalized deflection at the free end value of $\bar{y}(1)=1.1$. Examination of the various width reduction functional forms discussed herein indicates that the thermo-mechanical bender portion shape will be less efficient than a comparable rectangular shape if the free end region is made too long and narrow. Even though the widened base end width of such shapes improves the resistance to an applied load P, the long, narrow free end is so weak that its deflection negates the benefit of the stiffer base region. Inverse-power width reduction shapes having $\bar{y}(1) \geqq 1.0$ are not preferred embodiments of the present inventions.

Several mathematical forms have been analyzed herein to assess thermomechanical bending portions having monotonically reducing widths from a base end of width $w_b$ to a free end of width $w_f$, wherein $w_b$ is substantially greater than $w_f$. Many other shapes may be constructed as combinations of the specific shapes analyzed herein. Also, shapes that are only slightly modified from the precise mathematical forms analyzed will have substantially the same performance characteristics in terms of resistance to an applied load. All shapes for the thermo-mechanical bender portion which have normalized deflections of the free end values, $\bar{y}(1)<1.0$, are anticipated as preferred embodiments of the present inventions.

The load force or back pressure resistance reduction which accompanies narrowing the free end of the thermo-mechanical bender portion necessarily means that the base end is widened, for a constant area and length. The wider base has the additional advantage of providing a wider heat transfer pathway for removing the activation beat from the cantilevered element. However, at some point a wider base end may result in a less efficient thermal actuator if too much heat is lost before the actuator reaches an intended operating temperature.

Figure 28:
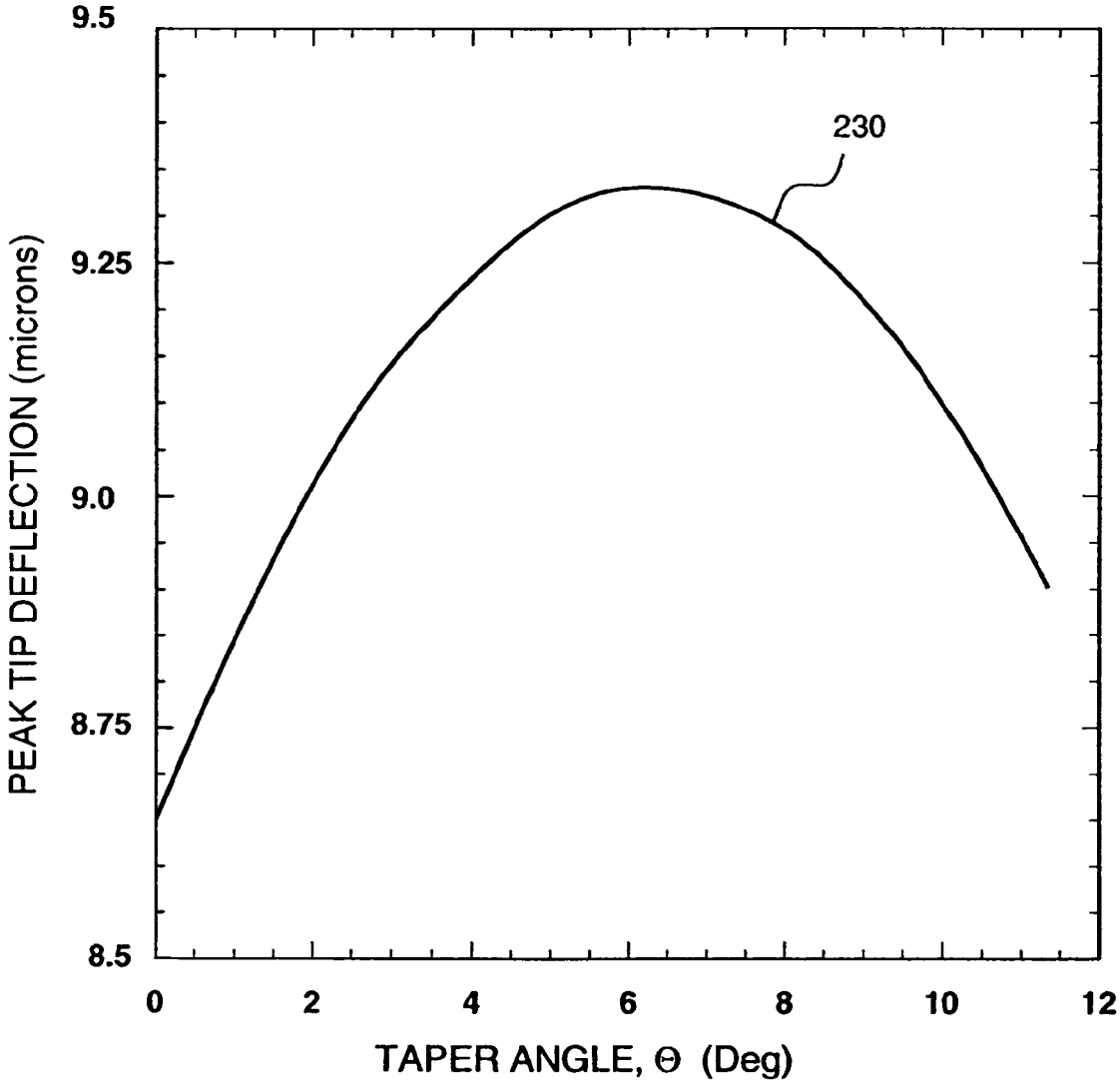
FIG. 28 plots a numerical simulation of the peak deflection of a tapered thermo-mechanical actuator, when actuated, as a function of taper angle.

Numerical simulations of the activation of trapezoidal shaped thermo-mechanical bender portions, as illustrated in FIGS. 17*a* and 17*b*, have been carried out using device dimensions and heat pulses representative of a liquid drop emitter application. The calculations assumed uniform heating over the area of the thermo-mechanical bender portion 63. The simulated deflection of the free end location 18 achieved, against a representative fluid backpressure, is plotted as curve 230 in FIG. 28 for tapered thermo-mechanical bender portions having taper angles $\Theta \sim 0^0$ to $11^0$. The energy per pulse input was held constant as were the lengths and overall areas of the thermo-mechanical bender portions having different taper angles. For plot 230 in FIG. 28, the deflection is larger for a device having more resistance to the back pressure load. It may be understood from plot 230, FIG. 28, that a taper angle in the range of $3^0$ to $10^0$ offers substantially increased deflection or energy efficiency over a rectangular thermo-mechanical bender portion having the same area and length. The rectangular device performance is conveyed by the $\Theta=0^0$ value of plot 230.

The fall-off in deflection at angles above 6° in plot 230 is due to thermal losses from the widening base ends of the thermo-mechanical bender portion. The more highly tapered devices do not reach the intended operating temperature because of premature loss in activation heat. An optimum taper or width reduction design preferably is selected after testing for such heat loss effects.

In addition to the efficiency advantages of a tapering shape via better resistance to the application load, the inventors of the present inventions have discovered that the energy efficiency of the thermo-mechanical actuation force may be enhanced by establishing a beneficial spatial thermal pattern in the thermo-mechanical bender portion. A beneficial spatial thermal pattern is one that causes the increase in temperature, ΔT, within the relevant layer or layers to be greater at the base end than at the free end of the thermo-mechanical bender portion. This may be further understood by using Equation 2 above for calculating the affect of an applied thermo-mechanical moment, $M_T(x)$, which varies spatially as a function of the distance x, measured from the anchor location 14 of the base end of the thermo-mechanical bender portion.

For a rectangular thermo-mechanical bender portion, the stiffness I(x) is a constant. Therefore, Equation 2 leads to a re-cast Equation 4 becoming Equation 35:

$$\frac{d^2y}{dx^2} = L^2\frac{M_T(x)}{EI} = L^2 c\Delta T(x), \tag{35}$$

where $$I = \frac{1}{12}w_0h^3,$$

and the distance variable x has been normalized by L. The quantity "c" is a thermo-mechanical structure factor which captures the geometrical and materials properties which lead to an internal thermo-mechanical moment when the temperature of a thermo-mechanical bender is increased. An example calculation of "c" for a multi-layer beam structure will be given hereinbelow. The temperature increase has a spatial thermal pattern, as indicated by making ΔT a function of x, i.e., ΔT(x).

Figure 29:
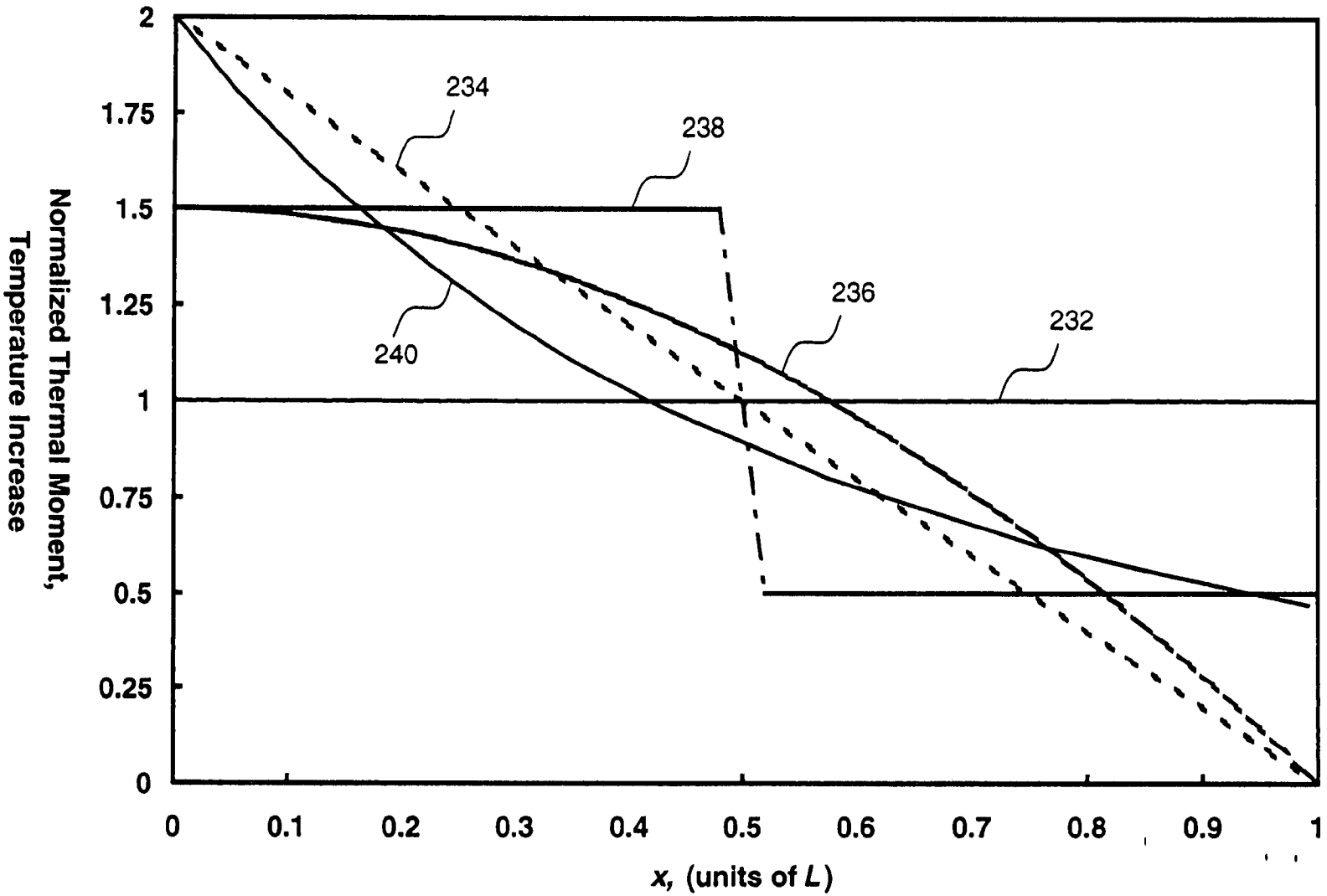
FIG. 29 illustrates several spatial thermal patterns over the thermo-mechanical bender portion causing spatial dependence of the applied thermal moments.

Several example spatial thermal patterns, ΔT(x), are plotted in FIG. 29. The plots in FIG. 29 illustrate temperature increase profiles along a rectangular thermo-mechanical bender portion wherein x=0 is at the base end and x=1 is at the free end location. The distance variable x has been normalized by the length L of the thermo-mechanical bender portion. The temperature increase profiles are further normalized so as to all have the same average temperature increase, normalized to 1. That is, the integrals of the temperature increase profiles in FIG. 29, evaluated from x=0 to x=1, have been made equal by adjusting the maximum increase in temperature for each spatial thermal pattern example. The amount of energy applied to the thermo-mechanical bender portion is proportional to this integral so all of the plotted thermal patterns have resulted from the application of the same amount of input heat energy.

In FIG. 29, plot 232 illustrates a constant temperature increase profile, plot 234 a linearly declining temperature increase profile, plot 236 a quadratically declining temperature increase profile, plot 238 a profile in which the temperature increase declines in one step, and plot 240 an inverse-power law declining temperature increase function. The following mathematical expressions will be used to analyze the effect on the deflection of a thermo-mechanical bender portion having these spatial thermal patterns:

$$\text{Constant } \Delta T \text{ pattern: } \frac{M_T(x)}{EI} = c\Delta T_0; \tag{36}$$

$$\text{Linear } \Delta T \text{ pattern: } \frac{M_T(x)}{EI} = 2c\Delta T_0(1-x); \tag{37}$$

$$\text{Quadratic } \Delta T \text{ pattern: } \frac{M_T(x)}{EI} = \frac{3}{2}c\Delta T_0(1-x^2); \tag{38}$$

$$\text{Stepped } \Delta T \text{ pattern: } \frac{M_T(x)}{EI} = c\Delta T_0(1+\beta);\ 0 \le x \le x_s \tag{39}$$

$$\frac{M_T(x)}{EI} = c\Delta T_0\frac{(1-(1+\beta)x_s)}{(1-x_s)},\ x_s \le x \le 1.$$

$$\text{Inverse-power } \Delta T \text{ pattern: } \frac{M_T(x)}{EI} = c\Delta T_0\left[\frac{2a}{(b+x)^n}\right]. \tag{40}$$

The stepped ΔT profile is expressed in terms of the increase in ΔT, β, over the constant case, at the base end of the thermo-mechanical bender portion, and the location, $x_s$, of the single step reduction. In order to be able to normalize a stepped reduction spatial thermal pattern to a constant case, $x_s \leqq 1/(1+\beta)$. If $x_s$ is set equal to $1/(1+\beta)$, then the temperature increase must be zero for the length of the thermo-mechanical bender outward of $x_s$. The stepped spatial thermal pattern plotted as curve 238 in FIG. 29 has the parameters β=0.5 and $x_s$=0.5.

The inverse-power law ΔT pattern is expressed in terms of shape parameters a, b, and inverse power, n. The parameter a, as a function of b and n, is determined by requiring that the average temperature increase over the thermo-mechanical bender portion be $\Delta T_0$:

$$\int_0^1 \frac{2a}{(b+x)^n}\,dx = 1, \tag{41}$$

$$\text{therefore, } 2a = \frac{(n-1)}{b^{(1-n)} - (1+b)^{(1-n)}}, \text{ for } n > 1,$$

$$\text{and, } 2a = \frac{1}{\ln\left(\frac{1+b}{b}\right)}, n = 1. \tag{42}$$

The inverse-power law spatial thermal pattern plotted as curve 240 in FIG. 29 has the shape parameters: n=3, b=1.62, and 2a=8.50.

The deflection of the free end of the thermomechanical bender portion, y(1), which results from the several different spatial thermal patterns plotted in FIG. 29 and expressed as Equations 36–40, may be understood by using Equation 35. First, considering the case of a constant temperature increase along the thermo-mechanical bender portion, Equation 36 is inserted into Equation 35. The resulting differential equation is solved for y(x) assuming boundary conditions: y(0)=dy(0)/dx=0.

$$\text{Constant } \Delta T \text{ pattern: } y_{cons}(x) = L^2 c \Delta T_0 \left(\frac{x^2}{2}\right); \tag{43}$$

$$y_{cons}(1) = L^2 c \Delta T_0 \left(\frac{1}{2}\right). \tag{44}$$

The value given in Equation 44 for the deflection of the free end of a thermo-mechanical bender portion when a constant thermal pattern is applied, $y_{cons}$(1), will be used hereinbelow to normalize, for comparison purposes, the free end deflections resulting from the other spatial thermal patterns illustrated in FIG. 29.

Many spatial thermal patterns which monotonically reduce in temperature increase from the base end to the free end of the thermo-mechanical bender portion will show improved deflection of the free end as compared to a uniform temperature increase. This can be seen from Equation 35 by recognizing that the rate of change in the bending of the beam, $d^2y/dx^2$ is caused to decrease as the temperature increase decreases away from the base end. That is, from Equation 35:

$$\frac{d^2 y}{dx^2} \propto \Delta T(x). \tag{45}$$

As compared to the constant temperature increase case wherein $\Delta T(x)=\Delta T_0$, a normalized, monotonically decreasing $\Delta T(x)$ will result in a larger value for the rate of change in the slope of the beam at the base end. The more the cantilevered element slope is increased nearer to the base end, the larger will be the ultimate amount of deflection of the free end. This is because the outward extent of the beam will act as a lever arm, further magnifying the amount of bending and deflection which occurs in higher temperature regions of the thermo-mechanical bending portion near the base end. A beneficial improvement in the thermo-mechanical bender portion energy efficiency will result if the base end temperature increase is substantially greater than the free end temperature increase, provided the total input energy or average temperature increase is held constant. The term substantially greater is used herein to mean at least 20% greater.

Applying added thermal energy in a spatial thermal pattern which is biased towards the free end will not enjoy the leveraging effect and will be less efficient than a constant spatial thermal pattern.

It is useful to the understanding of the present inventions to characterize thermo-mechanical bender portions that have a monotonically reducing spatial thermal pattern by calculating the normalized deflection at the free end, $\bar{y}$(1). The normalized deflection at the free end, $\bar{y}$(1), is calculated for an arbitrary spatial thermal pattern by first normalizing the spatial thermal pattern parameters so that the deflection may be compared in consistent fashion to a similiarly constructed thermo-mechanical bending portion subject to a uniform temperature increase. The length of and the distance along the thermo-mechanical bender portion, x, are normalized to L so that x ranges from x=0 at the anchor location 14 to x=1 at the free end location 18.

The spatial thermal pattern, $\Delta T(x)$, is normalized by requiring that the average temperature increase is $\Delta T_0$. That is, the normalized spatial thermal pattern, $\overline{\Delta T}(x)$, is formed by adjusting the pattern parameters so that $$\int_0^1 \frac{\overline{\Delta T}(x)}{\Delta T_0}\,dx = 1. \tag{46}$$

The normalized deflection at the free end, $\bar{y}$(1), is then calculated by first inserting the normalized spatial thermal pattern, $\overline{\Delta T}(x)$, into differential Equation 35:

$$\frac{d^2 y}{dx^2} = L^2 c \Delta T_0 \overline{\Delta T}(x). \tag{47}$$

Equation 47 is integrated twice to determine the deflection, y(x), along the thermo-mechanical bender portion. The integration solutions are subjected to the boundary conditions noted above, y(0)=dy(0)/dx=0. In addition, if the normalized spatial thermal pattern function $\overline{\Delta T}(x)$ has steps, i.e. discontinuities, y and dy/dx are required to be continuous at the discontinuities. y(x) is evaluated at free end location 18, x=1, and normalized by the quantity, $y_{cons}$(1), the free end deflection of the constant spatial thermal pattern, given in Equation 44. The resulting quantity is the normalized deflection at the free end, $\bar{y}$(1):

$$\bar{y}(\mathbf{1}) = 2\int_0^1 \left[\int_0^{x_2} \overline{\Delta T}(x)\,dx_1\right] dx_2 \tag{48}$$

If the normalized deflection at the free end, $\bar{y}$(1)>1, then that spatial thermal pattern will provide more free end deflection than by applying the same energy uniformly. Such a spatial thermal pattern may be used to create a thermal actuator having more deflection for the same input of thermal energy or the same deflection with the input of less thermal energy than the comparable uniform temperature increase pattern. If, however, $\bar{y}$(1)<1, then that spatial thermal pattern yields less free end deflection and is disadvantaged relative to a uniform temperature increase.

The normalized deflection at the free end, $\bar{y}$(1), is used herein to characterize and evaluate the contribution of an applied spatial thermal pattern to the performance of a cantilevered thermal actuator. $\bar{y}$(1) may be determined for an arbitary spatial thermal pattern, $\Delta T(x)$, by using well known numerical integration methods to calculate $\overline{\Delta T}(x)$ and to evaluate Equation 48. All spatial thermal patterns which have $\overline{y}(1)>1$ are preferred embodiments of the present inventions.

The deflections of a rectangular thermomechanical bender portion subjected to the linear, quadratic, stepped and inverse-power spatial thermal patterns given in Equations 37–40 respectively are found in similar fashion by employing above differential Equation 48 with the boundary conditions: $y(0)=dy(0)/dx=0$. For the stepped reduction spatial thermal pattern, it is further assumed that the deflection and deflection slope are continuous at the step position, $x_s$. The deflection values of the free ends, $y(1)$, are normalized to the constant thermal pattern case.

$$\text{Linear } \Delta T \text{ pattern: } y_{lin}(x) = 2L^2c\Delta T_0\left(x^2 - \frac{x^3}{3}\right); \tag{49}$$

$$\overline{y}_{lin}(1) = \frac{4}{3}. \tag{50}$$

$$\text{Quadratic } \Delta T \text{ pattern: } y_{quad}(x) = \frac{3}{2}L^2c\Delta T_0\left(\frac{x^2}{2} - \frac{x^4}{12}\right); \tag{51}$$

$$\overline{y}_{quad}(1) = \frac{5}{4}. \tag{52}$$

$$\text{Stepped } \Delta T \text{ pattern: } y_{step}(x) = (1+\beta)L^2c\Delta T_0\left(\frac{x^2}{2}\right), \quad 0 \le x \le x_s, \tag{53}$$

$$y_{step}(x) = \frac{(1-(1+\beta)x_s)}{(1-x_s)}L^2c\Delta T_0\left(\frac{x^2}{2}\right), \quad x_s \le x \le 1$$

$$\overline{y}_{step}(1) = (1+\beta x_s). \tag{54}$$

$$\text{and for } \beta = x_s = 0.5,\ \overline{y}_{step}(1) = \frac{5}{4}. \tag{55}$$

$$\text{Inverse-power } \Delta T \text{ pattern:} \tag{56}$$

$$y_{invpr}(x) = (2a)\frac{(x+b)^{(2-n)} + (n-2)b^{(1-n)}x - b^{(2-n)}}{(n-1)(n-2)}L^2c\Delta T_0,$$

$$\overline{y}_{invpr}(1) = 2(2a)\frac{(1+b)^{(2-n)} + (n-2)b^{(1-n)} - b^{(2-n)}}{(n-1)(n-2)}, \tag{57}$$

$$\text{and for } n = 3,\ b = 1.62,\ \overline{y}_{invpr}(1) = (1.24). \tag{58}$$

The expressions for the normalized free end deflection magnitudes given as Equations 50, 52, 55 and 58 above show the improvement in energy efficiency of spatial thermal patterns which result in a higher temperature increase at the base end than the free end of the thermo-mechanical bender portion. For example, if the same energy input used for a constant thermal profile actuation is applied, instead, in a linearly decreasing spatial thermal pattern, the free end deflection may be 33% greater (see Equation 50). If the energy is applied in a quadratic decreasing pattern, the deflection may be 25% greater (see Equation 52). If the energy is applied in an inverse-power decreasing pattern, the deflection may be 24% greater (see Equation 58).

The step reduction spatial thermal patterns have deflection increases that depend on both the position of the temperature increase step, $x_s$, and the magnitude of the step between the base end temperature increase, $\Delta T_b$, and the free end temperature increase, $\Delta T_f$:

$$\Delta T_b - \Delta T_f = \frac{\beta}{1-x_s}. \tag{59}$$

Figure 30:
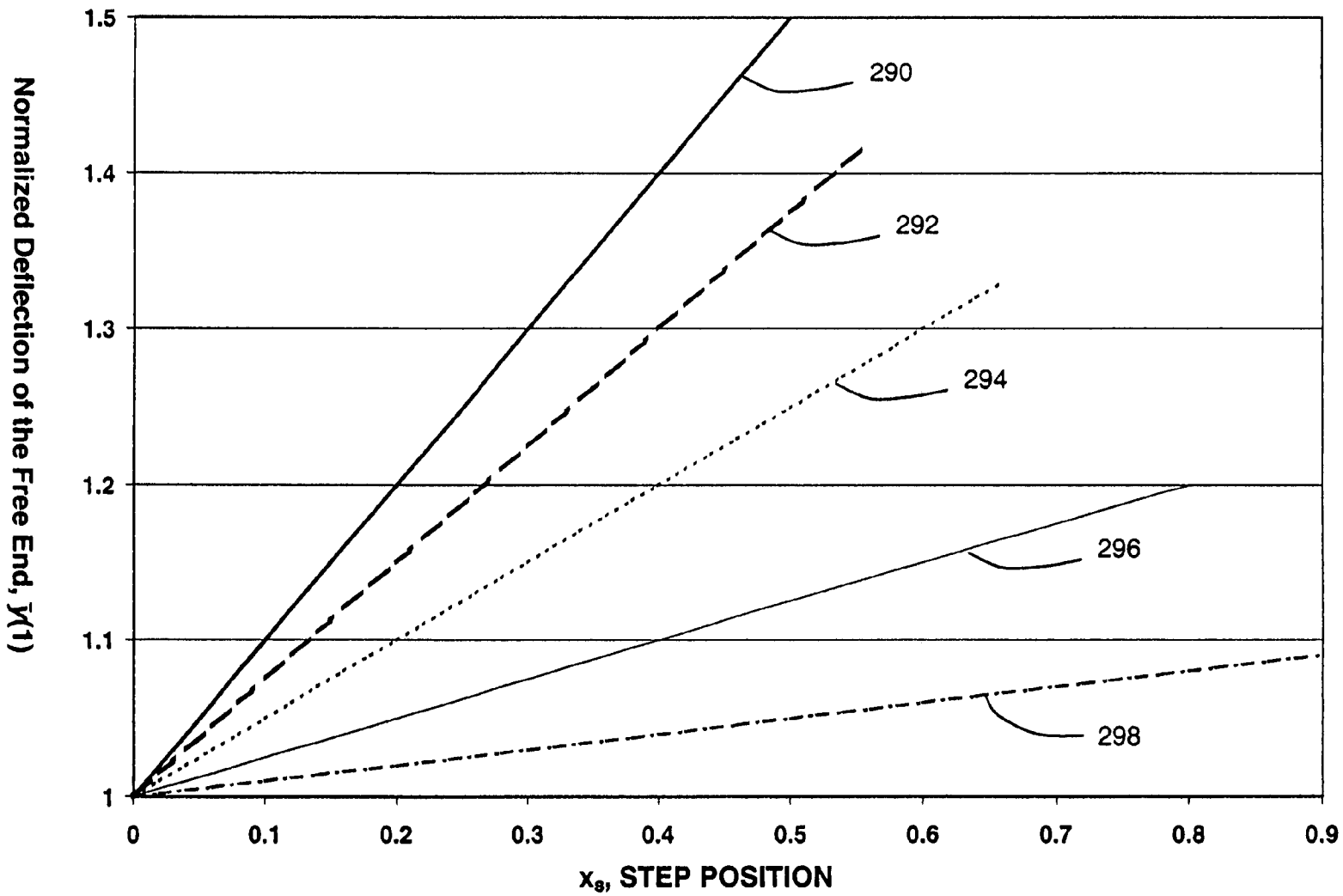
FIG. 30 plots calculations of the normalized peak deflection of a thermo-mechanical actuator having a stepped reduction spatial thermal pattern, as a function the magnitude and position of the temperature increase reduction.

Equation 59 is plotted in FIG. 30 for several values of β as a function of the step position, $x_s$, wherein $x_s \leqq 1/(1+\beta)$. If $x_s$ is set equal to $1/(1+\beta)$, then the temperature increase must be zero for the length of the thermo-mechanical bender outward of $x_s$. In FIG. 30 plot 290 is for β=1.0; plot 292 is for β=0.75; plot 294 is for β=0.50; plot 296 is for β=0.25; and plot 298 is for β=0.10.

The value of β represents the amount of additional heating and temperature increase, over the constant thermal profile base case, that must be tolerated by the materials of the thermo-mechanical bender portion in order to realize increased deflection efficiency. If, for example, a 100% increase is viable, then a value β=1 may be used. From plot 290 in FIG. 30 it may be seen that a 50% increase in free end deflection might be realized if the maximum possible step position, $x_s$=0.5, is used. If a 50% increase in temperature increase is viable, then β=0.50, and an efficiency increase of up to 33% might be realized.

Several mathematical forms have been analyzed herein to assess thermal spatial patterns having monotonically reducing temperature increases from a base end to a free end of a thermo-mechanical bender portrion. Many other spatial thermal patterns may be constructed as combinations of the specific functional forms analyzed herein. Also, spatial thermal patterns that are only slightly modified from the precise mathematical forms analyzed will have substantially the same performance characteristics in terms of the deflection of the free end. All spatial thermal patterns for the applied heat pulse which cause normalized deflections of the free end values, $\overline{y}(1)>1.0$, are anticipated as preferred embodiments of the present inventions.

A beneficial improvement in the thermo-mechanical bender portion energy efficiency will result if the base end temperature increase is substantially greater than the free end temperature increase. The term substantially greater is used herein to mean at least 20% greater. Applying added thermal energy in a spatial thermal pattern which is biased towards the free end will not enjoy the leveraging effect and will be less efficient than a constant spatial thermal pattern.

The present inventions include apparatus to apply a beat pulse having a spatial thermal pattern to the thermo-mechanical bender portion. Any means which can generate and transfer heat energy in a spatial pattern may be considered. Appropriate means may include projecting a light energy pattern onto the thermo-mechanical bender portion or coupling an rf energy pattern to the thermo-mechanical bender. Such spatial thermal patterns may be mediated by a special layer applied to the thermo-mechanical bender portion, for example a light absorbing and reflecting pattern to receive light energy or a conductor pattern to couple rf energy.

Figure 31A:
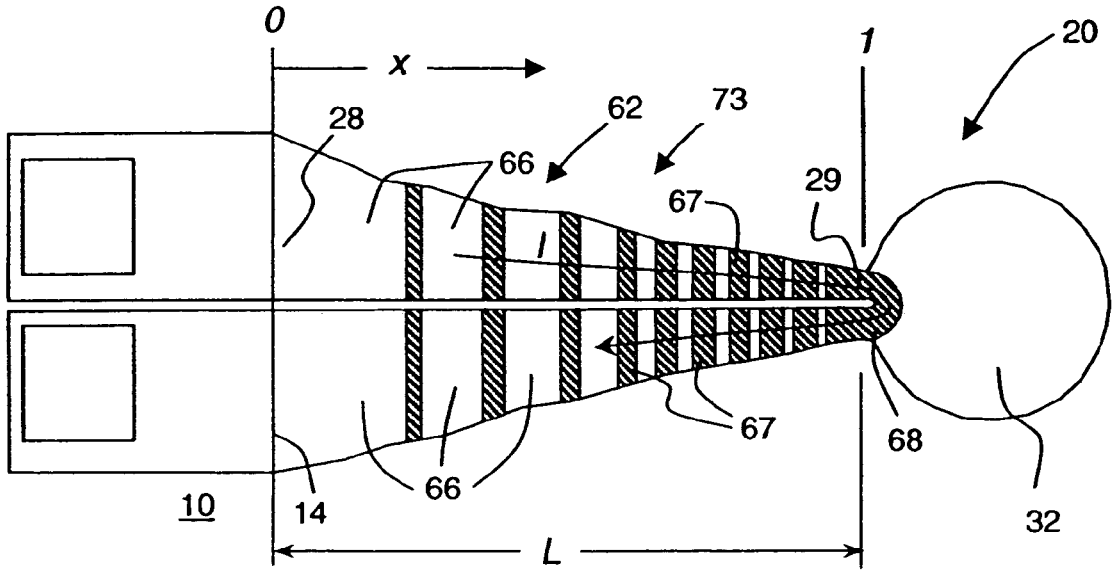
FIGS. 31(*a*) and 31(*b*) are a plan view and temperature increase plot, respectively, illustrating a heater resistor having a spatial thermal pattern according to the present inventions.
Figure 31B:
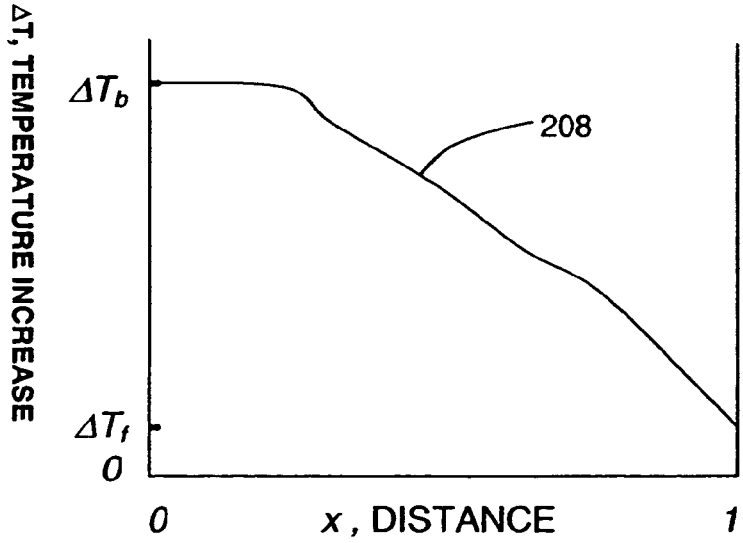

Preferred embodiments of the present inventions utilize electrical resistance apparatus to apply heat pulses having a spatial thermal pattern to the thermo-mechanical bender portion when pulsed with electrical pulses. FIG. 31*a* illustrates a monotonically declining spatial thermal pattern 73 in the area of a monotonically reducing width thermo-mechanical bender portion 62 which will generate a spatial thermal pattern according to the present inventions. Spatial thermal pattern 73 is generated by thin film resistor segments 66 joined serially by current coupler shunt 68 and overlaid with a pattern of current shunts 67 that result in the series of smaller resistor segments 66. The function of current shunts 67 is to reduce the electrical power density, and hence the Joule heating, in the areas of the current shunts. When energized with an electrical pulse, resistor pattern 62 will set up a spatial pattern of Joule heat energy, which, in turn will cause a spatial thermal pattern 73 as schematically illustrated by curve 208 in FIG. 31*b*. The illustrated spatial thermal pattern causes the highest temperature increase $\Delta T_b$ to occur at the base end and then a monotonically decreasing temperature increase to the free end temperature increase, $\Delta T_f$.

Figure 32A:
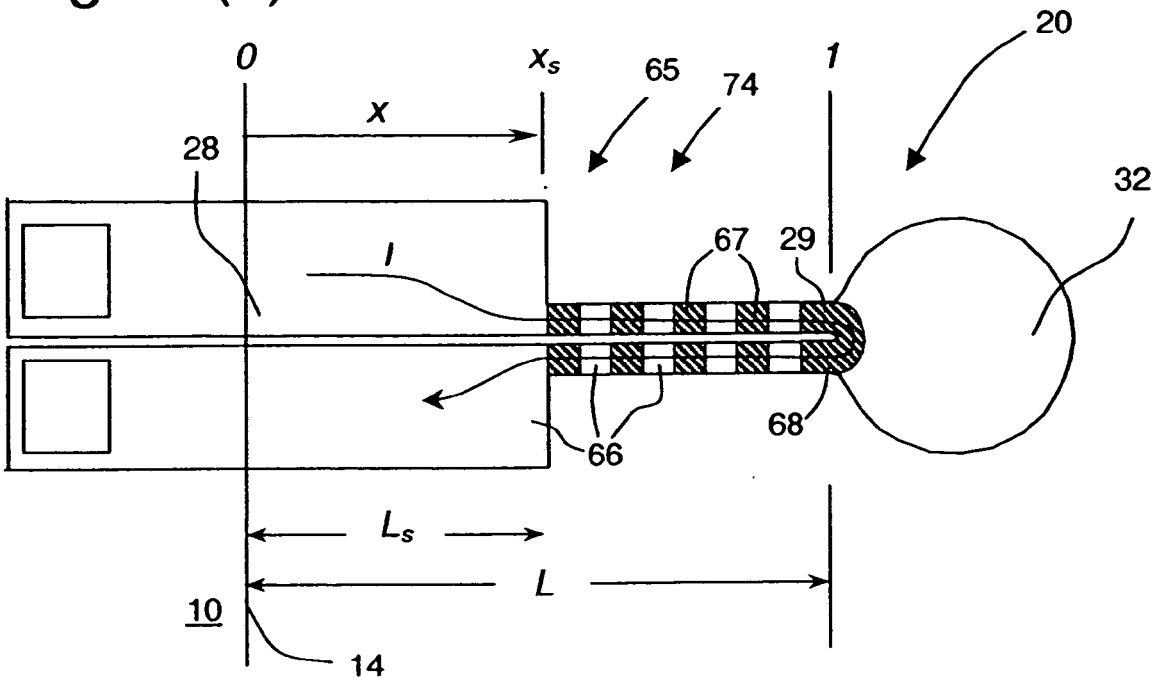
FIGS. 32(*a*) and 32*b* are a plan view and temperature increase plot, respectively, illustrating a heater resistor having a spatial thermal pattern having a stepped reduction in increase temperature according to the present inventions.
Figure 32B:
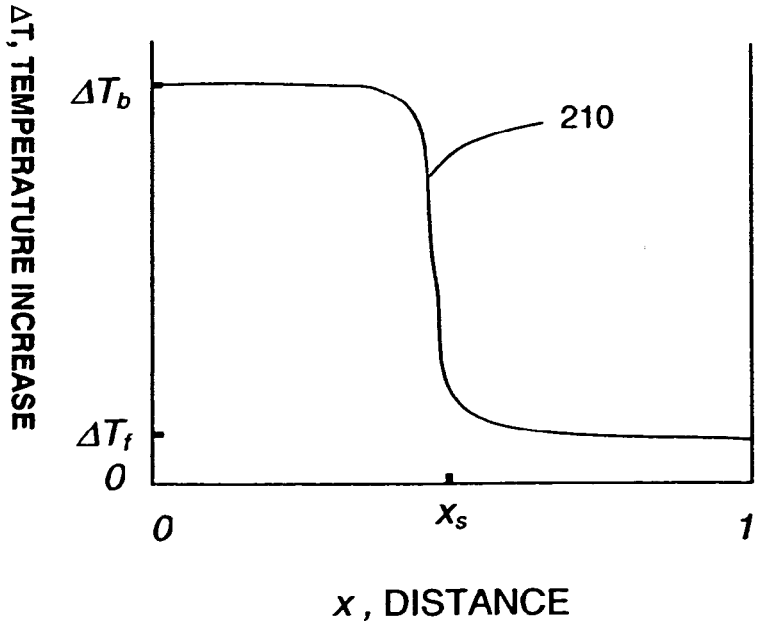

FIG. 32*a* illustrates a step-decline spatial thermal pattern 74 in the area of a step width reducing thermo-mechanical bender portion 65 according to the present inventions. Spatial pattern 74 is generated by thin film resistor segments 66 joined serially by current coupler shunt 68 and overlaid with a pattern of current shunts 67 that result in the series of smaller resistor segments 66. When energized with an electrical pulse a stepped pattern of applied Joule heat energy is set up, which, in turn will cause a stepped spatial thermal pattern 74 as schematically illustrated by curve 210 in FIG. 32*b*. The illustrated stepped spatial thermal pattern 74 causes the highest temperature increase $\Delta T_b$ to occur at the base end and then, at $x=x_s$, an abrupt drop in the temperature increase to the free end temperature increase, $\Delta T_f$.

Resistor patterns to generate spatial thermal patterns may be formed in either the first or the second deflector layers of the thermo-mechanical bender portion. Alternatively, a separate thin film heater resistor may be constructed in additional layers which are in good thermal contact with either deflector layer. Current shunt areas may be formed in several manners. A good conductor material may be deposited and patterned in a current shunt pattern over an underlying thin film resistor. The electrical current will leave the underlying resistor layer and pass through the conducting material, thereby greatly reducing the local Joule heating.

Alternatively, the conductivity of a thin film resistor material may be modified locally by an in situ process such as laser annealing, ion implantation, or thermal diffusion of a dopant material. The conductivity of a thin film resistor material may depend on factors such as crystalline structure, chemical stoichiometry, or the presence of dopant impurities. Current shunt areas may be formed as localized areas of high conductivity within a thin film resistor layer utilizing well known thermal and dopant techniques common to semiconductor manufacturing processes.

Figure 33A:
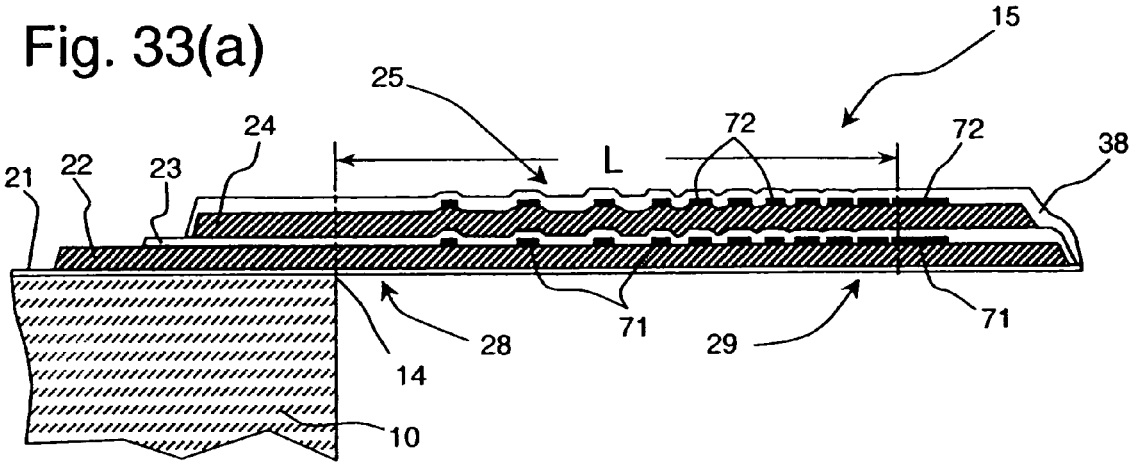
FIGS. 33(*a*)–33(*c*) are side views illustrating several apparatus for applying heat pulses having a spatial thermal pattern.
Figure 33B:
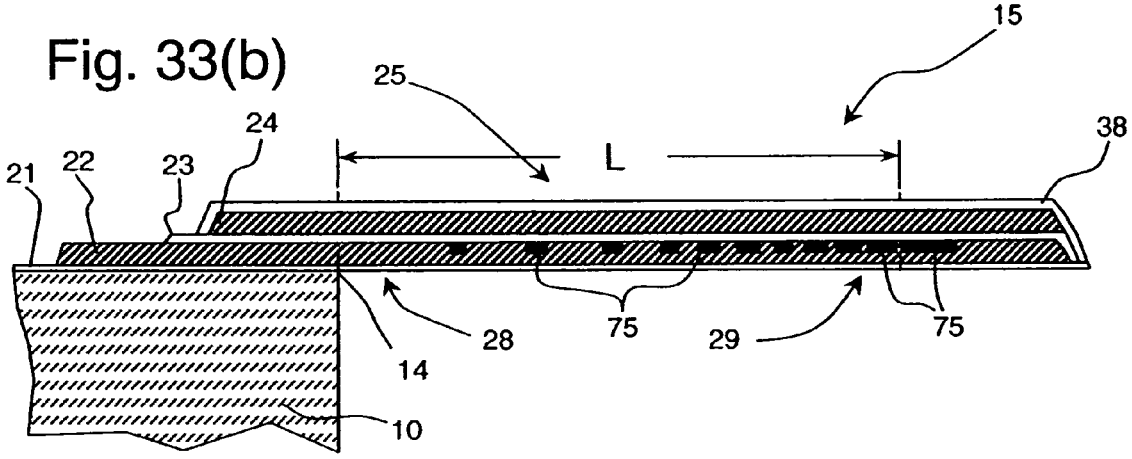
Figure 33C:
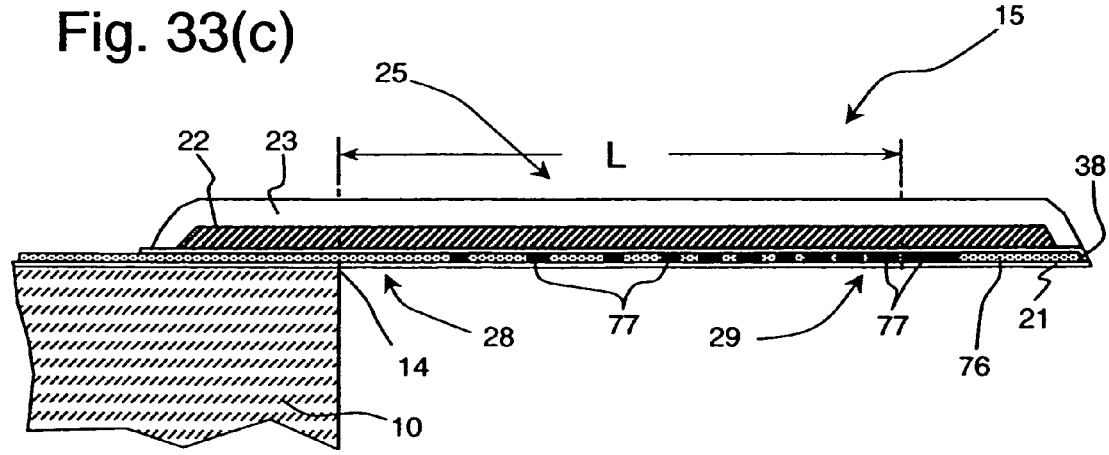

FIGS. 33*a*–33*c* illustrate in side view several alternatives to forming apparatus for applying heat pulses having spatial thermal patterns using thin film resistor materials and fabrication processes. FIG. 33*a* illustrates a thermo-mechanical bender portion formed with electrically resistive first deflector layer 22 and electrically resistive second deflector layer 24. A patterned conductive material is formed over first deflector layer 22 to create a first current shunt pattern 71. A patterned conductive material is also formed over the second deflector layer 24 to create a second current shunt pattern 72.

FIG. 33*b* illustrates a thermo-mechanical bender portion formed with a electrically resistive first deflector layer 22 and second deflector layer 24 configured as a passive restorer layer. A current shunt pattern 75 is formed in first deflector layer 22 by an insitu process which locally increases the conductivity of the first deflector layer material.

FIG. 33*c* illustrates a thermo-mechanical bender portion formed with a first deflector layer 22 and a low thermal expansion material layer 23. A thin film resistor structure is formed in a resistor layer 76 in good thermal contact with first deflector layer 22. A current shunt pattern 77 is formed in resistor layer 76 by an insitu process which locally increases the conductivity of the resistor layer material. Thin film resistor layer 76 is electrically isolated from first deflector layer 22 by a thin passivation layer 38.

Some spatial patterning of the Joule heating of a thin film resistor may also be accomplished by varying the resistor material thickness in a desired pattern. The current density, hence the Joule heating, will be inversely proportional to the layer thickness. A beneficial spatial thermal pattern can be set-up in the thermo-mechanical bender portion by forming an adjacent thin film heater resistor to be thinnest at the base end and increasing in thickness towards the free end.

The thermomechanical bender portions in FIGS. 31*a* and 32*a* illustrate the combination of both a width reducing shape and a declining temperature spatial thermal pattern. The inventors of the present inventions have found, via numerical simulations, that both energy saving mechanisms may be employed in combination to achieve maximum energy efficiency for thermal actuation. Thermal actuators and device applications, such as liquid drop emitters, may be designed using any combination of the beneficial shape and spatial thermal pattern concepts disclosed herein. Such combinations are anticipated as embodiments of the present inventions.

Additional features of the present inventions arise from the design, materials, and construction of the multi-layered thermo-mechanical bender portion illustrated previously in FIGS. 4*a*–15*b*.

Figure 34:
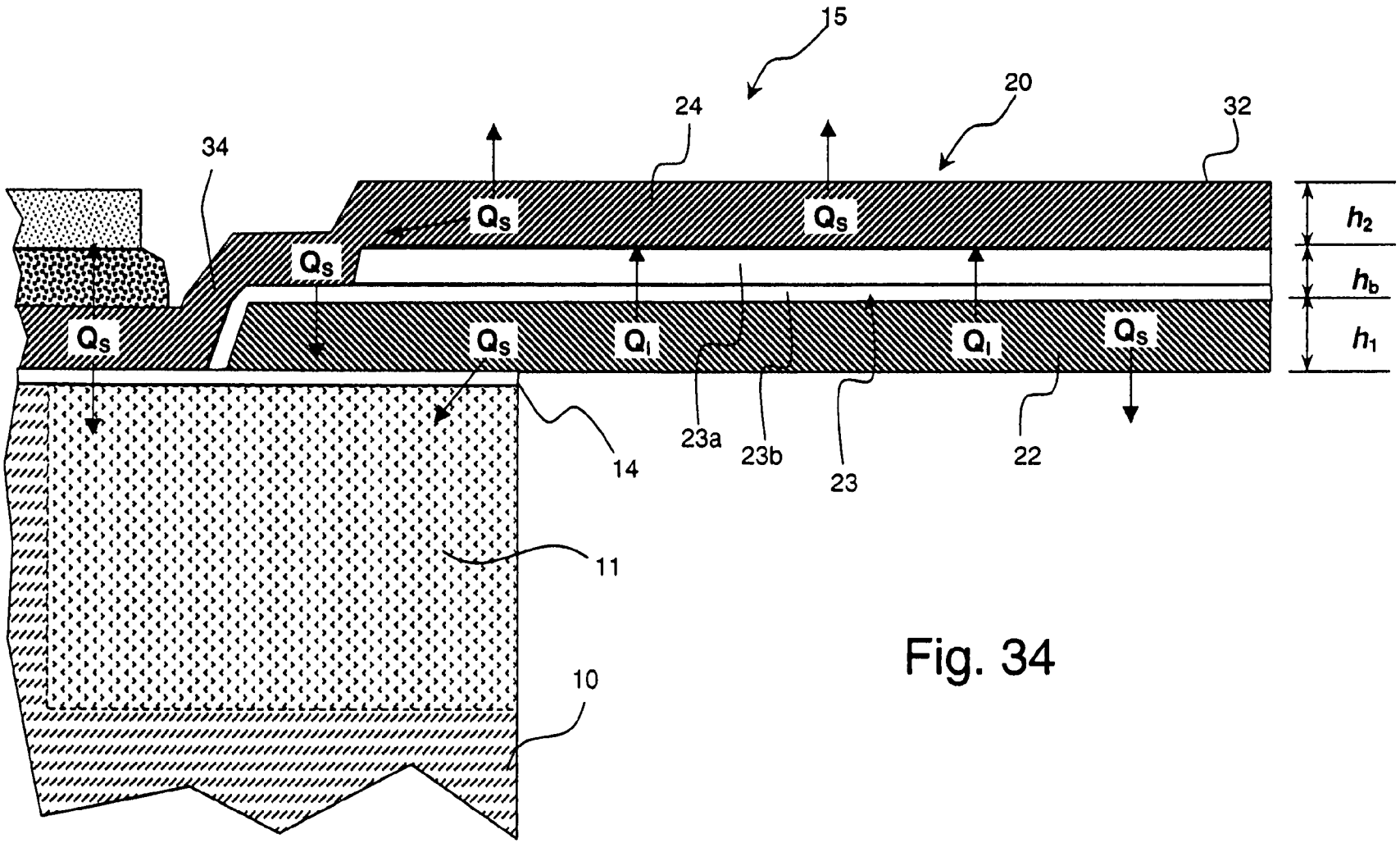
FIG. 34 is a side view illustrating heat flows within and out of a cantilevered element according to the present invention.

The flow of heat within cantilevered element 20 is a primary physical process underlying some of the present inventions. FIG. 34 illustrates heat flows by means of arrows designating internal heat flow, $Q_I$, and flow to the surroundings, $Q_S$. Cantilevered element 20 bends, deflecting free end 32, because first deflector layer 22 is made to elongate with respect to second deflector layer 24 by the addition of a heat pulse to first deflector layer 22, or vice versa. In general, thermal actuators of the cantilever configuration may be designed to have large differences in the coefficients of thermal expansion at a uniform operating temperature, to operate with a large temperature differential within the actuator, or some combination of both.

Embodiments of the present inventions which employ first and second deflector layers with an interposed thin thermal barrier layer are designed to utilize and maximize an internal temperature differential set up between the first deflector layer 22 and second deflector layer 24. Such structures will be termed tri-layer thermal actuators herein to distinguish them from bi-layer thermal actuators which employ only one elongating deflector layer and a second, low thermal expansion coefficient, layer. Bi-layer thermal actuators operate primarily on layer material differences rather than brief temperature differentials.

In preferred tri-layer embodiments, the first deflector layer 22 and second deflector layer 24 are constructed using materials having substantially equal coefficients of thermal expansion over the temperature range of operation of the thermal actuator. Therefore, maximum actuator deflection occurs when the maximum temperature difference between the first deflector layer 22 and second deflector layer 24 is achieved. Restoration of the actuator to a first or nominal position then will occur when the temperature equilibrates among first deflector layer 22, second deflector layer 24 and barrier layer 23. The temperature equilibration process is mediated by the characteristics of the barrier layer 23, primarily its thickness, Young's modulus, coefficient of thermal expansion and thermal conductivity.

The temperature equilibration process may be allowed to proceed passively or heat may be added to the cooler layer. For example, if first deflector layer 22 is heated first to cause a desired deflection, then second deflector layer 24 may be heated subsequently to bring the overall cantilevered element into thermal equilibrium more quickly. Depending on the application of the thermal actuator, it may be more desirable to restore the cantilevered element to the first position even though the resulting temperature at equilibrium will be higher and it will take longer for the thermal actuator to return to an initial starting temperature.

A cantilevered multi-layer structure comprised of k layers having different materials properties and thicknesses, generally assumes a parabolic arc shape at an elevated temperature. The deflection y(x,T) of the mechanical centerline of the cantilever, as a function of temperature above a base temperature, ΔT, and the distance x from the anchor edge 14, is proportional to the materials properties and thickness according to the following relationship:

$$y(x,T)=c\Delta Tx^2/2. \tag{60}$$

c ΔT is the thermal moment where c is a thermomechanical structure factor which captures the properties of the layers of the cantilever and is given by:

$$c=\frac{\dfrac{\displaystyle\sum_{k=1}^{N}\frac{E_k}{1-\sigma_k^2}\left(\frac{y_k^2-y_{k-1}^2}{2}\right)}{\displaystyle\sum_{k=1}^{N}\frac{E_k}{1-\sigma_k^2}(y_k-y_{k-1})}\displaystyle\sum_{k=1}^{2}\frac{E_k\alpha_k}{1-\sigma_k}(y_k-h_{k-1})-\displaystyle\sum_{k=1}^{N}\frac{E_k\alpha_k}{1-\sigma_k}\left(\frac{y_k^2-y_{k-1}^2}{2}\right)}{\left(\displaystyle\sum_{k=1}^{N}\frac{E_k}{1-\sigma_k^2}(y_k-y_{k-1})\right)\left(\displaystyle\sum_{k=1}^{N}\frac{E_k}{1-\sigma_k^2}\left(\frac{y_k^3-y_{k-1}^3}{3}\right)\right)-\dfrac{\left(\displaystyle\sum_{k=1}^{N}\frac{E_k}{1-\sigma_k^2}\left(\frac{y_k^2-y_{k-1}^2}{2}\right)\right)^2}{\displaystyle\sum_{k=1}^{N}\frac{E_k}{1-\sigma_k^2}(y_k-y_{k-1})}}, \tag{61}$$

where $y_0=0$, $$y_k=\sum_{j=1}^{k}h_j,$$

and $E_k$, $h_k$, $\sigma_k$ and $\alpha_k$ are the Young's modulus, thickness, Poisson's ratio and coefficient to thermal expansion, respectively, of the $k^{th}$ layer.

The present inventions of the tri-layer type are based on the formation of first and second heater resistor portions to heat first and second deflection layers, thereby setting up the temperature differences, ΔT, which give rise to cantilever bending. For the purposes of the present inventions, it is desirable that the second deflector layer 24 mechanically balance the first deflector layer 22 when internal thermal equilibrium is reached following a heat pulse which initially heats first deflector layer 22. Mechanical balance at thermal equilibrium is achieved by the design of the thickness and the materials properties of the layers of the cantilevered element, especially the coefficients of thermal expansion and Young's moduli. If any of the first deflector layer 22, barrier layer 23 or second deflector layer 24 are composed of sub-layer laminations, then the relevant properties are the effective values of the composite layer.

The present inventions may be understood by considering the conditions necessary for a zero net deflection, y(x,ΔT) =0, for any elevated, but uniform, temperature of the cantilevered element, ΔT≠0. From Equation 60 it is seen that this condition requires that the thermomechanical structure factor c=0. Any non-trivial combination of layer material properties and thicknesses which results in the thermomechanical structure factor c=0, Equation 61, will enable practice of the present inventions. That is, a cantilever design having c=0 can be activated by setting up temporal temperature gradients among layers, causing a temporal deflection of the cantilever. Then, as the layers of the cantilever approach a uniform temperature via thermal conduction, the cantilever will be restored to an undeflected position, because the equilibrium thermal expansion effects have been balanced by design.

For the case of a tri-layer cantilever, k=3 in Equation 61, and with the simplifying assumption that the Poisson's ratio is the same for all three material layers, the thermomechanical structure factor c can be shown to be proportional the following quantity:

$$c\propto\frac{1}{G}\left\{\begin{matrix}E_1(\alpha-\alpha_1)\left[\left(\frac{h_b}{2}\right)^2-\left(\frac{h_b}{2}+h_1\right)^2\right]+\\E_2(\alpha-\alpha_2)\left[\left(\frac{h_b}{2}+h_2\right)^2-\left(\frac{h_b}{2}\right)^2\right]\end{matrix}\right\}, \tag{62}$$

$$\text{where } \alpha=\frac{E_1\alpha_1h_1+E_b\alpha_bh_b+E_2\alpha_2h_2}{E_1h_1+E_bh_b+E_2h_2}. \tag{63}$$

The subscripts 1, b and 2 refer to the first deflector, barrier and second deflector layers, respectively. $E_k$, $\alpha_k$, and $h_k$ (k=1, b, or 2) are the Young's modulus, coefficient of thermal expansion and thickness, respectively, for the $k^{th}$ layer. The parameter G is a function of the elastic parameters and dimensions of the various layers and is always a positive quantity. Exploration of the parameter G is not needed for determining when the tri-layer beam could have a net zero deflection at an elevated temperature for the purpose of understanding the present inventions.

The quantities on the right hand side of Equation 62 capture critical effects of materials properties and thickness of the layers. The tri-layer cantilever will have a net zero deflection, y(x,ΔT)=0, for an elevated value of ΔT, if c=0. Examining Equation 62, the condition c=0 occurs when:

$$E_1(\alpha-\alpha_1)\left[\left(\frac{h_b}{2}\right)^2-\left(\frac{h_b}{2}+h_1\right)^2\right]=E_2(\alpha-\alpha_2)\left[\left(\frac{h_b}{2}\right)^2-\left(\frac{h_b}{2}+h_2\right)^2\right]. \tag{64}$$

For the special case when layer thickness, $h_1=h_2$ coefficients of thermal expansion, $\alpha_1=\alpha_2$, and Young's moduli, $E_1=E_2$, the quantity c is zero and there is zero net deflection, even at an elevated temperature, i.e. ΔT≠0.

It may be understood from Equation 64 that if the second deflector layer 24 material is the same as the first deflector layer 22 material, then the tri-layer structure will have a net zero deflection if the thickness $h_1$ of first deflector layer 22 is substantially equal to the thickness $h_2$ of second deflector layer 24.

It may also be understood from Equation 64 there are many other combinations of the parameters for the second deflector layer 24 and barrier layer 23 which may be selected to provide a net zero deflection for a given first deflector layer 22. For example, some variation in second deflector layer 24 thickness, Young's modulus, or both, may be used to compensate for different coefficients of thermal expansion between second deflector layer 24 and first deflector layer 22 materials.

All of the combinations of the layer parameters captured in Equations 61–64 that lead to a net zero deflection for a tri-layer or more complex multi-layer cantilevered structure, at an elevated temperature $\Delta T$, are anticipated by the inventors of the present inventions as viable embodiments of the present inventions.

Returning to FIG. 34, the internal heat flows $Q_I$ are driven by the temperature differential among layers. For the purpose of understanding the present inventions, heat flow from a first deflector layer 22 to a second deflector layer 24 may be viewed as a heating process for the second deflector layer 24 and a cooling process for the first deflector layer 22. Barrier layer 23 may be viewed as establishing a time constant, $\tau_B$, for heat transfer in both heating and cooling processes.

The time constant $\tau_B$ is approximately proportional to the thickness $h_b$ of the barrier layer 23 and inversely proportional to the thermal conductivity of the materials used to construct this layer. As noted previously, the heat pulse input to first deflector layer 22 must be shorter in duration than the heat transfer time constant, otherwise the potential temperature differential and deflection magnitude will be dissipated by excessive heat loss through the barrier layer 23.

A second heat flow ensemble, from the cantilevered element to the surroundings, is indicated by arrows marked $Q_S$. The details of the external heat flows will depend importantly on the application of the thermal actuator. Heat may flow from the actuator to substrate 10, or other adjacent structural elements, by conduction. If the actuator is operating in a liquid or gas, it will lose heat via convection and conduction to these fluids. Heat will also be lost via radiation. For purpose of understanding the present inventions, heat lost to the surrounding may be characterized as a single external cooling time constant $\tau_S$ which integrates the many processes and pathways that are operating.

Another timing parameter of importance is the desired repetition period, $\tau_C$, for operating the thermal actuator. For example, for a liquid drop emitter used in an ink jet printhead, the actuator repetion period establishes the drop firing frequency, which establishes the pixel writing rate that a jet can sustain. Since the heat transfer time constant $\tau_B$ governs the time required for the cantilevered element to restore to a first position, it is preferred that $\tau_B \ll \tau_C$ for energy efficiency and rapid operation. Uniformity in actuation performance from one pulse to the next will improve as the repetition period $\tau_C$ is chosen to be several units of $\tau_B$ or more. That is, if $\tau_C > 5\tau_B$ then the cantilevered element will have fully equilibrated and returned to the first or nominal position. If, instead $\tau_C < 2\tau_B$, then there will be some significant amount of residual deflection remaining when a next deflection is attempted. It is therefore desirable that $\tau_C > 2\tau_B$ and more preferably that $\tau_C > 4\tau_B$.

The time constant of heat transfer to the surround, $\tau_S$, may influence the actuator repetition period, $\tau_C$, as well. For an efficient design, $\tau_S$ will be significantly longer than $\tau_B$. Therefore, even after the cantilevered element has reached internal thermal equilibrium after a time of 3 to 5 $\tau_B$, the cantilevered element will be above the ambient temperature or starting temperature, until a time of 3 to 5 $\tau_S$. A new deflection may be initiated while the actuator is still above ambient temperature. However, to maintain a constant amount of mechanical actuation, higher and higher peak temperatures for the layers of the cantilevered element will be required. Repeated pulsing at periods $\tau_C < 3\tau_S$ will cause continuing rise in the maximum temperature of the actuator materials until some failure mode is reached.

A heat sink portion 11 of substrate 10 is illustrated in FIG. 34. When a semiconductor or metallic material such as silicon is used for substrate 10, the indicated heat sink portion 11 may be simply a region of the substrate 10 designated as a heat sinking location. Alternatively, a separate material may be included within substrate 10 to serve as an efficient sink for heat conducted away from the cantilevered element 20 at the anchor portion 34.

Figure 35:
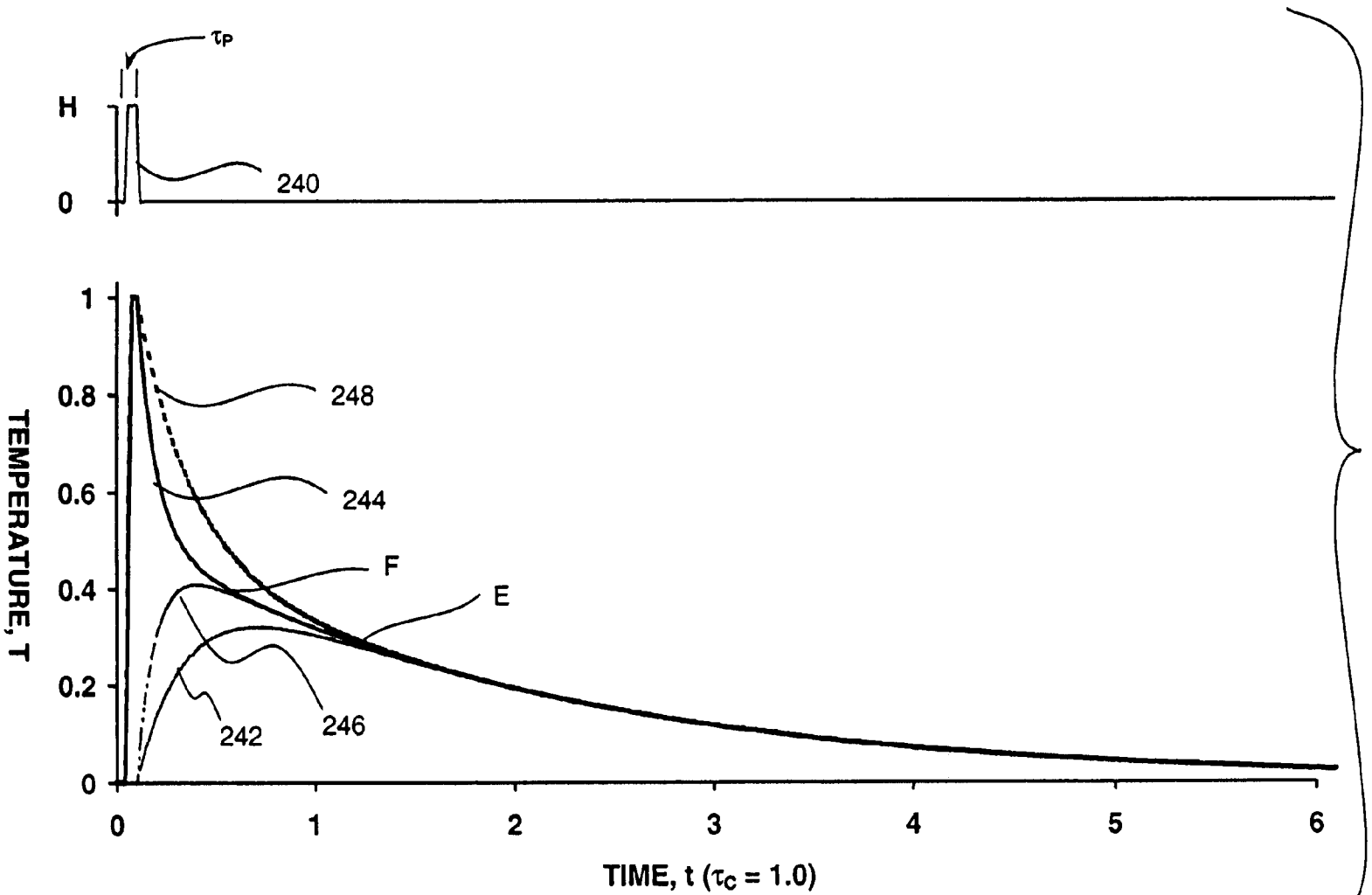
FIG. 35 is a plot of temperature versus time for first deflector and second deflector layers for two configurations of the barrier layer of a thermo-mechanical bender portion of a cantilevered element according to the present invention.

FIG. 35 illustrates the timing of heat transfers within the cantilevered element 20 and from the cantilevered 20 to the surrounding structures and materials. Temperature, T, is plotted on a scale normalized over the intended range of temperature excursion of the first deflector layer 22 above its steady state operating temperature. That is, T=1 in FIG. 35 is the maximum temperature reached by the first deflector layer after a heat pulse has been applied and T=0 in FIG. 35 is the base or steady state temperature of the cantilevered element. The time axis of FIG. 35 is plotted in units of $\tau_C$, the minimum time period for repeated actuations. Also illustrated in FIG. 35 is a single heating pulse 240 having a pulse duration time of $\tau_P$. Heating pulse 240 is applied to first deflector layer 22.

FIG. 35 shows four plots of temperature, T, versus time, t. Curves for the second deflector layer 24 and for the first deflector layer 22 are plotted for cantilevered element configurations having two different values of the heat transfer time constant $\tau_B$. A single value for the heat transfer time constant, $\tau_S$, was used for all four temperature curves. One-dimensional, exponential heating and cooling functions are assumed to generate the temperature versus time plots of FIG. 28.

In FIG. 35, curve 248 illustrates the temperature of the first deflector layer 22 and curve 242 illustrates the temperature of the second deflector layer 24 following a heat pulse applied to the first deflector layer 22. For curves 248 and 242, the barrier layer 23 heat transfer time constant is $\tau_B = 0.3\tau_C$ and the time constant for cooling to the surround, $\tau_S = 2.0\tau_C$. FIG. 35 shows the second deflector layer 24 temperature 242 rising as the first deflector layer 22 temperature 248 falls, until internal equilibrium is reached at the point denoted E. After point E, the temperature of both layers 22 and 24 continues to decline together at a rate governed by $\tau_S = 2.0\tau_C$. The amount of deflection of the cantilevered element is approximately proportional to the difference between first deflector layer temperature 248 and second deflector layer temperature 242. Hence, the cantilevered element will be restored from its deflected position to the first position at the time and temperature denoted as E in FIG. 35.

The second pair of temperature curves, 244 and 246, illustrate the first deflector layer temperature and second deflector layer temperature, respectively, for the case of a shorter barrier layer time constant, $\tau_B = 0.1\ \tau_C$. The surround cooling time constant for curves 244 and 246 is also $\tau_S$=2.0 $\tau_C$ as for curves 248 and 242. The point of internal thermal equilibrium within cantilevered element 20 is denoted F in FIG. 35. Hence, the cantilevered element will be restored from its deflection position to the first position at the time and temperature denoted as F in FIG. 35.

It may be understood from the illustrative temperature plots of FIG. 35 that it is advantageous that $\tau_B$ is small with respect to $\tau_C$ in order that the cantilevered element is restored to its first or nominal position before a next actuation is initiated. If a next actuation were initiated at time t=1.0 $\tau_C$, it can be understood from equilibrium points E and F that the cantilevered element would be fully restored to its first position when $\tau_B$=0.1 $\tau_C$. If $\tau_B$=0.3 $\tau_C$, however, it would be starting from a somewhat deflected position, indicated by the small temperature difference between curves 248 and 242 at time t=1.0 $\tau_C$.

FIG. 35 also illustrates that the cantilevered element 20 will be at an elevated temperature even after reaching internal thermal equilibrium and restoration of the deflection to the first position. The cantilevered element 20 will be elongated at this elevated temperature but not deflected due to a balance of forces between the first deflector layer 22 and second deflector layer 24. The cantilevered element may be actuated from this condition of internal thermal equilibrium at an elevated temperature. However, continued application of heat pulses and actuations from such elevated temperature conditions may cause failure modes to occur as various materials in the device or working environment begin to occur as peak temperature excursions also rise. Consequently, it is advantageous to reduce the time constant of heat transfer to the surround, $\tau_S$, as much as possible.

In operating the thermal actuators according to the present inventions, it is advantageous to select the electrical pulsing parameters with recognition of the heat transfer time constant, $\tau_B$, of the barrier layer 23. Once designed and fabricated, a thermal actuator having a cantilevered design according to the present inventions, will exhibit a characteristic time constant, $\tau_B$, for heat transfer between first deflector layer 22 and second deflector layer 24 through barrier layer 23. For efficient energy use and maximum deflection performance, heat pulse energy is applied over a time which is short compared to the internal energy transfer process characterized by $\tau_B$. Therefore it is preferable that applied heat energy or electrical pulses for electrically resistive heating have a duration of $\tau_P$, where $\tau_P<\tau_B$ and, preferably, $\tau_P<\frac{1}{2}\tau_B$.

The thermal actuators of the present invention allow for active deflection on the cantilevered element 20 in substantially opposing motions and displacements. By applying an electrical pulse to heat the first deflector layer 22, the cantilevered element 20 deflects in a direction away from first deflector layer 22 (see FIGS. 4*b* and 14*b*). By applying an electrical pulse to heat the second deflector layer 24, the cantilevered element 20 deflects in a direction away from the second deflector layer 24 and towards the first deflector layer 22 (see FIGS. 4*c* and 15*b*). The thermo-mechanical forces that cause the cantilevered element 20 to deflect become balanced if internal thermal equilibrium is then allowed to occur via internal heat transfer, for cantilevered elements 20 designed to satisfy above Equation 64, that is, when the thermomechanical structure factor c=0.

In addition to the passive internal heat transfer and external cooling processes, the cantilevered element 20 also responds to passive internal mechanical forces arising from the compression or tensioning of the unheated layer materials. For example, if the first deflector layer 22 is heated causing the cantilevered element 20 to bend, the barrier layer 23 and second deflector layer 24 are mechanically compressed. The mechanical energy stored in the compressed materials leads to an opposing spring force which counters the bending, hence counters the deflection. Following a thermo-mechanical impulse caused by suddenly heating one of the deflector layers, the cantilevered element 20 will move in an oscillatory fashion until the stored mechanical energy is dissipated, in addition to the thermal relaxation processes previously discussed.

Figure 36:
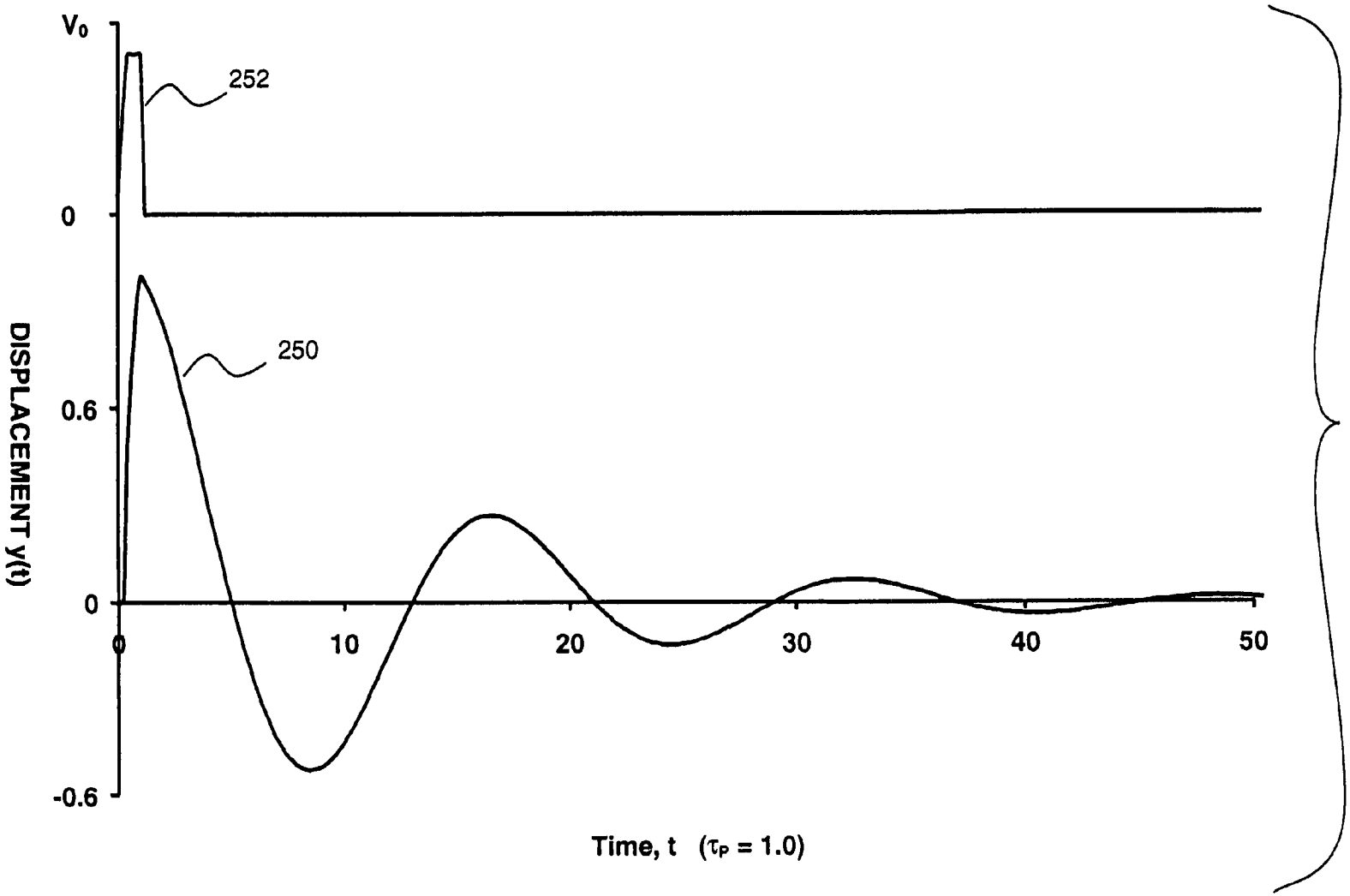
FIG. 36 is an illustration of damped resonant oscillatory motion of a cantilevered beam subjected to a deflection impulse.

FIG. 36 illustrates the damped oscillatory behavior of a cantilevered element. Plot 250 shows the displacement of the free end tip 32 of a cantilevered element as a function of time. Plot 252 shows the electrical pulse which generates the initial thermo-mechanical impulse force that starts the damped oscillatory displacement. The time duration of the electrical pulse, $\tau_{P1}$, is assumed to be less than one-half the internal heat transfer time constant $\tau_B$, discussed previously. The time axis in FIG. 36 is plotted in units of $\tau_{P1}$. Plot 250 of cantilevered element free end displacement illustrates a case wherein the resonant period of oscillation $\tau_R$~16 $\tau_{P1}$, and the damping time constant $\tau_D$~8 $\tau_{P1}$. It may be understood from FIG. 36 that the resultant motion of a cantilevered element 20, which is subjected to thermo-mechanical impulses via both the first and second deflector layers 22 and 24 will be a combination of both the actively applied thermo-mechanical forces as well as the internal thermal and mechanical effects.

A desirable predetermined displacement versus time profile may be constructed utilizing the parameters of applied electrical pulses, especially the energies and time duration's, the waiting time $\tau_{W1}$ between applied pulses, and the order in which first and second deflector layers are addressed. The damped resonant oscillatory motion of a cantilevered element 20, as illustrated in FIG. 36, generates displacements on both sides of a quiescent or first position in response to a single thermo-mechanical impulse. A second, opposing, thermo-mechanical impulse may be timed, using $\tau_{W1}$, to amplify, or to further dampen, the oscillation begun by the first impulse.

Figure 37:
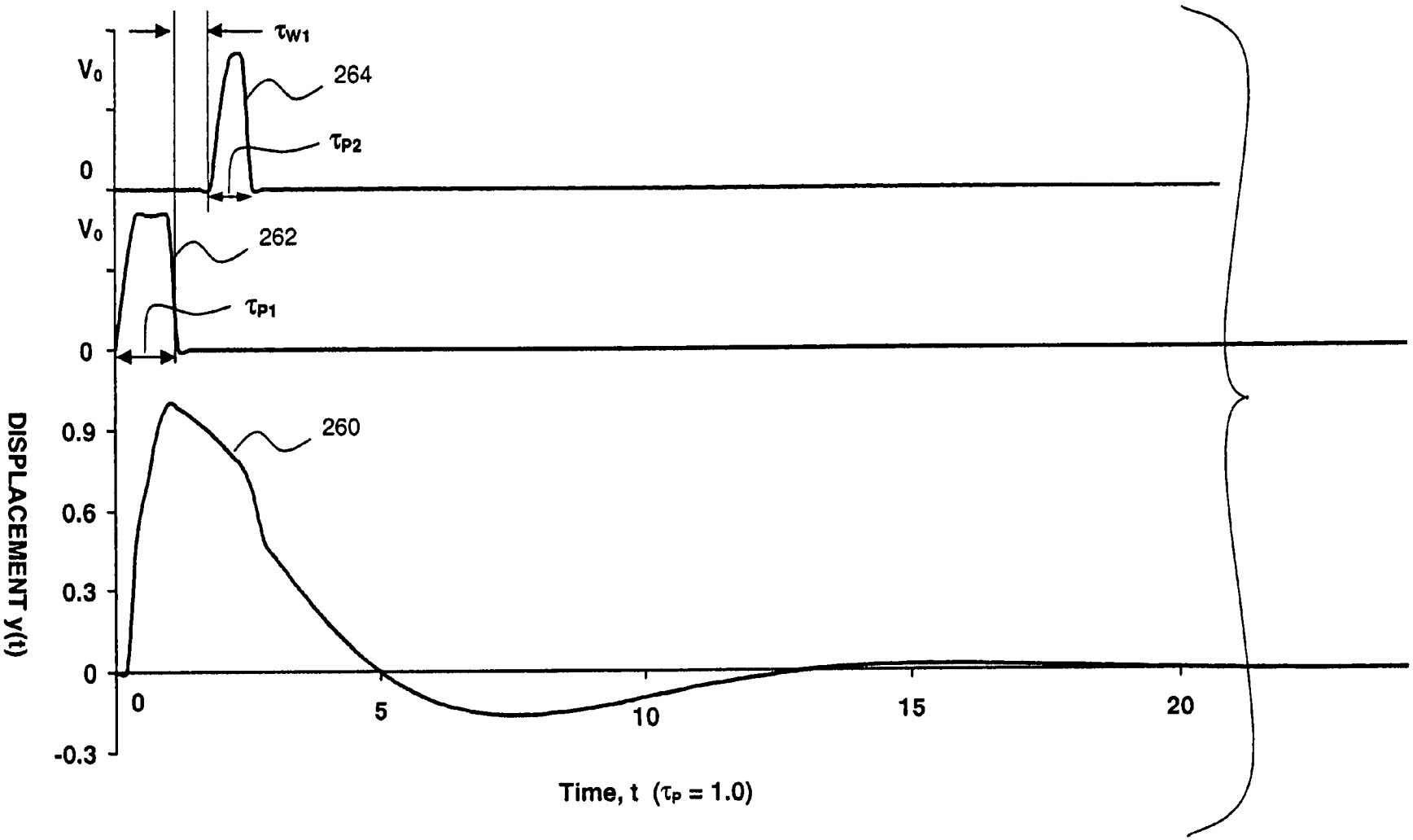
FIG. 37 is an illustration of some alternate applications of electrical pulses to affect the displacement versus time of a thermal actuator according to the present invention.

An activation sequence which serves to promote more rapid dampening and restoration to the first position is illustrated by plots 260, 262 and 264 in FIG. 37. The same characteristics $\tau_B$, $\tau_R$, and $\tau_D$ of the cantilevered element 20 used to plot the damped oscillatory motion shown in FIG. 36 are used in FIG. 37 as well. Plot 260 indicates the cantilevered element deflecting rapidly in response to an electrical pulse applied to the pair of electrodes attached to the first heater resistor 26 of the first deflector layer 22. This first electrical pulse is illustrated as plot 262. The pulse duration $\tau_{P1}$ is the same as was used in FIG. 36 and the time axis of the plots in FIG. 37 are in units of $\tau_{P1}$. The initial deflection of cantilevered element 20 illustrated by plot 260 is therefore the same as for plot 250 in FIG. 36.

After a short waiting time, $\tau_{W1}$, a second electrical pulse is applied to the pair of electrodes attached to the second heater resistor 27 of the second deflector layer 22, as illustrated by plot 264 in FIG. 37. The energy of this second electrical pulse is chosen so as to heat the second deflector layer 24 and raise its temperature to nearly that of the first deflector layer 22 at that point in time. In the illustration of FIG. 37, the second electrical pulse 264 is shown as having the same amplitude as the first electrical pulse 262, but has a shorter time duration, $\tau_{P2}<\tau_{P1}$. Heating the second deflector layer in this fashion elongates the second deflector layer, releasing the compressive stored energy and balancing the forces causing the cantilevered element 20 to bend. Hence, the second electrical pulse applied to second deflector layer 24 has the effect of quickly damping the oscillation of the cantilevered element 20 and restoring it to the first position.

Applying a second electrical pulse for the purpose of more quickly restoring the cantilevered element 20 to the first position has the drawback of adding more heat energy overall to the cantilevered element. While restored in terms of deflection, the cantilevered element will be at an even higher temperature. More time may be required for it to cool back to an initial starting temperature from which to initiate another actuation. Active restoration using a second actuation may be valuable for applications of thermal actuators wherein minimization of the duration of the initial cantilevered element deflection is important. For example, when used to activate liquid drop emitters, actively restoring the cantilevered element to a first position may be used to hasten the drop break off process, thereby producing a smaller drop than if active restoration was not used. By initiating the retreat of cantilevered element 20 at different times (by changing the waiting time $\tau_{W1}$) different drop sizes may be produced.

Figure 38:
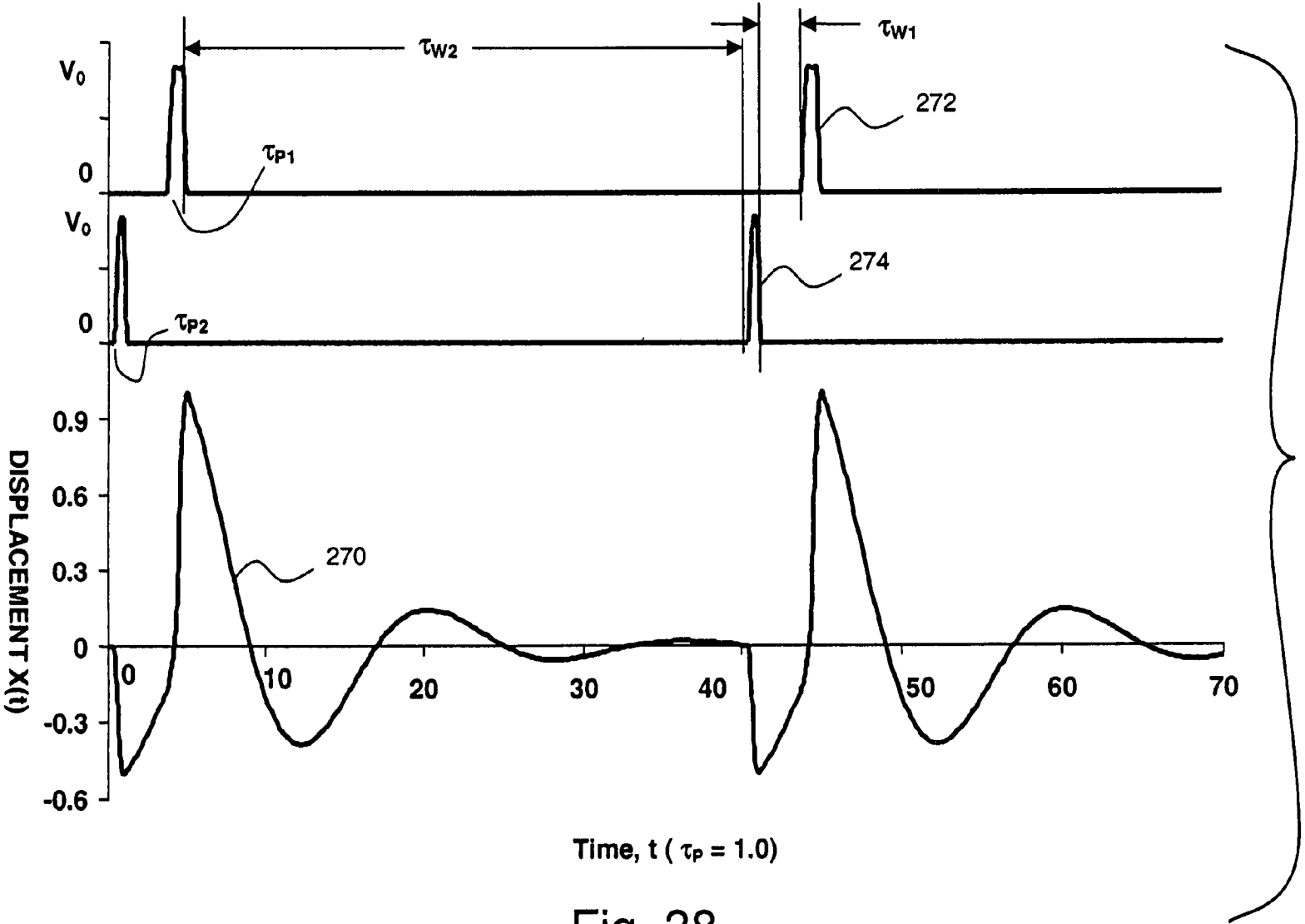
FIG. 38 is an illustration of some alternate applications of electrical pulses to affect the characteristics of drop emission according to the present invention.

An activation sequence that serves to alter liquid drop emission characteristics by pre-setting the conditions of the liquid and liquid meniscus in the vicinity of the nozzle 30 of a liquid drop emitter is illustrated in FIG. 38. The conditions produced in the nozzle region of the liquid drop emitter are further illustrated in FIGS. 39*a*–39*c*. Plot 270 illustrates the deflection versus time of the cantilevered element free end tip 32, plot 272 illustrates an electrical pulse sequence applied to the first pair of electrodes addressing the first heater resistor 26 formed in the first deflector layer 22 and plot 274 illustrates an electrical pulse sequence applied to the second pair of electrodes attached to the second heater resistor 27 formed in the second deflector layer 24. The same cantilevered element characteristics $\tau_B$, $\tau_R$, and $\tau_D$ are assumed for FIG. 38 as for previously discussed FIGS. 36 and 37. The time axis is plotted in units of $\tau_{P1}$.

Figure 39A:
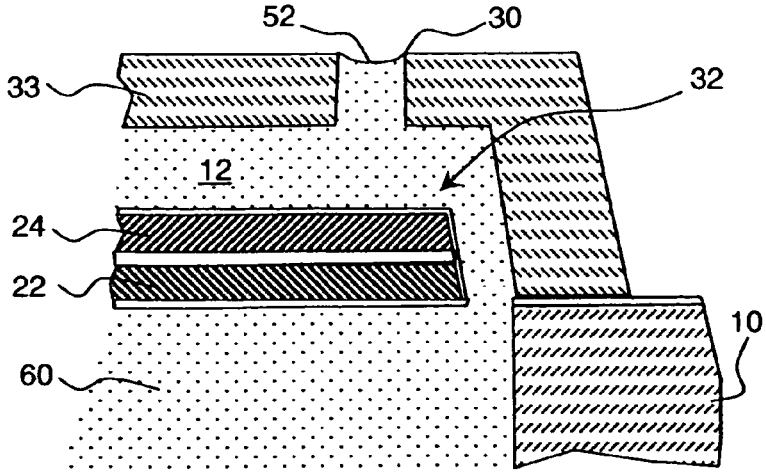
FIGS. 39(*a*)–39(*c*) are side views illustrating the application of an electrical pulse to the second pair and then to the first pair of electrodes to cause drop emission according to the present inventions.
Figure 39B:
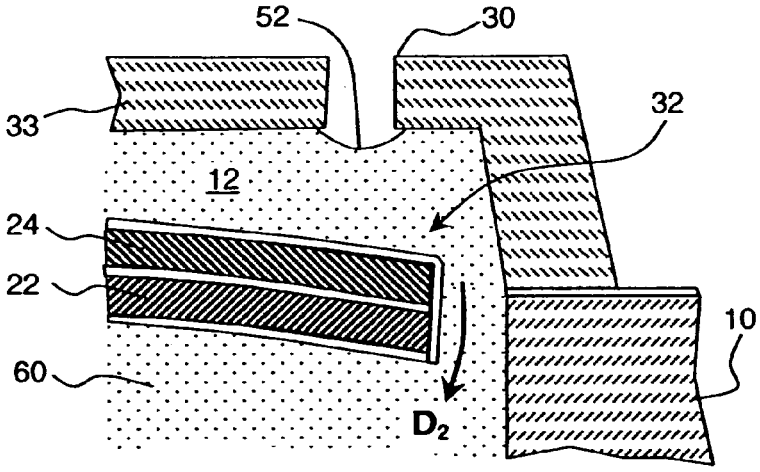
Figure 39C:
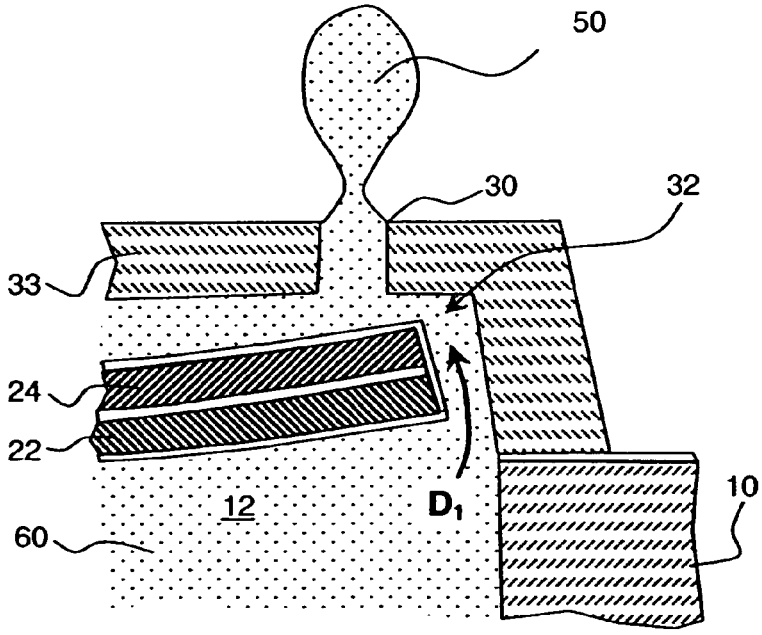

From a quiescent first position, the cantilevered element is first deflected an amount $D_2$ away from nozzle 30 by applying an electrical pulse to the second deflector layer 24 (see FIGS. 39*a* and 39*b*). This has the effect of reducing the liquid pressure at the nozzle and caused the meniscus to retreat within the nozzle 30 bore toward the liquid chamber 12. Then, after a selected waiting time $\tau_{W1}$, the cantilevered element is deflected an amount $D_1$ toward the nozzle to cause drop ejection. If the waiting time $\tau_{W1}$ is chosen to so that the resonant motion of the cantilever element 20 caused by the initial thermo-mechanical impulse is toward the nozzle, then the second thermo-mechanical impulse will amplify this motion and a strong positive pressure impulse will cause drop formation.

By changing the magnitude of the initial negative pressure excursion caused by the first actuation or by varying the timing of the second actuation with respect to the excited resonant oscillation of the cantilevered element 20, drops of differing volume and velocity may be produced. The formation of satellite drops may also be affected by the prepositioning of the meniscus in the nozzle and by the timing of the positive pressure impulse.

Plots 270, 272, and 274 in FIG. 38 also show a second set of actuations to generate a second liquid drop emission after waiting a second wait time $\tau_{W2}$. This second wait time, $\tau_{W2}$, is selected to account for the time required for the cantilevered element 20 to have restored to its first or nominal position before a next actuation pulse is applied. The second wait time $\tau_{W2}$, together with the pulse times $\tau_{P1}$, $\tau_{P2}$, and inter-pulse wait time $\tau_{W1}$, establish the practical repetition time $\tau_C$ for repeating the process of liquid drop emission. The maximum drop repetition frequency, $f=1/\tau_C$, is an important system performance attribute. It is preferred that the second wait time $\tau_{W2}$ be much longer than the internal heat transfer time constant $\tau_B$. Most preferably, it is most preferred that $\tau_{W2}>3\tau_B$ for efficient and reproducible activation of the thermal actuators and liquid drop emitters of the present invention.

The parameters of electrical pulses applied to the dual thermo-mechanical actuation means of the present inventions, the order of actuations, and the timing of actuations with respect to the thermal actuator physical characteristics, such as the heat transfer time constant $\tau_B$ and the resonant oscillation period $\tau_R$, provide a rich set of tools to design desirable predetermined displacement versus time profiles. The dual actuation capability of the thermal actuators of the present inventions allows modification of the displacement versus time profile to be managed by an electronic control system. This capability may be used to make adjustments in the actuator displacement profiles for the purpose of maintaining nominal performance in the face of varying application data, varying environmental factors, varying working liquids or loads, or the like. This capability also has significant value in creating a plurality of discrete actuation profiles that cause a plurality of predetermined effects, such as the generation of several predetermined drop volumes for creating gray level printing.

Figure 40A:
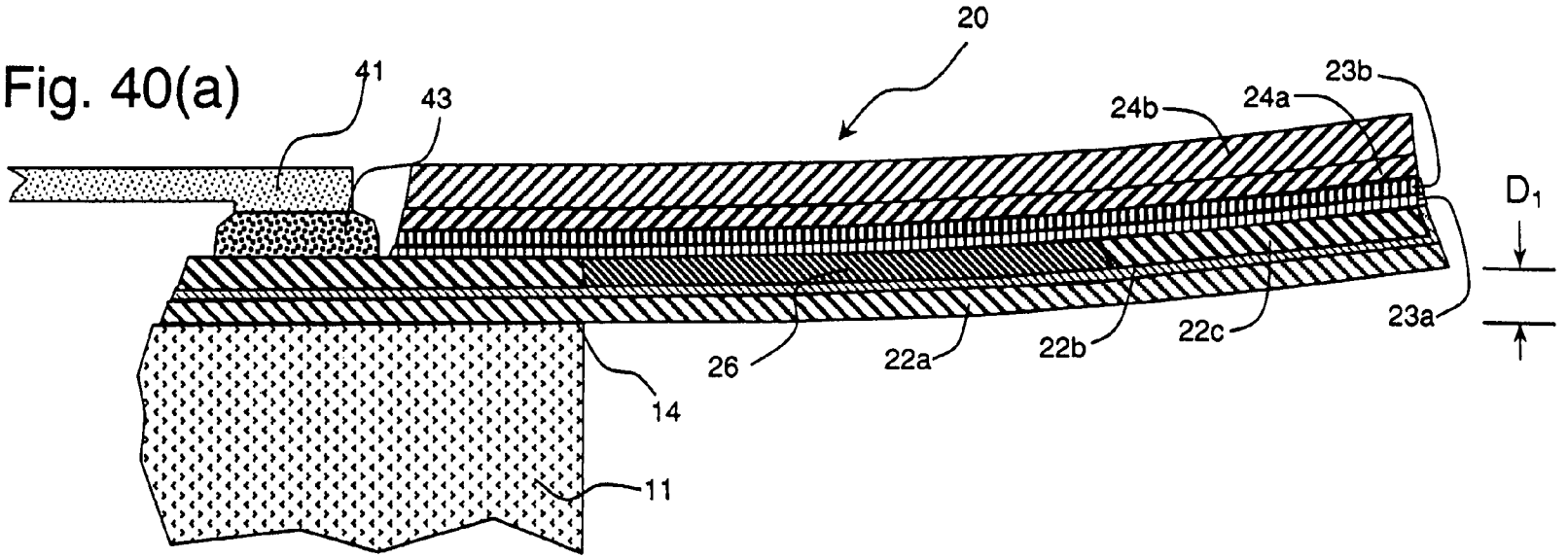
FIGS. 40(*a*) and 40(*b*) are side views illustrating multilayer laminate constructions according to the present inventions.
Figure 40B:
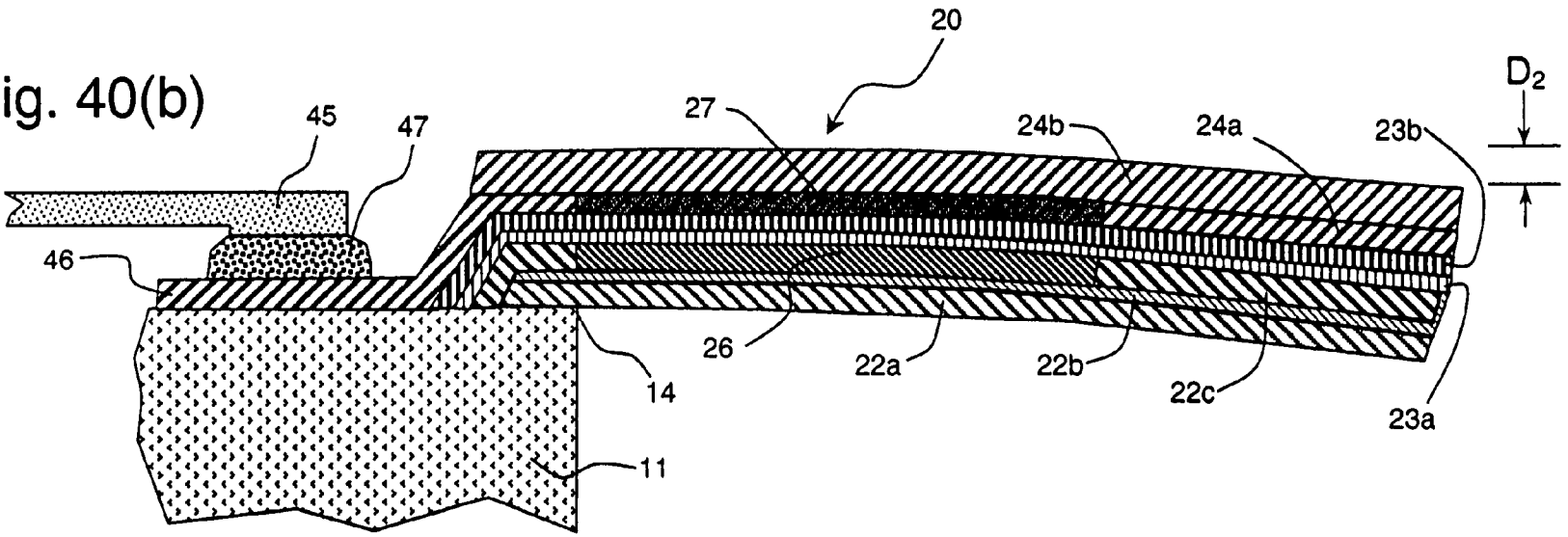

Most of the foregoing analysis has been presented in terms of a tri-layer cantilevered element which includes first and second deflector layers 22, 24 and a barrier layer 23 controlling heat transfer between deflector layers. One or more of the three layers thus described may be formed as laminates composed of sub-layers. Such a construction is illustrated in FIGS. 40*a* and 40*b*. The cantilevered elements of FIGS. 40*a* and 40*b* are constructed of a first deflector layer 22 having three sub-layers 22*a*, 22*b*, and 22*c*; barrier layer 23 having sub layers 23*a* and 23*b*; and second deflector layer 24 having two sub-layers 24*a* and 24*b*. The structure illustrated in FIG. 40*a* has only one actuator, first heater resistor 26. It is illustrated in a upward deflected position, $D_1$. The second deflector layer 24 in FIG. 40*a* acts as a passive restorer layer.

In FIG. 40*b*, both first and second deflector layers 22 and 24 are patterned with first and second heater resistors 26 and 27 respectively. It is illustrated in a downward deflected position, $D_2$ as a result of activating the second deflector layer. The structure of FIG. 40*b* may be activated either up or down by electrically pulsing the first and second uniform resister portions appropriately. The use of multiple sub-layers to form the first or second deflector layer or the barrier layer may be advantageous for a variety of fabrication considerations as well as a means to adjust the thermo-mechanical structure factor to produce the c=0 condition desirable for the operation of the present inventions.

While much of the foregoing description was directed to the configuration and operation of a single drop emitter, it should be understood that the present invention is applicable to forming arrays and assemblies of multiple drop emitter units. Also it should be understood that thermal actuator devices according to the present invention may be fabricated concurrently with other electronic components and circuits, or formed on the same substrate before or after the fabrication of electronic components and circuits.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST 10 substrate base element
11 heat sink portion of substrate 10
12 liquid chamber
13 gap between cantilevered element and chamber wall
14 cantilevered element anchor location at base element or wall edge
15 thermal actuator
16 liquid chamber curved wall portion
18 location of free end width of the thermo-mechanical bender portion
20 cantilevered element
21 passivation layer
22 first deflector layer
22a first deflector layer sub-layer
22b first deflector layer sub-layer
22c first deflector layer sub-layer
23 barrier layer
23a barrier layer sub-layer
23b barrier layer sub-layer
24 second deflector layer
24a second deflector layer sub-layer
24b second deflector layer sub-layer
25 thermo-mechanical bender portion of the cantilevered element
26 first heater resistor formed in the first deflector layer
27 second heater resistor formed in the second deflector layer
28 base end of the thermo-mechanical bender portion
29 free end of the thermo-mechanical bender portion
30 nozzle
31 sacrificial layer
32 free end tip of cantilevered element
33 liquid chamber cover
34 anchored end of cantilevered element
35 spatial thermal pattern
36 first spatial thermal pattern
37 second spatial thermal pattern
38 passivation overlayer
39 clearance areas
41 TAB lead attached to electrode 44
42 electrode of first electrode pair
43 solder bump on electrode 44
44 electrode of first electrode pair
45 TAB lead attached to electrode 46
46 electrode of second electrode pair
47 solder bump on electrode 46
48 electrode of second electrode pair
49 thermal pathway leads
50 drop
52 liquid meniscus at nozzle 30
60 fluid
62 thermo-mechanical bender portion with monotonic width reduction
63 trapezoidal shaped thermo-mechanical bender portion
64 thermo-mechanical bender portion with supralinear width reduction
65 thermo-mechanical bender portion with stepped width reduction
66 heater resistor segments
67 current shunts
68 current coupling device
69 thin film heater resistor
71 first patterned current shunt layer
72 second patterned current shunt layer
73 monotonically declining spatial thermal pattern
74 step declining spatial thermal pattern
75 current shunt areas formed in first deflector layer 22
76 thin film heater resistor layer
77 current shunt areas formed in thin film heater resistor layer 76
80 mounting support structure
90 nominal case rectangular thermo-mechanical bender portion
92 inverse power law reduction shape thermo-mechanical bender portion
93 inverse power law reduction shape thermo-mechanical bender portion -continued

PARTS LIST 94 inverse power law reduction shape thermo-mechanical bender portion
97 quadratic reduction shape thermo-mechanical bender portion
98 quadratic reduction shape thermo-mechanical bender portion
100 ink jet printhead
110 drop emitter unit
200 electrical pulse source
300 controller
400 image data source
500 receiver

What is claimed is:

1. A thermal actuator for a micro-electromechanical device comprising:

(a) a base element;

(b) a cantilevered element including a thermo-mechanical bender portion extending from the base element to a free end tip residing at a first position, the thermo-mechanical bender portion including the cantilevered element including a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers; the thermo-mechanical bender portion further having a base end and base end width, $w_b$, adjacent the base element, and a free end and free end width, $w_f$, adjacent the free end tip, wherein the base end width is substantially greater than the free end width;

(c) a first heater resistor formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end;

(d) a second heater resistor formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end;

(e) a first pair of electrodes connected to the first heater resistor to apply an electrical pulse to cause resistive heating of the first deflector layer, resulting in a thermal expansion of the first deflector layer relative to the second deflector layer; and (f) a second pair of electrodes connected to the second heater resistor portion to apply an electrical pulse to cause resistive heating of the second deflector layer, resulting in a thermal expansion of the second deflector layer relative to the first deflector layer, wherein application of an electrical pulse to either the first pair or the second pair of electrodes causes deflection of the cantilevered element away from the first position to a second position, followed by restoration of the cantilevered element to the first position as heat diffuses through the barrier layer and the cantilevered element reaches a uniform temperature.

2. The thermal actuator of claim 1 wherein the first and second electrically resistive materials are the same material and the first and second deflector layers are substantially equal in thickness.

3. The thermal actuator of claim 1 wherein the first and second electrically resistive materials are titanium aluminide.

4. The thermal actuator of claim 1 wherein the width of the thermo-mechanical bender portion reduces from the base end width to the free end width in a substantially monotonic function of the distance from the base element.

5. The thermal actuator of claim 1 wherein the width of the thermo-mechanical bender portion reduces from the base end width to the free end width in at least one width reduction step.

6. The thermal actuator of claim 5 wherein the thermo-mechanical bending portion has a length L and the at least one reduction step occurs at a distance $L_s$ from the base element, wherein $0.3\ L \leqq L_s \leqq 0.84\ L$.

7. The thermal actuator of claim 6 wherein the first spatial thermal pattern results in the temperature increase of the first deflector layer of the thermo-mechanical bender portion reducing from $\Delta T_{1b}$ to $\Delta T_{1f}$ in at least one temperature reduction step located at $L_s$.

8. The thermal actuator of claim 6 wherein the second spatial thermal pattern results in the temperature increase of the second deflector layer of the thermo-mechanical bender portion reducing from $\Delta T_{2b}$ to $\Delta T_{2f}$ in at least one temperature reduction step located at $L_s$.

9. The thermal actuator of claim 1 wherein the first spatial thermal pattern results in the temperature increase of the first deflector layer of the thermo-mechanical bender portion reducing monotonically from $\Delta T_{1b}$ to $\Delta T_{1f}$ as a function of the distance from the base element.

10. The thermal actuator of claim 1 wherein the second spatial thermal pattern results in the temperature increase of the second layer of the thermo-mechanical bender portion reducing monotonically from $\Delta T_{2b}$ to $\Delta T_{2f}$ as a function of the distance from the base element.

11. The thermal actuator of claim 1 wherein the first spatial thermal pattern results in the temperature increase of the first deflector layer of the thermo-mechanical bender portion reducing from $\Delta T_{1b}$ to $\Delta T_{1f}$ in at least one temperature reduction step.

12. The thermal actuator of claim 1 wherein the second spatial thermal pattern results in the temperature increase of the second layer of the thermo-mechanical bender portion reducing from $\Delta T_{1b}$ to $\Delta T_{2f}$ in at least one temperature reduction step.

13. The thermal actuator of claim 1 further comprising a first conductor layer constructed of a first electrically conductive material adjacent the first deflector layer wherein the first spatial thermal pattern results in part from patterning the first conductor layer in a first current shunt pattern.

14. The thermal actuator of claim 1 further comprising a second conductor layer constructed of a second electrically conductive material adjacent the second deflector layer wherein the second spatial thermal pattern results in part from patterning the second conductor layer in a second current shunt pattern.

15. A method for operating a thermal actuator, said thermal actuator comprising a base element; a cantilevered element including a thermo-mechanical bender portion extending from the base element to a free end tip residing at a first position, the thermo-mechanical bender portion including the cantilevered element including a barrier layer having a heat transfer time constant $\tau_B$, constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers; the thermo-mechanical bender portion further having a base end and base end width, $w_b$, adjacent the base element, and a free end and free end width, $w_f$, adjacent the free end tip, wherein the base end width is substantially greater than the free end width; a first heater resistor formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end; a second heater resistor formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end; a first pair of electrodes connected to the first heater resistor to apply an electrical pulse to cause resistive heating of the first deflector layer, resulting in a thermal expansion of the first deflector layer relative to the second deflector layer; a second pair of electrodes connected to the second heater resistor portion to apply an electrical pulse to cause resistive heating of the second deflector layer, the method for operating comprising:

(a) applying to the first pair of electrodes a first electrical pulse which provides sufficient heat energy to cause a first deflection of the cantilevered element;

(b) waiting for a time $\tau_{W1}$; and (c) applying to the second pair of electrodes a second electrical pulse which provides sufficient heat energy to cause a second deflection of the cantilevered element; wherein the time $\tau_{W1}$ is selected to achieve a predetermined resultant of the first and second deflections.

16. The method of claim 15 wherein the first electrical pulse has a time duration of $\tau_{P1}$, where $\tau_{P1} < \frac{1}{2}\tau_B$, and the second electrical pulse has a time duration of $\tau_{P2}$, where $\tau_{P2} < \frac{1}{2}\tau_B$.

17. The method of claim 15 wherein the time $\tau_{W1}$ is selected so that the second deflection acts to restore the cantilevered element to the first position.

18. The method of claim 15 wherein the time $\tau_{W1}$ is selected so that the second deflection acts to increase a residual velocity of the cantilevered element resulting from the first deflection.

19. A liquid drop emitter comprising:

(a) a chamber, formed in a substrate, filled with a liquid and having a nozzle for emitting drops of the liquid;

(b) a thermal actuator having a cantilevered element including a thermo-mechanical bender portion extending from a wall of the chamber and a free end tip residing in a first position proximate to the nozzle, the thermo-mechanical bender portion including a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the bamer layer is bonded between the first and second deflector layers; the thermo-mechanical bender portion further having a base end and base end width, $w_b$, adjacent the base element, and a free end and free end width, $w_f$, adjacent the free end tip, wherein the base end width is substantially greater than the free end width;

(c) a first heater resistor formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end;

(d) a second heater resistor formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end;

(e) a first pair of electrodes connected to the first heater resistor to apply an electrical pulse to cause resistive heating of the first deflector layer, resulting in a thermal expansion of the first deflector layer relative to the second deflector layer; and (f) a second pair of electrodes connected to the second heater resistor portion to apply an electrical pulse to cause resistive heating of the second deflector layer, resulting in a thermal expansion of the second deflector layer relative to the first deflector layer, wherein application of electrical pulses to the first and second pairs of electrodes causes rapid deflection of the cantilevered element, ejecting liquid at the nozzle, followed by restoration of the cantilevered element to the first position as heat diffuses through the barrier layer and the cantilevered element reaches a uniform temperature.

20. The liquid drop emitter of claim 19 wherein the liquid drop emitter is a drop-on-demand ink jet printhead and the liquid is an ink for printing image data.

21. The liquid drop emitter of claim 20 further comprising a second conductor layer constructed of a second electrically conductive material adjacent the second deflector layer wherein the second spatial thermal pattern results in part from patterning the second conductor layer in a second current shunt pattern.

22. The liquid drop emitter of claim 19 wherein the first and second electrically resistive materials are the same material and the first and second deflector layers are substantially equal in thickness.

23. The liquid drop emitter of claim 19 wherein the first and second electrically resistive materials are titanium aluminide.

24. The liquid drop emitter of claim 19 wherein the width of the thermo-mechanical bender portion reduces from the base end width to the free end width in a substantially monotonic function of the distance from the base element.

25. The liquid drop emitter of claim 19 wherein the width of the thermo-mechanical bender portion reduces from the base end width to the free end width in at least one width reduction step.

26. The liquid drop emitter of claim 25 wherein the thermo-mechanical bending portion has a length L and the at least one reduction step occurs at a distance $L_s$ from the base element, wherein $0.3\ L \leqq L_s \leqq 0.84\ L$.

27. The liquid drop emitter of claim 26 wherein the first spatial thermal pattern results in the temperature increase of the first deflector layer of the thermo-mechanical bender portion reducing from $\Delta T_{1b}$ to $\Delta T_{1f}$ in at least one temperature reduction step located at $L_s$.

28. The liquid drop emitter of claim 26 wherein the second spatial thermal pattern results in the temperature increase of the second deflector layer of the thermo-mechanical bender portion reducing from $\Delta T_{2b}$ to $\Delta T_{2f}$ in at least one temperature reduction step located at $L_s$.

29. The liquid drop emitter of claim 19 wherein the first spatial thermal pattern results in the temperature increase of the first deflector layer of the thermo-mechanical bender portion reducing monotonically from $\Delta T_{1b}$ to $\Delta T_{1f}$ as a function of the distance from the base element.

30. The liquid drop emitter of claim 19 wherein the second spatial thermal pattern results in the temperature increase of the second layer of the thermo-mechanical bender portion reducing monotonically from $\Delta T_{2b}$ to $\Delta T_{2f}$ as a function of the distance from the base element.

31. The liquid drop emitter of claim 19 wherein the first spatial thermal pattern results in the temperature increase of the first deflector layer of the thermo-mechanical bender portion reducing from $\Delta T_{1b}$ to $\Delta T_{1f}$ in at least one temperature reduction step.

32. The liquid drop emitter of claim 19 wherein the second spatial thermal pattern results in the temperature increase of the second layer of the thermo-mechanical bender portion reducing from $\Delta T_{2b}$ to $\Delta T_{2f}$ in at least one temperature reduction step.

33. The liquid drop emitter of claim 19 further comprising a first conductor layer constructed of a first electrically conductive material adjacent the first deflector layer wherein the first spatial thermal pattern results in part from patterning the first conductor layer in a first current shunt pattern.

34. A method for operating a liquid drop emitter, said liquid drop emitter comprising a chamber, formed in a substrate, filled with a liquid and having a nozzle for emitting drops of the liquid; a cantilevered element including a thermo-mechanical bender portion extending from a wall of the chamber and a free end tip residing in a first position proximate to the nozzle, the thermo-comprising a base element; a cantilevered element including a thermo-mechanical bender portion extending from the base element to a free end tip residing at a first position, the thermo-mechanical bender portion including the cantilevered element including a barrier layer having a heat transfer time constant $\tau_B$, constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion wherein the barrier layer is bonded between the first and second deflector layers; the thermo-mechanical bender portion further having a base end and base end width, $w_b$, adjacent the base element, and a free end and free end width, $w_f$, adjacent the free end tip, wherein the base end width is substantially greater than the free end width; a first heater resistor formed in the first deflector layer and adapted to apply heat energy having a first spatial thermal pattern which results in a first deflector layer base end temperature increase, $\Delta T_{1b}$, in the first deflector layer at the base end that is greater than a first deflector layer free end temperature increase, $\Delta T_{1f}$, in the first deflector layer at the free end; a second heater resistor formed in the second deflector layer and adapted to apply heat energy having a second spatial thermal pattern which results in a second deflector layer base end temperature increase, $\Delta T_{2b}$, in the second deflector layer at the base end that is greater than a second deflector layer free end temperature increase, $\Delta T_{2f}$, in the second deflector layer at the free end; a first pair of electrodes connected to the first heater resistor to apply an electrical pulse to cause resistive heating of the first deflector layer, resulting in a thermal expansion of the first deflector layer relative to the second deflector layer; a second pair of electrodes connected to the second heater resistor portion to apply an electrical pulse to cause resistive heating of the second deflector layer, the method for operating comprising:

(a) applying to the first pair of electrodes a first electrical pulse which provides sufficient heat energy to cause a first deflection of the cantilevered element;

(b) waiting for a time $\tau_{W1}$; and (c) applying to the second pair of electrodes a second electrical pulse which provides sufficient heat energy to cause a second deflection of the cantilevered element; wherein the time $\tau_{W1}$ is selected to achieve a predetermined motion of the thermal actuator resulting in liquid drop emission.

35. The method of claim 34 wherein the first electrical pulse has a time duration of $\tau_{P1}$, where $\tau_{P1}<\frac{1}{2}\tau_B$, and the second electrical pulse has a time duration of $\tau_{P2}$, where $\tau_{P2}<\frac{1}{2}\tau_B$.

36. The method of claim 34 wherein parameters of the first electrical pulse and second electrical pulses, and the time $\tau_{W1}$, are adjusted to change a characteristic of the liquid drop emission.

* * * * *

UNITED STATES PATENT AND TRADEMARK OFFICE

CERTIFICATE OF CORRECTION

PATENT NO. : 7,029,101 B2
APPLICATION NO. : 10/953398
DATED : April 18, 2006
INVENTOR(S) : Christopher N. Delametter et al.

It is certified that error appears in the above-identified patent and that said Letters Patent is hereby corrected as shown below:

| | |
|---|---|
| Column 45, claim 12, line 48 | Please replace "$\Delta T_{1b}$" with --$\Delta T_{2b}$-- |

Signed and Sealed this

Twelfth Day of September, 2006

JON W. DUDAS
*Director of the United States Patent and Trademark Office*